US009593870B2

(12) United States Patent
Boarman et al.

(10) Patent No.: US 9,593,870 B2
(45) Date of Patent: Mar. 14, 2017

(54) REFRIGERATOR WITH THERMOELECTRIC DEVICE FOR ICE MAKING

(71) Applicant: Whirlpool Corporation, Benton Harbor, MI (US)

(72) Inventors: Patrick J. Boarman, Evansville, IN (US); Brian K. Culley, Evansville, IN (US); Gregory G. Hortin, Henderson, KY (US); Mark E. Thomas, Corydon, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 531 days.

(21) Appl. No.: 13/691,966

(22) Filed: Dec. 3, 2012

(65) Prior Publication Data

US 2014/0150460 A1 Jun. 5, 2014

(51) Int. Cl.

| | |
|---|---|
| ***F25B 21/02*** | (2006.01) |
| ***F25C 5/18*** | (2006.01) |
| ***F25D 21/14*** | (2006.01) |
| *F25D 17/06* | (2006.01) |

(52) U.S. Cl.

CPC ..... *F25B 21/02* (2013.01); *F25C 5/185* (2013.01); *F25D 21/14* (2013.01); *F25B 2321/0251* (2013.01); *F25C 2400/10* (2013.01); *F25C 2400/14* (2013.01); *F25D 17/065* (2013.01); *F25D 2317/0413* (2013.01)

(58) Field of Classification Search

CPC .. F25B 21/02; F25B 21/04; F25B 2321/0251; F25C 5/185; F25C 5/08; F25D 17/065

USPC ..... 62/3.63

See application file for complete search history.

(56) References Cited

U.S. PATENT DOCUMENTS

| | | | |
|---|---|---|---|
| 2,513,823 | A | 7/1950 | Shreve |
| 2,940,276 | A | 6/1960 | Loewenthal et al. |
| 3,075,360 | A | 1/1963 | Elfving |
| 3,100,970 | A | 8/1963 | Elfving |

(Continued)

FOREIGN PATENT DOCUMENTS

| | | | |
|---|---|---|---|
| CN | 2757045 | Y | 2/2006 |
| DE | 102010001465 | A1 | 8/2011 |

(Continued)

OTHER PUBLICATIONS

EP Search Opinion, EP2738483, Dated Feb. 2, 2015.

(Continued)

*Primary Examiner* — Orlando E Aviles Bosques

(57) ABSTRACT

An apparatus that has a housing with an icemaker disposed within the housing is disclosed. The icemaker includes an ice mold. A thermoelectric device is provided having a warm side and an opposite cold side. The cold side is thermally coupled to the icemaker. A flow pathway is configured in communication with the warm side of the thermoelectric device. A heat carrier is communicated through the flow pathway. The heat carrier transfers heat from the warm side of the thermoelectric device to support operations of the apparatus. The apparatus may be configured as a refrigerator wherein the refrigerator is configured to transfer the heat carrier from the warm side of the thermoelectric device to a compartment of the refrigerator.

6 Claims, 38 Drawing Sheets

(56) References Cited

U.S. PATENT DOCUMENTS 3,146,601 A 9/1964 Gould
3,192,726 A 7/1965 Newton
3,200,600 A 8/1965 Elfving
3,237,415 A 3/1966 Newton
3,332,807 A 7/1967 Boehmer
3,775,992 A 12/1973 Bright
3,828,568 A 8/1974 Frazier
3,850,008 A 11/1974 Frazier
4,003,214 A 1/1977 Schumacher
4,193,271 A 3/1980 Honigsbaum
4,251,996 A 2/1981 Esformes
4,286,438 A * 9/1981 Clarke ..... F25B 41/04 62/208
4,448,032 A 5/1984 Hibino et al.
4,487,024 A 12/1984 Fletcher
4,487,032 A 12/1984 Speicher
4,727,720 A 3/1988 Wernicki
4,733,539 A 3/1988 Josten
4,831,840 A 5/1989 Fletcher
4,848,102 A 7/1989 Stanfill
4,897,099 A 1/1990 Ruff
4,916,921 A 4/1990 Fletcher
4,938,030 A 7/1990 Josten
4,941,902 A 7/1990 Ruff
4,947,653 A 8/1990 Day
4,982,574 A 1/1991 Morris, Jr.
4,998,417 A 3/1991 Ruff
5,011,524 A 4/1991 Ruff
5,013,344 A 5/1991 Ruff
5,032,157 A 7/1991 Ruff et al.
5,103,653 A 4/1992 Ruff
5,123,948 A 6/1992 Ruff
5,207,761 A 5/1993 Ruff
5,212,957 A 5/1993 Ruff
5,218,830 A 6/1993 Martineau
5,237,832 A 8/1993 Alston
5,372,014 A 12/1994 Adams
5,385,032 A 1/1995 Martin
5,497,629 A 3/1996 Rafalovich
5,505,046 A 4/1996 Nelson
5,598,716 A 2/1997 Tanaka
5,666,817 A 9/1997 Schulak
5,690,849 A 11/1997 DeVilbiss
5,794,452 A 8/1998 Black
5,816,060 A 10/1998 Brownell
5,964,101 A 10/1999 Schulak
6,003,319 A 12/1999 Gilley
6,094,918 A 8/2000 Burbidge
6,112,543 A 9/2000 Feuerecker
6,145,324 A 11/2000 Dolezal
6,148,624 A 11/2000 Bishop
6,230,514 B1 5/2001 Schulak
6,293,107 B1 9/2001 Kitagawa et al.
6,327,871 B1 12/2001 Rafalovich
6,401,461 B1 6/2002 Harrison
6,408,633 B1 6/2002 Carr
6,412,286 B1 7/2002 Park et al.
6,463,755 B2 10/2002 Schulak
6,735,959 B1 5/2004 Najewicz
6,820,433 B2 11/2004 Hwang
6,837,067 B2 1/2005 Lee
6,908,163 B1 6/2005 Hebeler et al.
6,951,113 B1 10/2005 Adamski
7,000,407 B2 2/2006 Mioza
7,089,756 B2 8/2006 Hu
7,188,479 B2 3/2007 Anselmino
7,216,490 B2 5/2007 Joshi
7,240,510 B2 7/2007 Lee
7,246,496 B2 * 7/2007 Goenka ..... B60H 1/004 136/204
7,269,960 B2 9/2007 Elsom
7,278,269 B2 10/2007 Pham
7,278,569 B2 10/2007 Cohen
7,284,379 B2 10/2007 Pham
7,310,953 B2 12/2007 Pham
7,392,665 B2 7/2008 Lee
7,520,139 B2 4/2009 Kim
7,591,141 B2 9/2009 Wetekamp
7,610,773 B2 11/2009 Rafalovich
7,654,105 B2 2/2010 Lee
7,681,406 B2 3/2010 Cushman et al.
7,726,148 B2 6/2010 Martin
7,752,852 B2 7/2010 Akei
7,762,101 B1 7/2010 Zuili
7,870,745 B2 1/2011 Goenka
7,942,018 B2 5/2011 Niu
8,037,697 B2 10/2011 LeClear
8,042,355 B2 10/2011 Cur
8,061,153 B2 11/2011 Cur
8,099,975 B2 1/2012 Rafalovich
8,240,159 B2 8/2012 Prabhakar et al.
2002/0121096 A1 9/2002 Harrison
2003/0029174 A1 2/2003 Lee
2004/0012314 A1 1/2004 Hay et al.
2006/0096310 A1 * 5/2006 Lee ..... 62/348
2006/0168983 A1 8/2006 Tatsui
2006/0260325 A1 11/2006 Lin
2006/0260333 A1 11/2006 Wetekamp
2006/0260345 A1 * 11/2006 Coulter ..... F25D 11/02 62/340
2006/0260350 A1 11/2006 Van Meter
2006/0266059 A1 11/2006 Wetekamp et al.
2007/0051127 A1 3/2007 McMillin
2007/0180839 A1 8/2007 Kim
2007/0261431 A1 11/2007 Cohen
2008/0041066 A1 2/2008 Luo
2008/0059003 A1 3/2008 Doberstein et al.
2008/0072610 A1 3/2008 Venkatakrishnan
2008/0141699 A1 6/2008 Rafalovich et al.
2008/0155993 A1 7/2008 Kuehl
2008/0156009 A1 7/2008 Cur
2008/0156028 A1 7/2008 Cur
2008/0156030 A1 7/2008 Cur
2008/0156031 A1 7/2008 Cur
2008/0156032 A1 7/2008 Cur
2008/0156033 A1 7/2008 Cur
2008/0156034 A1 7/2008 Cur
2009/0031750 A1 2/2009 Whillock
2009/0049858 A1 2/2009 Lee
2009/0133409 A1 5/2009 Chen
2000/9015892 6/2009 Wu
2009/0151375 A1 6/2009 Tarr
2009/0158767 A1 6/2009 McMillin
2009/0158768 A1 6/2009 Rafalovich
2009/0165491 A1 7/2009 Rafalovich
2009/0260371 A1 * 10/2009 Kuehl ..... F25B 25/005 62/79
2009/0282844 A1 11/2009 Rafalovich
2009/0302724 A1 12/2009 Allard et al.
2010/0018223 A1 1/2010 Sundhar
2010/0071384 A1 * 3/2010 Lu et al. ..... 62/3.2
2010/0115985 A1 5/2010 Mitchell
2010/0126185 A1 5/2010 Cho
2010/0138073 A1 6/2010 Tarr
2010/0147003 A1 6/2010 Ueda
2010/0147005 A1 6/2010 Watson
2010/0147007 A1 6/2010 Froelicher
2010/0147008 A1 6/2010 Watson
2010/0154458 A1 6/2010 Davis
2010/0242526 A1 9/2010 Junge
2010/0242530 A1 9/2010 Tindale
2010/0251730 A1 10/2010 Whillock, Sr.
2010/0326096 A1 12/2010 Junge
2010/0326112 A1 12/2010 Prabhakar
2011/0000237 A1 1/2011 Wetekamp
2011/0000238 A1 1/2011 Wetekamp
2011/0011119 A1 1/2011 Kuehl
2011/0094256 A1 4/2011 Song
2011/0100046 A1 5/2011 Choi
2011/0110706 A1 5/2011 Allard
2011/0113810 A1 5/2011 Mitchell
2011/0113811 A1 5/2011 Lee
2011/0162405 A1 7/2011 Jeong
2011/0162829 A1 7/2011 Xiang

(56) References Cited

U.S. PATENT DOCUMENTS

| | | | | |
|---|---|---|---|---|
| 2011/0203305 | A1 | 8/2011 | Schenk | |
| 2011/0219794 | A1 | 9/2011 | Shiba | |
| 2011/0232888 | A1 | 9/2011 | Sasaki | |
| 2011/0296863 | A1 | 12/2011 | Bergqvist | |
| 2011/0308259 | A1 | 12/2011 | Wray | |
| 2012/0031129 | A9 | 2/2012 | Tarr | |
| 2012/0047911 | A1 | 3/2012 | Bhavsar | |
| 2012/0047918 | A1 | 3/2012 | Herrera | |
| 2012/0055191 | A1 | 3/2012 | Lee | |
| 2012/0090346 | A1* | 4/2012 | Mitchell et al. | 62/340 |
| 2012/0118001 | A1 | 5/2012 | Mitchell | |
| 2012/0151940 | A1 | 6/2012 | Uratani | |
| 2012/0167596 | A1 | 7/2012 | Krause et al. | |

FOREIGN PATENT DOCUMENTS

| | | | |
|---|---|---|---|
| DE | 102010042080 | A1 | 4/2012 |
| EP | 0171140 | A3 | 12/1986 |
| EP | 1253387 | A1 | 10/2002 |
| EP | 1441188 | A1 | 7/2004 |
| EP | 1517103 | A2 | 3/2005 |
| EP | 1684036 | A2 | 7/2006 |
| EP | 1821051 | A1 | 8/2007 |
| EP | 2144023 | A1 | 4/2008 |
| EP | 2322887 | A2 | 5/2011 |
| EP | 2444761 | A2 | 4/2012 |
| GB | 839337 | | 8/1957 |
| GB | 1244831 | | 9/1971 |
| GB | 2453515 | A | 4/2009 |
| JP | 11023135 | A | 1/1999 |
| JP | 2000121218 | A | 4/2000 |
| JP | 2000161835 | A | 6/2000 |
| JP | 2003227673 | A | 8/2003 |
| JP | 2006084135 | A | 3/2006 |
| JP | 2007255804 | A | 10/2007 |
| KR | 627911 | B1 | 9/2006 |
| KR | 20110064738 | A | 6/2011 |
| WO | 2008130712 | A1 | 10/2008 |
| WO | 2009025448 | A1 | 2/2009 |
| WO | 2009072745 | A2 | 6/2009 |
| WO | 2009078562 | A1 | 6/2009 |
| WO | 2010058888 | A2 | 5/2010 |
| WO | 2011124440 | A1 | 10/2011 |

OTHER PUBLICATIONS

EP Search Opinion, EP2738484, Dated Feb. 23, 2015.
EP Search Opinion, EP2738485, Dated Feb. 2, 2015.
EP Search Opinion, EP2738496, Dated Feb. 2, 2015.
EP Search Opinion, EP2738497, Dated Feb. 2, 2015.
DE102010042080 Machine Translation from Espacenet.
DE102010001465 Machine Translation from Espacenet.
Vian, J. et. al, "Development of a Thermoelectric Ice Maker of Fingers Incorporated into a Static Domestic Refrigerator", 5th European Conference on Thermoelectrics, Sep. 10, 2007, pp. 1-6.
European Patent Office, "European Search Report," issued in connection with European Patent Application No. 13173609.2, mailed Aug. 29, 2016, 8 pages.
European Patent Office, "European Search Report," issued in connection with European Patent Application No. 13182465.8, mailed Dec. 2, 2016, 9 pages.
European Patent Office, "European Search Report," issued in connection with European Patent Application No. 13188928.9, mailed Dec. 2, 2016, 8 pages.
European Patent Office, "European Search Report," issued in connection with European Patent Application No. 13188925.5, mailed Dec. 14, 2016, 9 pages.
European Patent Office, "European Search Report," issued in connection with European Patent Application No. 13188923.0, mailed Dec. 14, 2016, 12 pages.

* cited by examiner

REFRIGERATOR WITH THERMOELECTRIC DEVICE FOR ICE MAKING

CROSS-REFERENCE TO RELATED APPLICATIONS

U.S. patent application Ser. No. 13/691,874, titled Refrigerator With Icemaker Chilled By Thermoelectric Device Cooled By Fresh Food Compartment Air, Boarman et al., filed on Dec. 3, 2012, the same day as the present application.

U.S. patent application Ser. No. 13/691,919, titled Refrigerator With Icemaker Chilled By Thermoelectric Device Cooled By Fresh Food Compartment Air, Boarman et al., filed on Dec. 3, 2012, the same day as the present application.

U.S. patent application Ser. No. 13/691,883, titled Refrigerator With Ice Mold Chilled By Air Exchange From Freezer Compartment, Boarman et al., filed on Dec. 3, 2012, the same day as the present application.

U.S. patent application Ser. No. 13/691,878, titled On-Door Ice Maker Cooling, filed on Dec. 3, 2012, the same day as the present application.

U.S. patent application Ser. No. 13/691,948, titled Modular Cooling and Low Energy Ice, Boarman, filed on Dec. 3, 2012, the same day as the present application.

U.S. patent application Ser. No. 13/691,903, titled Modular Cooling and Low Energy Ice, Boarman, filed on Dec. 3, 2012, the same day as the present application.

U.S. patent application Ser. No. 13/691,890, titled Low Energy Refrigerator Heat Source, Boarman, filed on Dec. 3, 2012, the same day as the present application.

U.S. patent application Ser. No. 13/691,885, titled Convertible Ice Storage, Boarman et al., filed on Dec. 3, 2012, the same day as the present application.

U.S. patent application Ser. No. 13/691,882, titled Fresh Ice, Boarman, filed on Dec. 3, 2012, the same day as the present application.

U.S. patent application Ser. No. 13/691,898, titled Custom Bin Interface, Boarman, filed on Dec. 3, 2012, the same day as the present application.

U.S. patent application Ser. No. 13/691,887, titled Refrigerator Providing Air Flow To Door, Boarman et al., filed on Dec. 3, 2012, the same day as the present application.

U.S. patent application Ser. No. 13/691,893, titled Custom Location Ice Maker, Boarman et al., filed on Dec. 3, 2012, the same day as the present application.

U.S. patent application Ser. No. 13/691,877, titled Refrigerator With Icemaker Chilled By Thermoelectric Device Cooled By Fresh Food Compartment Air, Boarman et al., filed on Dec. 3, 2012, the same day as the present application.

U.S. patent application Ser. No. 13/691,908, titled Refrigerator With Ice Mold Chilled by Fluid Exchange from Thermoelectric Device with Cooling From Fresh Food Compartment or Freezer Compartment, Boarman et al., filed on Dec. 3, 2012, the same day as the present application.

U.S. patent application Ser. No. 13/691,916, titled Refrigerator With Thermoelectric Device Control Process for An Ice Maker, Boarman et al., filed on Dec. 3, 2012, the same day as the present application.

U.S. patent application Ser. No. 13/646,901, titled Refrigerator with Wet Ice Storage, Boarman et al., filed Oct. 8, 2012.

U.S. patent application Ser. No. 13/617,493, titled Phase Change-Application for Refrigerator and Ice Making, Boarman, filed Sep. 14, 2012.

U.S. patent application Ser. No. 13/594,030, titled Integrated Icemaker Pump, Boarman et al., filed Aug. 24, 2012.

All of these applications are hereby incorporated by reference in their entirety as if set forth herein.

FIELD OF THE INVENTION

The invention relates generally to icemakers, and more particularly, but not necessarily to refrigerators with the icemaker located remotely from the freezer compartment.

BACKGROUND OF THE INVENTION

Numerous challenges and problems are involved in apparatuses which make ice and store ice, including refrigerators with ice makers. These include being able to sufficiently cool water in order to make ice as well as removing ice from an ice mold. These may also include storing the ice. Moreover, different environments may provide additional challenges in making ice such as when ice is made within a fresh food or refrigeration compartment of a refrigerator or when attempting to make ice in an energy efficient manner or when clear ice or wet ice is being made. What is needed are improved ways to address one or more of these challenges or problems.

SUMMARY OF THE INVENTION

According to one aspect, an apparatus having a housing and an icemaker disposed within the housing is disclosed. The icemaker includes an ice mold. A thermoelectric device is provided having a warm side and an opposite cold side. The cold side is thermally coupled to the icemaker. A flow pathway is configured in communication with the warm side of the thermoelectric device. A heat carrier is communicated through the flow pathway. The heat carrier transfers heat from the warm side of the thermoelectric device to support operations of the apparatus. The apparatus may be configured as a refrigerator wherein the refrigerator is configured to transfer the heat carrier from the warm side of the thermoelectric device to a compartment of the refrigerator.

According to another aspect, a refrigerator is disclosed. The refrigerator includes an icemaker having an ice mold and a thermoelectric device. The thermoelectric device has a cold side thermally coupled to the ice mold and a warm side. A supply pathway is provided for acquiring a heat carrier from a location remote from the icemaker. The supply pathway may be configured in communication with the warm side of the thermoelectric device.

According to another aspect, a method for warming or cooling in an apparatus is disclosed. The method includes providing a housing, an icemaker disposed within the housing, and an ice mold within the icemaker. A thermoelectric device may be thermally coupled to the icemaker. The thermoelectric device has a heat flow across its opposing sides. A pathway may be configured in communication with a side of the thermoelectric device for moving a heat carrier through the pathway from a location separate from the thermoelectric device. The heat flow from the side of the thermoelectric device is either absorbed or rejected by the heat carrier for supporting operations of the apparatus.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENTS

Figure 1A:
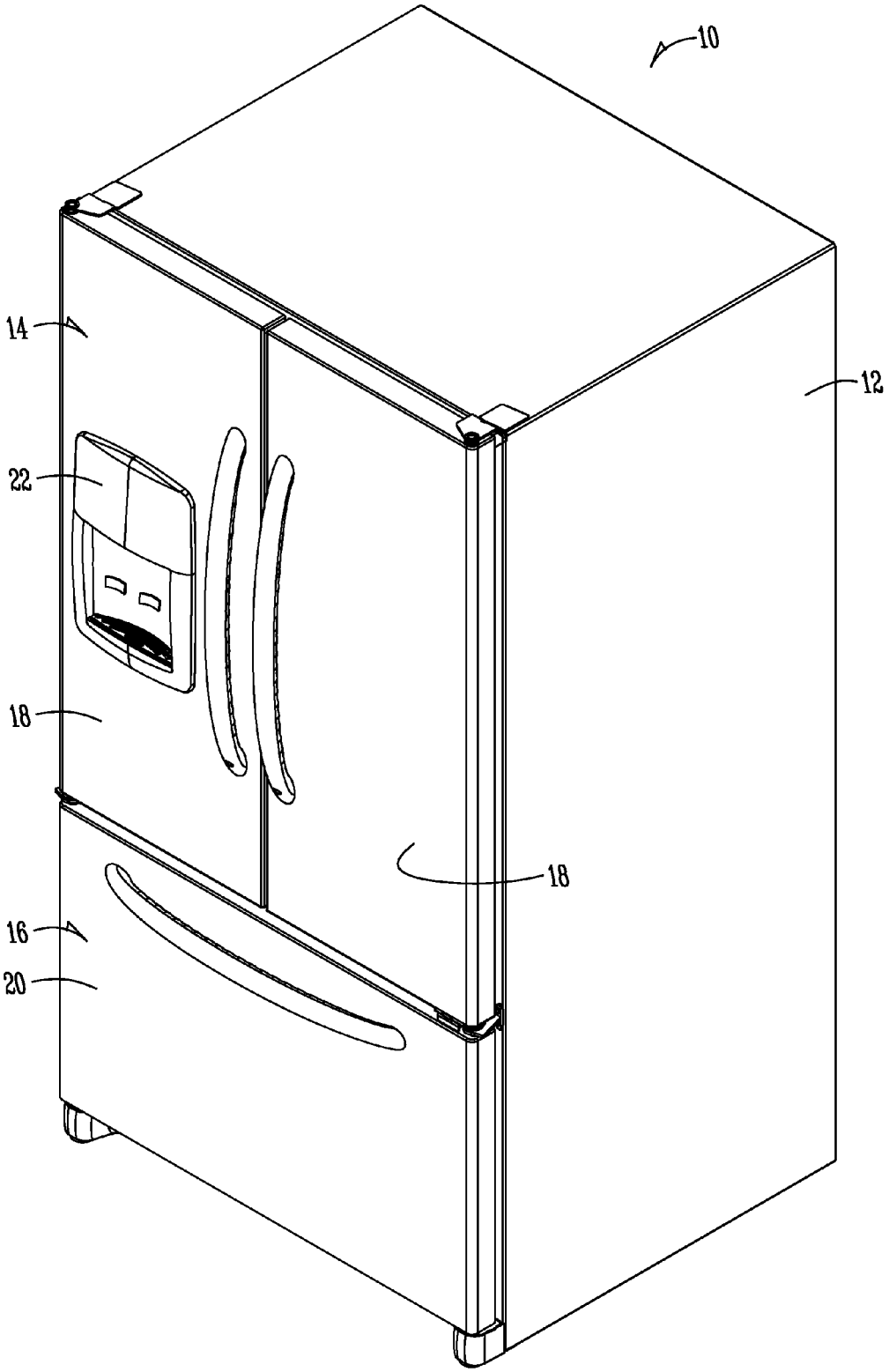
FIG. 1A is a perspective view of a refrigerator according to one exemplary configuration.

By way of illustration, FIGS. 1-8 provide exemplary features, aspects and embodiments for a refrigerator 10. The refrigerator 10 includes a cabinet body 12 with a refrigerator compartment or fresh food compartment 14 selectively closeable by a refrigerator compartment door 18 and a freezer compartment 16 selectably closeable by a freezer compartment door 20. A dispenser 22 is included on the refrigerator compartment door 18 for providing dispensions of liquid and/or ice at the refrigerator compartment door 18. Although one particular design of a refrigerator 10 is shown in FIG. 1A and replicated throughout the various figures, other refrigerator styles and configurations are contemplated. For example, the refrigerator 10 could be a side-by-side refrigerator, a refrigerator with the freezer compartment positioned above the refrigerator compartment (top-mount refrigerator), a refrigerator with the freezer compartment positioned beneath the refrigerator compartment (bottom-mount refrigerator), a refrigerator that includes only a refrigerator or fresh food compartment and no freezer compartment, etc. In the figures is shown a bottom-mount refrigerator 10 where the freezer compartment 16 is located below the refrigerator compartment 14. The various exemplary concepts and configurations shown and described may also be incorporated into other refrigerated platforms or applications. For example, a water dispenser/cooler 10 (See FIG. 1B), a countertop dispenser 10 (See FIG. 1C), an under-counter dispenser 10 (See FIG. 1D) may be configured with one or more of the disclosed exemplary aspects.

Figure 2:
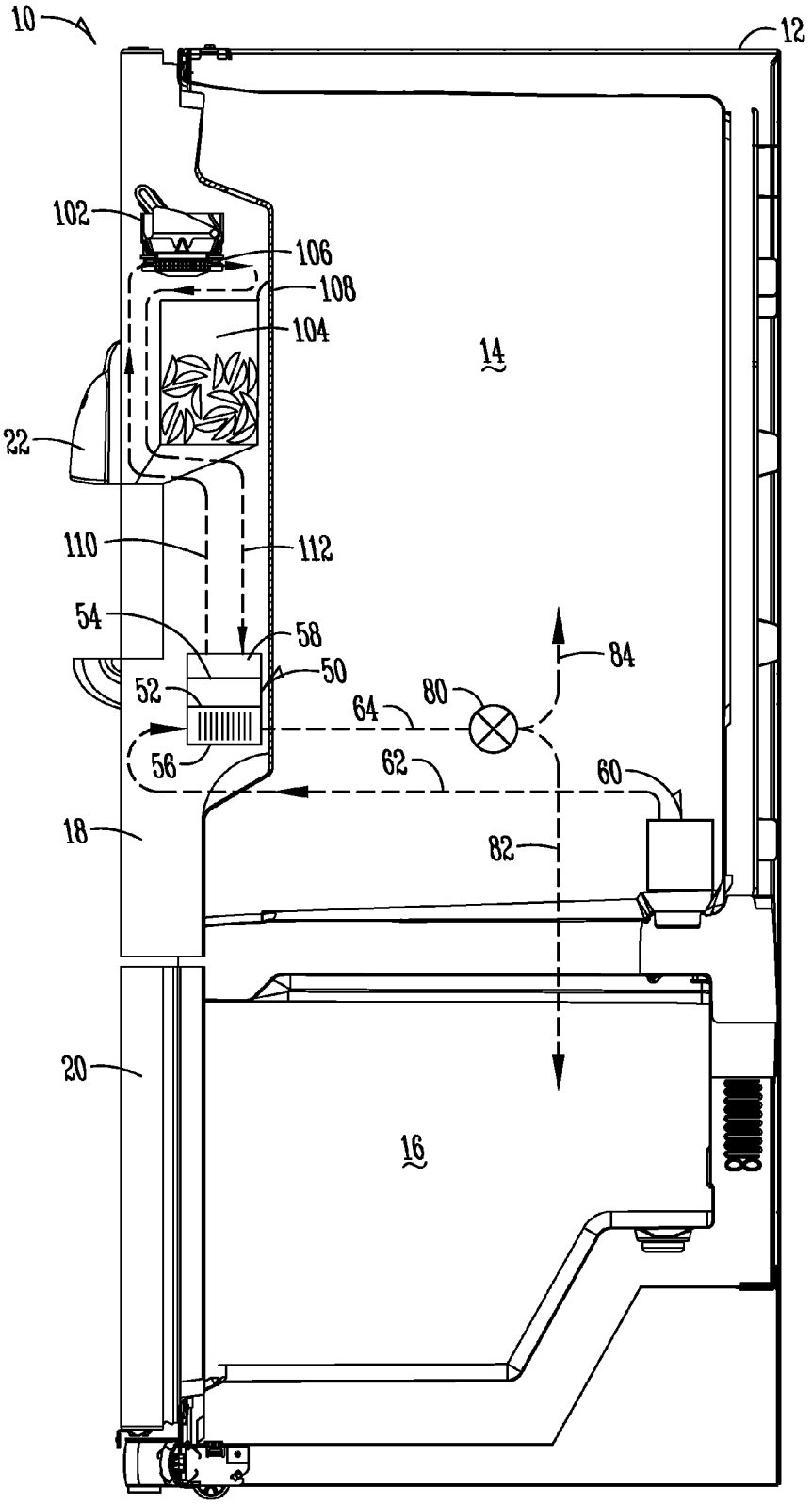
FIG. 2 is a side elevation showing a sectional of an exemplary configuration for a refrigerator such as shown in FIG. 1A.
Figure 3:
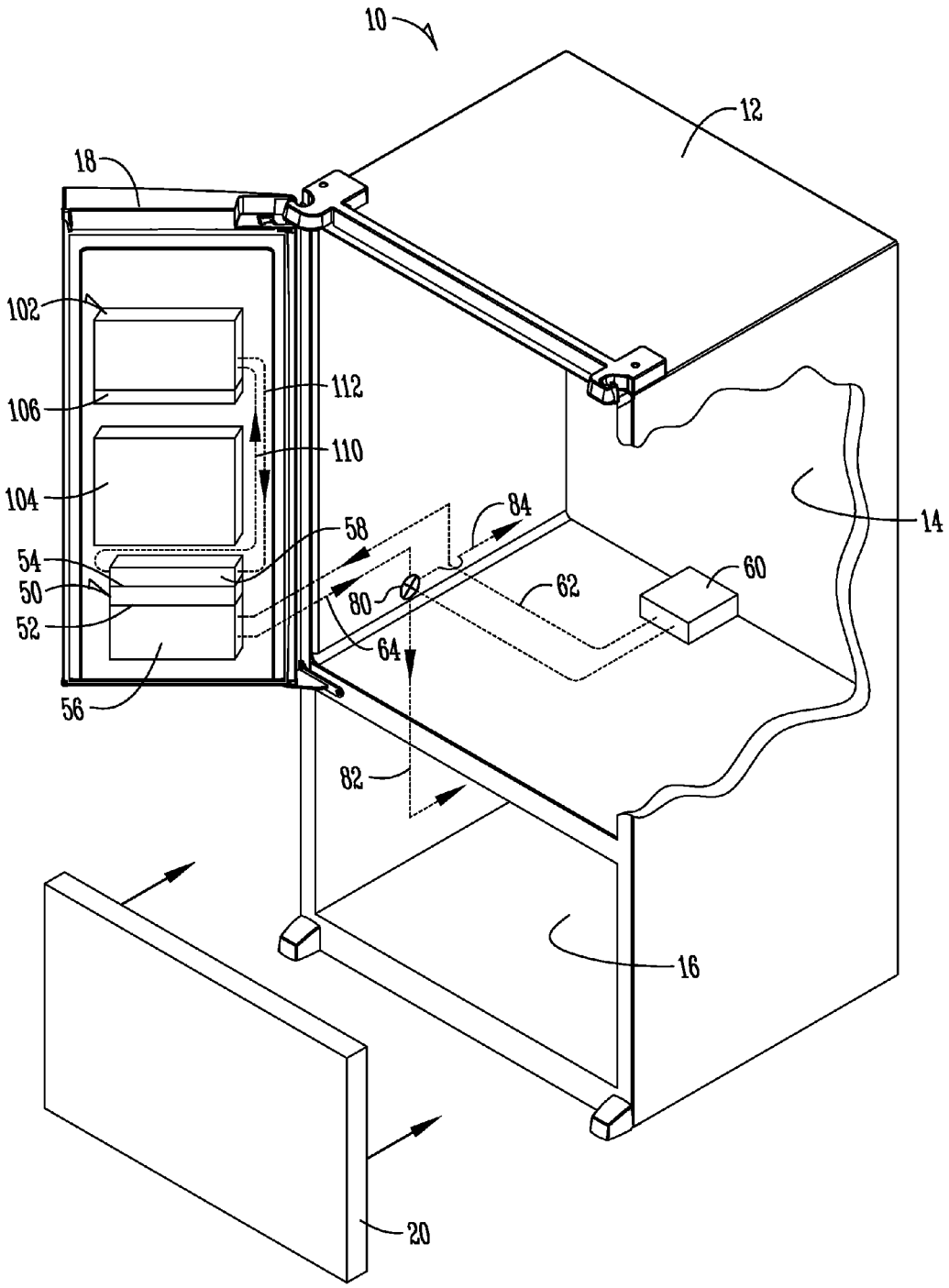
FIG. 3 is a perspective view with a cutaway for illustrating various exemplary aspects configured on a door and compartment of a refrigerator.

Several aspects of the disclosure are illustrated in the sectional and cutout views of refrigerator 10 shown in FIGS. 2 and 3, and replicated throughout the several other views. In connection with the dispenser 22 on the cabinet body 12 of the refrigerator 10, such as for example on the refrigerator compartment door 18, is an icemaker 102 having an ice mold 106 for extracting heat from liquid within the ice mold to create ice which is dispensed from the ice mold 106 into an ice storage bin 104. The ice is stored in the ice storage bin 104 until dispensed from the dispenser 22. The ice mold 106 or icemaker 102 may include a fluid sink (See, for example, fluid sink 156 in FIGS. 15 and 16) for extracting heat from the ice mold 106 using a fluid as the extraction medium. Aspects of the disclosure also contemplate that air may be used as the medium for carrying away heat from the ice mold 106. According to one aspect, a fluid supply pathway 110 is connected between the icemaker 102 and a thermoelectric device 50. A fluid return pathway 112 is also connected between the icemaker 102 and the thermoelectric device 50. The fluid supply pathway 110 and the fluid return pathway 112 together form a fluid loop connecting the icemaker 102 with the thermoelectric device 50. The fluid supply pathway 110 and fluid return pathway 112 could also be configured as air pathways (e.g., an air supply pathway and an air return pathway) connected between the icemaker 102 and thermoelectric device 50. The pathways 110, 112 may include a conduit, line, ductwork, or other enclosed flow path to facilitate the transfer of a heat carrying medium (e.g., fluid or air) between the icemaker 102 and the thermoelectric device 50. In one aspect of the disclosure, a fluid supply pathway 110 and a fluid return pathway 112 are connected to a fluid sink 58 positioned on the cold side 54 of the thermoelectric device 50. The fluid sink 58 provides a thermal transfer pathway between the fluid carrier and the cold side 54 of the thermoelectric device 50. The fluid in the line between the icemaker 102 and the thermoelectric device 50 may be a heat transfer fluid such as ethylene or propylene glycol. The fluid in the line between the icemaker 102 and the thermoelectric device 50 may be a heat transfer fluid such as ethylene or propylene glycol. As the fluid temperature may drop below freezing, it may be beneficial to use an anti-freeze, such as glycol, such that the fluid will not freeze when passing through the fluid pathways 110, 112. The fluid in the fluid pathways could also be water or other chemically altered fluid suitable for use in combination food.

The cold side 54 of the thermoelectric device 50 is kept generally at a temperature below the temperature required for making ice (e.g., temperatures near or below 0° Fahrenheit). Conversely, the warm side 52 of the thermoelectric device 50 is operated at a temperature of the desired temperature for the fluid used to cool the ice mold plus the operating delta for the thermoelectric device 50. For example, if the delta for the thermoelectric device 50 is 20° Fahrenheit, the warm side 52 of the thermoelectric device 50 must be kept at a temperature less than 52° Fahrenheit to maintain the cold side 54 of the thermoelectric device 50 at 32° Fahrenheit or below. An electrical current is provided to the thermoelectric device 50 which provides the necessary Peltier effect that creates a heat flux and provides a cold side 54 and warm side 52 during operation. To dissipate heat from the warm side 52 of the thermoelectric device 50, an air sink 56 is configured in operable thermal operation with the warm side 52 of the thermoelectric device 50. An air supply pathway 62 is connected between the air sink 56 and a fan 60 positioned within the refrigerator compartment 14 of the refrigerator 10. An air return pathway 64 is connected between the air sink 56 and the refrigerator compartment 14 and/or freezer compartment 16, wherein flow there through is selectably open and closed by operation of flow controller 80. In a typical refrigerator, the refrigerator compartment 14 is kept generally between 32° Fahrenheit and about 40° Fahrenheit. A fan 60 or other means (e.g., pump) for moving air through a ductwork or other channel is positioned within the refrigerator compartment 14 at a location such as adjacent the mullion that separates the refrigerator compartment 14 from the freezer compartment 16. Other embodiments are contemplated. For example, the fan 60 may be positioned within a mullion or sidewall of the cabinet body 12 of the refrigerator 10. Advantageously, positioning the fan 60 adjacent the horizontal mullion that separates the refrigerator compartment from the freezer compartment draws cooler air within the refrigerator compartment 14 given that the cooler air within the refrigerator compartment 14 is generally located closer to or adjacent the horizontal mullion that separates the refrigerator compartment 14 from the freezer compartment 16. The cool air may be ducted out of the refrigerator compartment 14 through an air supply pathway 62 using fan 60. The fan may also be positioned within the insulated compartment 108 on the refrigerator compartment door 18. The cool air pumped to the air sink 56 at the thermoelectric device 50 may be exhausted back into the refrigerator compartment 14 or into the freezer compartment 16. A flow controller 80 may be provided within the air return pathway 64 to direct flow through an air return pathway 84 that exhausts into the refrigerator compartment or an air return pathway 82 that exhausts into the freezer compartment 16. Aspects of the disclosure also contemplate that other pathways may be configured so that air from the air return pathway 64 is communicated to other locations within the cabinet body of the refrigerator 12. For example, the air within the air return pathway 64 may be communicated to a discreet (e.g., modulated space or bin), or desired space within the refrigerator compartment 14 or freezer compartment 16. A separate cabinet, bin or module within the freezer compartment 16 or refrigerator compartment 14 may be configured to receive air exhausted from the thermoelectric device 50 through the air return pathway 64. A junction may be provided in the air supply pathway 62 at the interface between the refrigerator compartment door 18 and the refrigerator compartment 14. The interface (not shown) between the refrigerator compartment 14 and refrigerator compartment door 18 is sealed and separated upon opening and closing the refrigerator compartment door 18. Alternatively, the air supply pathway 62 may be configured through another attachment or interface point of the refrigerator compartment door 18 such as a hinge point at a top or bottom portion of the door. Thus, cool air from the refrigerator compartment 14 is communicated through the air supply pathway 62 to the air sink 56 of the thermoelectric device 50. The air temperature in the refrigerator compartment 14 ranges generally between 32° Fahrenheit and about 40° Fahrenheit and the temperature on the cold side 54 of the thermoelectric device 50 ranges anywhere from about 32° Fahrenheit to 40° Fahrenheit minus the temperature delta of the thermoelectric device. Assuming the refrigerator compartment is set at 35° Fahrenheit and the thermoelectric device has a delta of 10 degrees, the cold side 54 of the thermoelectric device 50 would operate generally at 25° Fahrenheit. The liquid in the fluid supply pathway 110 is cooled generally then to the temperature of the cold side 54 of the thermoelectric device 50. Heat from the ice mold 106 is extracted and carried away from the icemaker 102 through the fluid return pathway 112. Depending upon the desired rate of production of ice, the flow rate of fluid through the fluid supply pathway 110 and the flow rate of air through the air supply pathway 62 may be controlled so that the warm side 52 and cold side 54 of the thermoelectric device 50 are kept at the desired operating temperatures so that ice production can be maintained at a desired rate of production by extracting heat from the ice mold 106 of the icemaker 102 at a rate that is capable of sustaining the desired level of ice production. The rate of operation for these various components may be controlled to use the least amount of energy necessary for keeping up with the desired rate of ice production.

Figure 4:
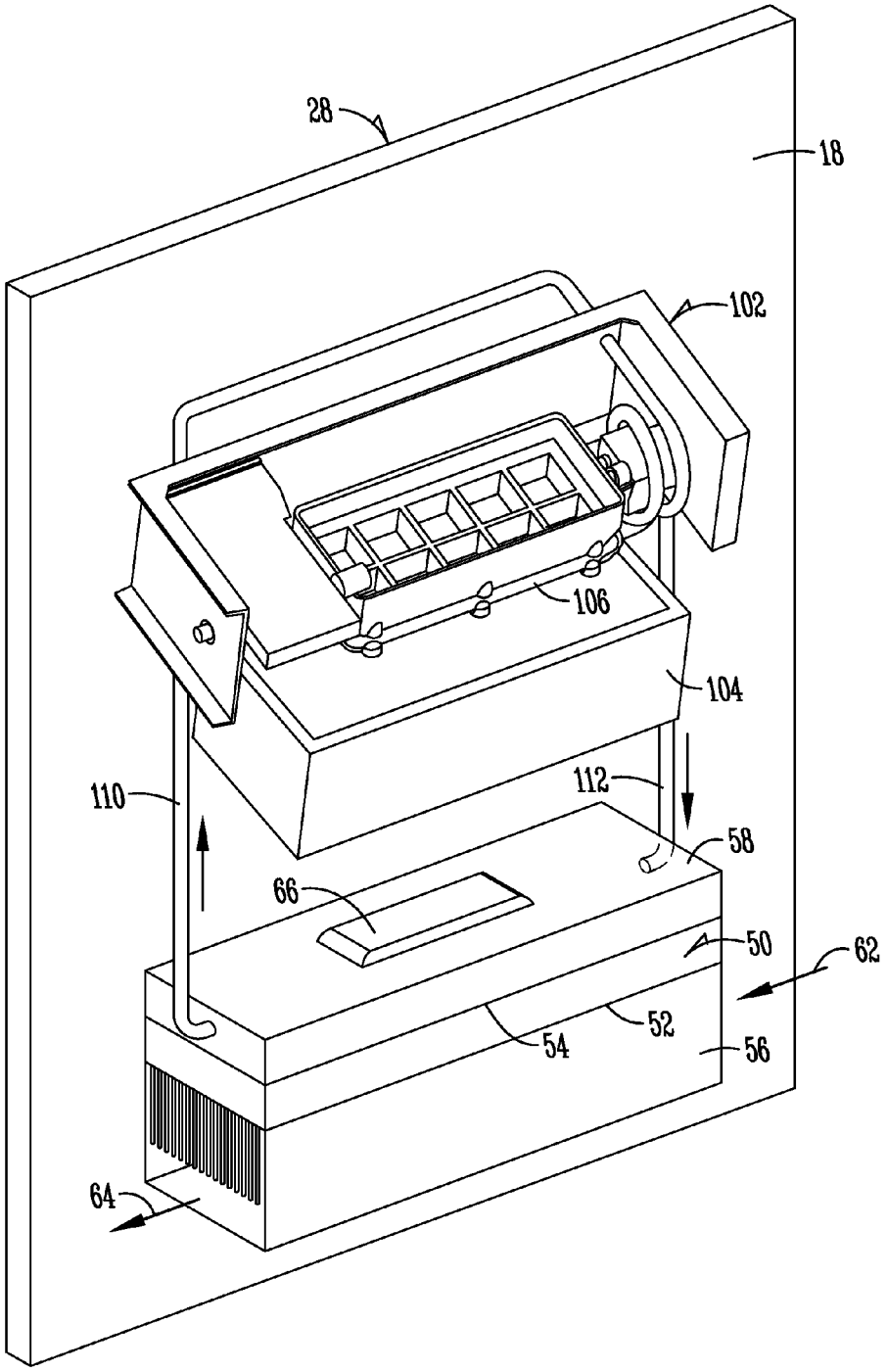
FIGS. 4-8 are perspective views of the inside of a door of a refrigerator configured to illustrate exemplary embodiments of the disclosure.

As illustrated in FIG. 4, the air sink 56 may include a plurality of fins to allow heat to be dissipated from the warm side 52 of the thermoelectric device 50 using air from the refrigerator compartment 14 to pass through the air supply pathway 62 and return to the refrigerator compartment or freezer compartment through the air return pathway 64. The fluid in the fluid supply pathway 110 and fluid return pathway 112 may be communicated through the fluid sink 58 and the ice mold 106 by actuation of a pump 66. The ice mold 106 may include a number of aqueducts or channels for passing fluid through for cooling the ice mold or extracting heat from the ice. Using fluid to cool the ice mold 106 allows various types of icemakers to be used, such as a flex-tray icemaker. The icemaker 102, ice storage bin 104, and thermoelectric device 50 may be mounted together in a configuration to form an icemaker module 28. The icemaker module 28 may be configured on the refrigerator compartment door 18 as shown in FIG. 4.

Figure 5:
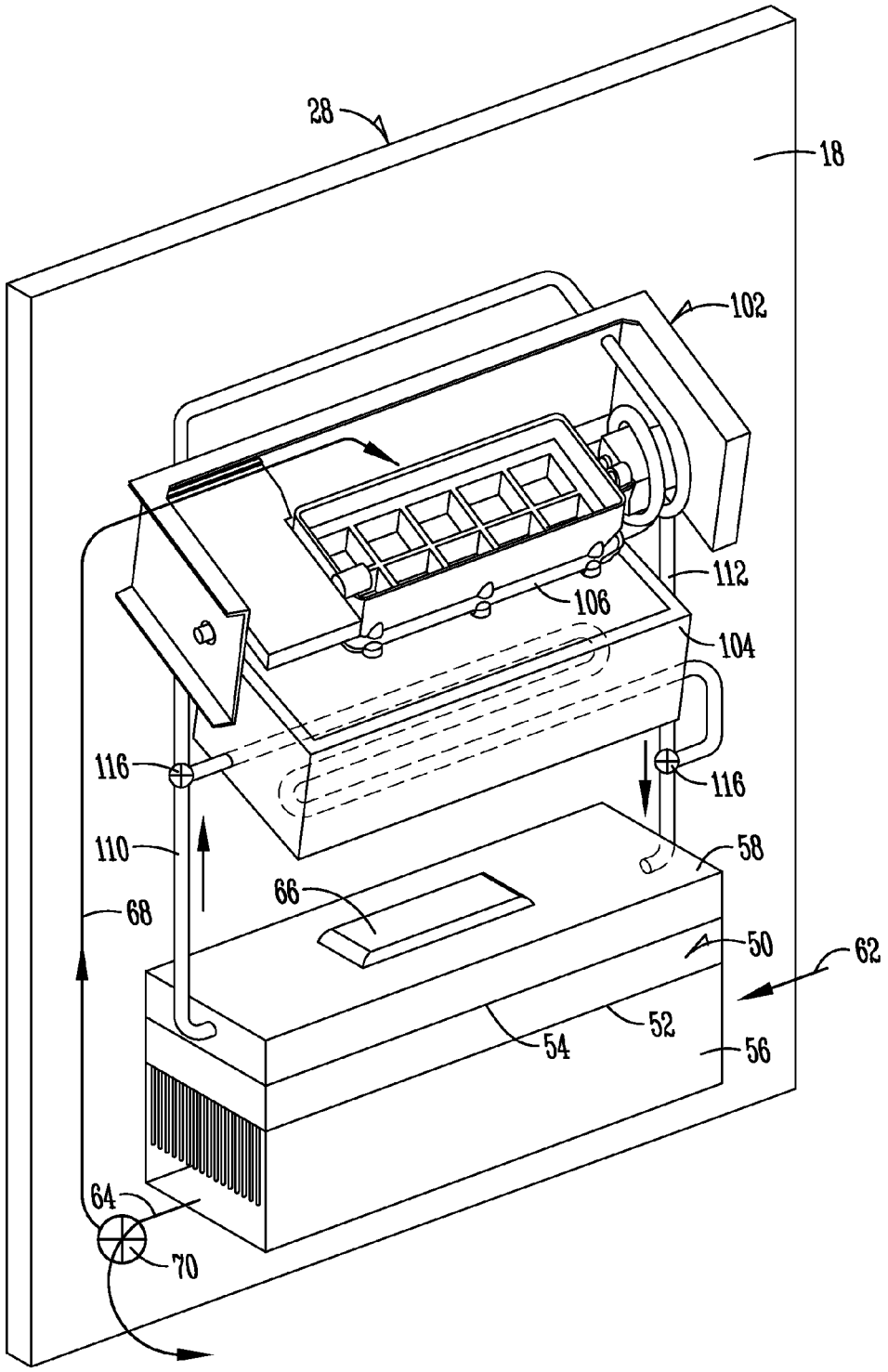

FIG. 5 illustrates other exemplary aspects for one or more configurations of the disclosure. The door illustrated in FIG. 5 may be a refrigerator compartment door 18 such as illustrated in FIGS. 1A, 2 and 3. The various components making up the icemaker module 28 (illustrated in FIG. 5) may be housed within an insulated compartment 108 such as illustrated in FIG. 2. As previously illustrated and described, the thermoelectric device 50 includes an air sink 56 configured to receive air through an air supply pathway 62 connected between the thermoelectric device 50 and a fan 60 in the refrigerator compartment 14 of the refrigerator 10. Air passing through the air sink 56 dissipates heat from the warm side 52 of the thermoelectric device 50. The warm air is communicated through an air return pathway 64 to the refrigerator compartment 14 and/or freezer compartment 16. A flow controller 70 may be configured in the air return pathway 64 for selectively controlling the flow of warm air there through. According to one aspect of the invention, warm air may be communicated through an air supply pathway 68 connected between the flow controller 70 and the ice maker 102. Ductwork or other channels of communication may be provided within the refrigerator compartment door 18 or within the insulated compartment 108 for communicating air between the flow controller 70 and the icemaker 102. Advantageously, during an ice harvesting cycle, warm air from the air sink 56 may be communicated through air supply pathway 68 to the ice mold 106 to assist in the ice harvesting process whereby the ice mold 106 is warmed to a temperature to create a thin fluid layer between the frozen ice and the side walls of the ice mold to allow each of the cubes to release from the ice mold during harvesting. One or more ducts or channels may be configured within the ice mold 106 to direct the flow of warm air within the air supply pathway 68 to specific regions or locations within the icemaker. The air supply pathway 68 may also be configured to communicate warm air through one or more ducts positioned adjacent to or in contact with the ice mold 106 for warming the ice mold 106 by convection or conduction.

In addition to cooling the ice mold 106, the fluid supply pathway 110 originating at the fluid sink 58 of the thermoelectric device 50 may be configured with a flow controller 116 for selectively communicating the cold fluid through the ice storage bin 104 (e.g., the sidewalls of the ice storage bin). For cooling the ice storage bin 104, a flow controller 116 may also be included in the fluid return pathway 112 for controlling liquid flow through the fluid return pathway 112 into the fluid sink 58. The flow controllers 116 may be operated to allow both cooling of the ice mold 106 and the ice storage bin 104 simultaneously to the extent the demand on the thermoelectric device 50 does not exceed its capabilities. Thus, the ability to extract heat using air from the refrigerator compartment for cooling the thermoelectric device 50 may be used to provide other cooling operations on the refrigerator compartment door as illustrated in FIG. 5.

Figure 6:
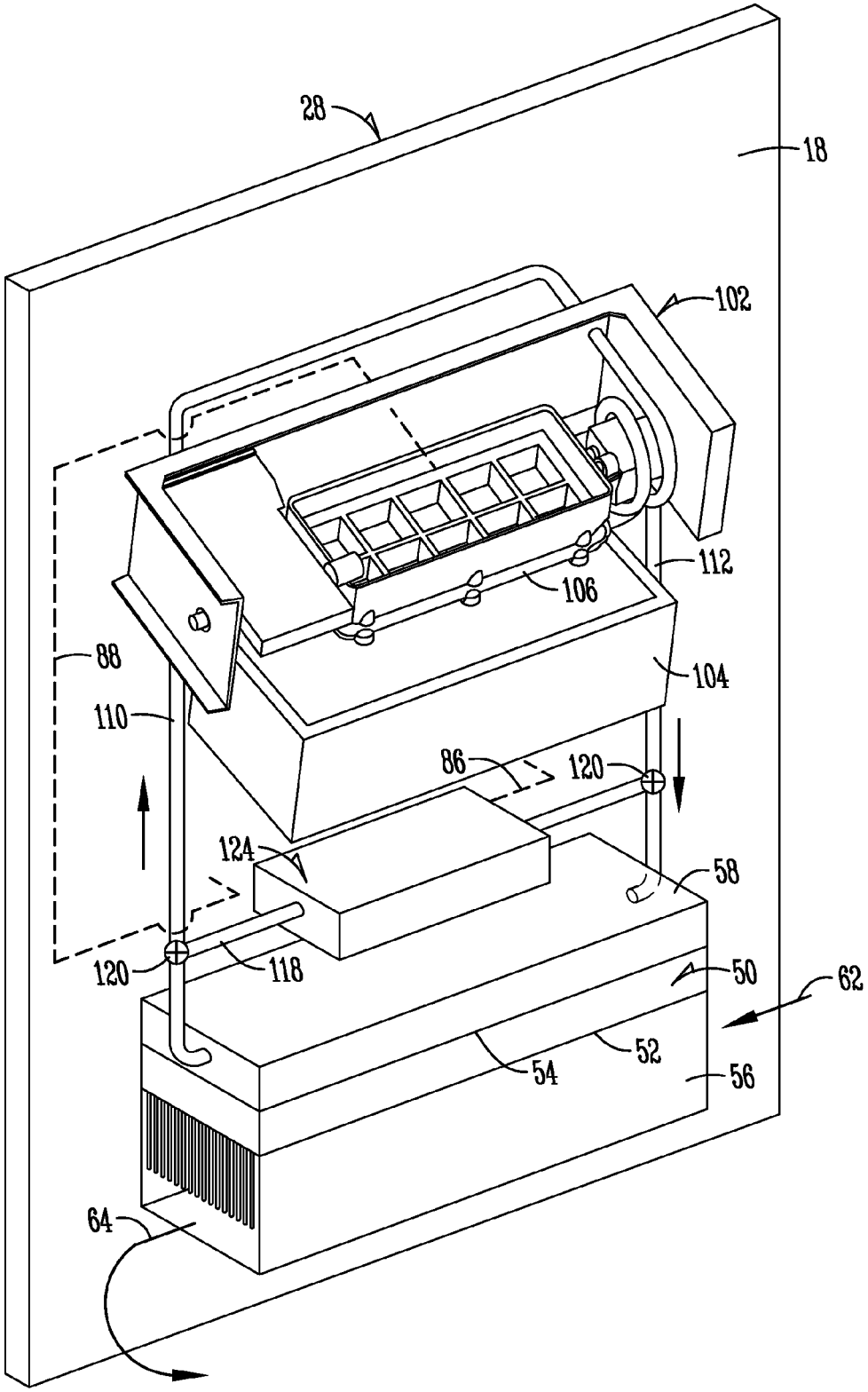

FIG. 6 illustrates another possible cooling application according to one exemplary configuration. In FIG. 6, both cooling and heating applications on, for example, a refrigerator compartment door 18 of a refrigerator 10 are disclosed. The cooling and heating applications may also be included as components or subcomponents of the icemaker module 28. As indicated previously, the thermoelectric device 50 has a warm side 52 and a cold side 54. The cold side is in thermal contact with the fluid sink 58 and the warm side is in thermal contact with the air sink 56. Reversing the polarity of the thermoelectric device 50 changes the warm side 52 to a cold side and the cold side 54 to a warm side. The thermoelectric device 50 may be operated in two modes, namely the mode illustrated in FIG. 6 and in a mode where the warm and cold sides are switched. In the mode illustrated in FIG. 6, the cold side 54 is in thermal contact with the fluid sink 58 and the warm side 52 is in thermal contact with the air sink 56. A fluid supply pathway 110 is connected between the icemaker 102 and the fluid sink 58. A flow controller 120 in the fluid supply pathway 110 is selectable between open and closed positions. A fluid supply pathway 118 is connected between the fluid supply pathway 110 and the fluid return pathway 112 by a flow controller 120. The fluid supply pathway 118 is connected to a warming or cooling application 124. Thus, the fluid supply pathway 110 may be used to supply cold fluid to the cooling application 124 via fluid supply pathway 118 by selectably changing the flow controller 120 in both the fluid supply pathway 110 and fluid return pathway 112. The warming or cooling application 124 may include a reservoir housing a body of liquid. The liquid in the reservoir may be supplied to the icemaker 102 through supply pathway 88 or supplied to the refrigerator 10 through supply pathway 86 for dispensing from the dispenser 22. Cooling liquid passed through the cooling application 124 cools the reservoir of liquid which may then be communicated to other applications, such as for example, applications on or remote from the refrigerator compartment door 18 that uses cool or chilled liquid. For example, the chilled liquid from the cooling application 124 may be communicated to the icemaker 102 for use in the ice mold 106 to reduce the amount of energy and time to make ice. If the cooling fluid within the fluid supply pathway 118 is at a temperature of 38 to 40 degrees Fahrenheit the water in the reservoir in the cooling application 124 may be cooled generally to the same temperature and communicated to the ice mold 106, which can reduce the amount of time and energy used to freeze the water. Cooling application 124 may also be used to cool water that is communicated to the dispenser 22 for dispensing cold water from the refrigerator 10. The chilled water may also be used to provide cooling within the refrigerator compartment 14 by communicating the chilled water across the door 18 into the compartment 14. For example, the chilled liquid may be used for controlling or assisting with the temperature control of a bin, drawer or other defined space. Reversing the polarity of the thermoelectric device 50 cools the air passing through the air return pathway 64 back to the refrigerator compartment 14 or freezer compartment 16 and warms the fluid sink 58. The fluid in the fluid supply pathway 118 may be then used to warm the water within the heating application 124. The warm water within the heating application 124 may be communicated to the dispenser 22 on the refrigerator 10 for dispensing warm water or may be used by the icemaker 102 for ice harvesting or for performing a wash, sanitizing or recycle of the ice mold 106. The warm water may also be communicated to the refrigerator compartment 14 across the door 18 for controlling or assisting with the temperature control of a drawer, bin, or other defined space within the refrigerator compartment 18.

Figure 7:
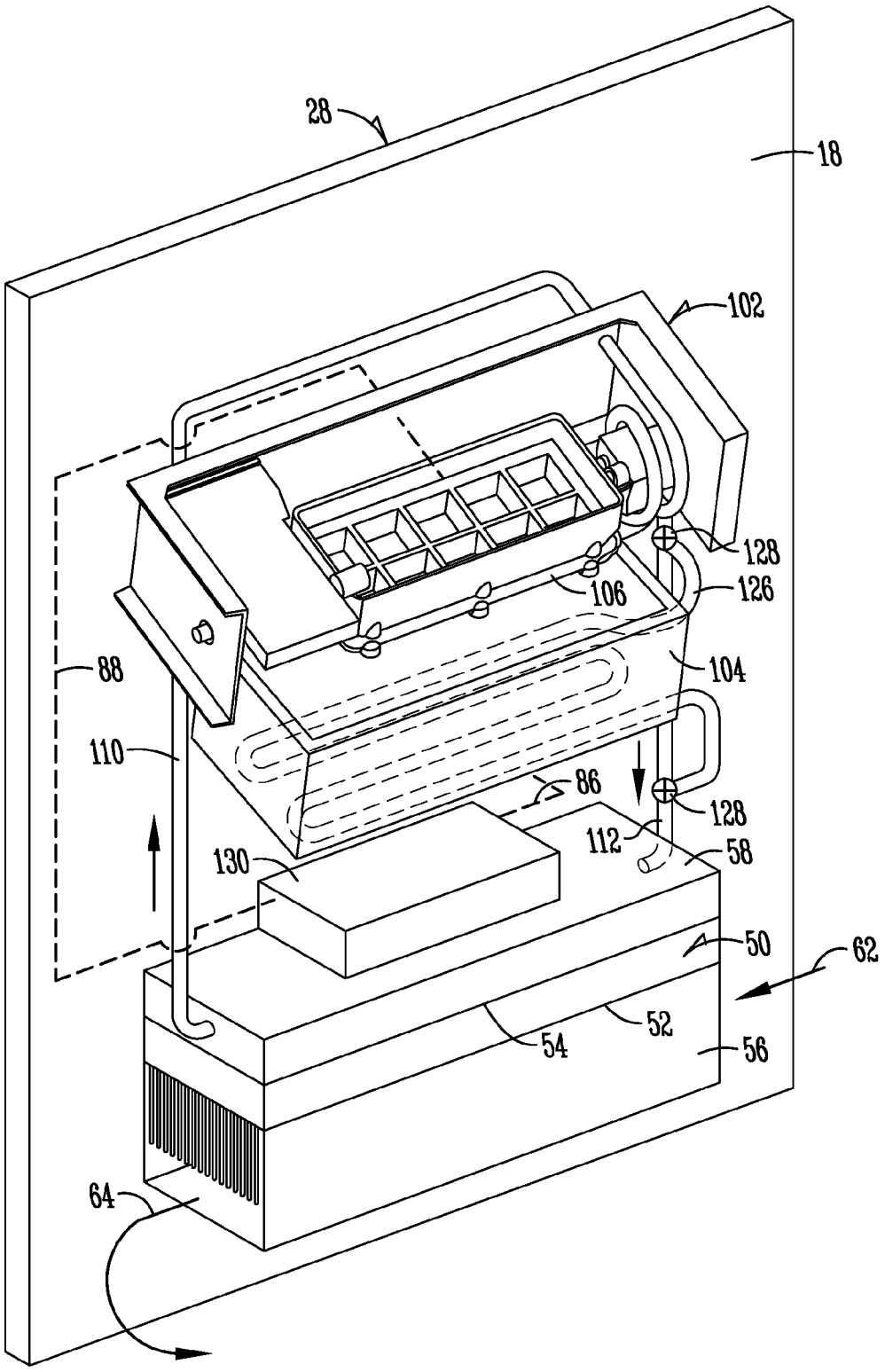

FIG. 7 illustrates another exemplary configuration contemplated by various aspects of the disclosure. The icemaker module 28 may be configured to include other applications in addition to those described above. As indicated previously, the thermoelectric device 50 may be used to support not only primary cooling applications but secondary and possibly tertiary cooling applications or heating applications. FIG. 7 illustrates another exemplary cooling application. As the fluid sink 58 is maintained at a temperature minus delta below the air temperature passing through the air supply pathway 62, the fluid sink 58 may be used to provide cooling to various applications, such as, on the door 18 of the refrigerator compartment 14. A reservoir 130, for example, may be provided for housing a body of water to be used for dispensing from the dispenser 22 or used in the icemaker 102 for making ice. Heat may be extracted from the reservoir 130 by placing the reservoir 130 in thermal contact with the fluid sink 58. A supply pathway 86 and 88 may be connected between the dispenser 22 and the reservoir 130 and the icemaker 102 and the reservoir 130 for providing chilled water to either or both. The chilled water may also be used to provide cooling within the refrigerator compartment 14 by communicating the chilled water across the door 18 into the compartment 14. For example, the chilled liquid may be used for controlling or assisting with the temperature control of a bin, drawer or other defined space. As previously indicated, the fluid return pathway 112 carries heat away from the ice mold 106. Beneficially, the heat carried in the fluid return pathway 112 may be used in the ice storage bin 104 for melting ice within the bin 104 for creating fresh or clear ice. A fluid supply pathway 126 may be configured within the ice storage bin 104 (e.g., within the walls of the ice storage bin) for warming the ice within the ice storage bin 104. The fluid supply pathway may be configured between flow controllers 128 which are selectably open and closed to allow or provide for warm fluid flow through the fluid supply pathway 126 within the ice storage bin 104. As the fluid passes through the fluid supply pathway 126 the ice within the ice storage bin 104 is warmed and begins to melt and thereby creates fresh ice. The fluid within the fluid supply pathway 126 is cooled and returned to the fluid sink 58 through the fluid return pathway 112. The fluid may also enter the fluid sink 58 from the fluid return pathway 112 at a temperature lower than the fluid that returns from the ice mold 106 during the ice making process. Thus, the thermoelectric device 50 requires less energy to cool the fluid in the fluid supply pathway 110. As with the warming application 124 shown in FIG. 6, the warmed water in the reservoir 130 may also be communicated to the refrigerator compartment 14 across the door 18 for controlling or assisting with the temperature control of a drawer, bin, or other defined space within the refrigerator compartment 18.

Figure 8:
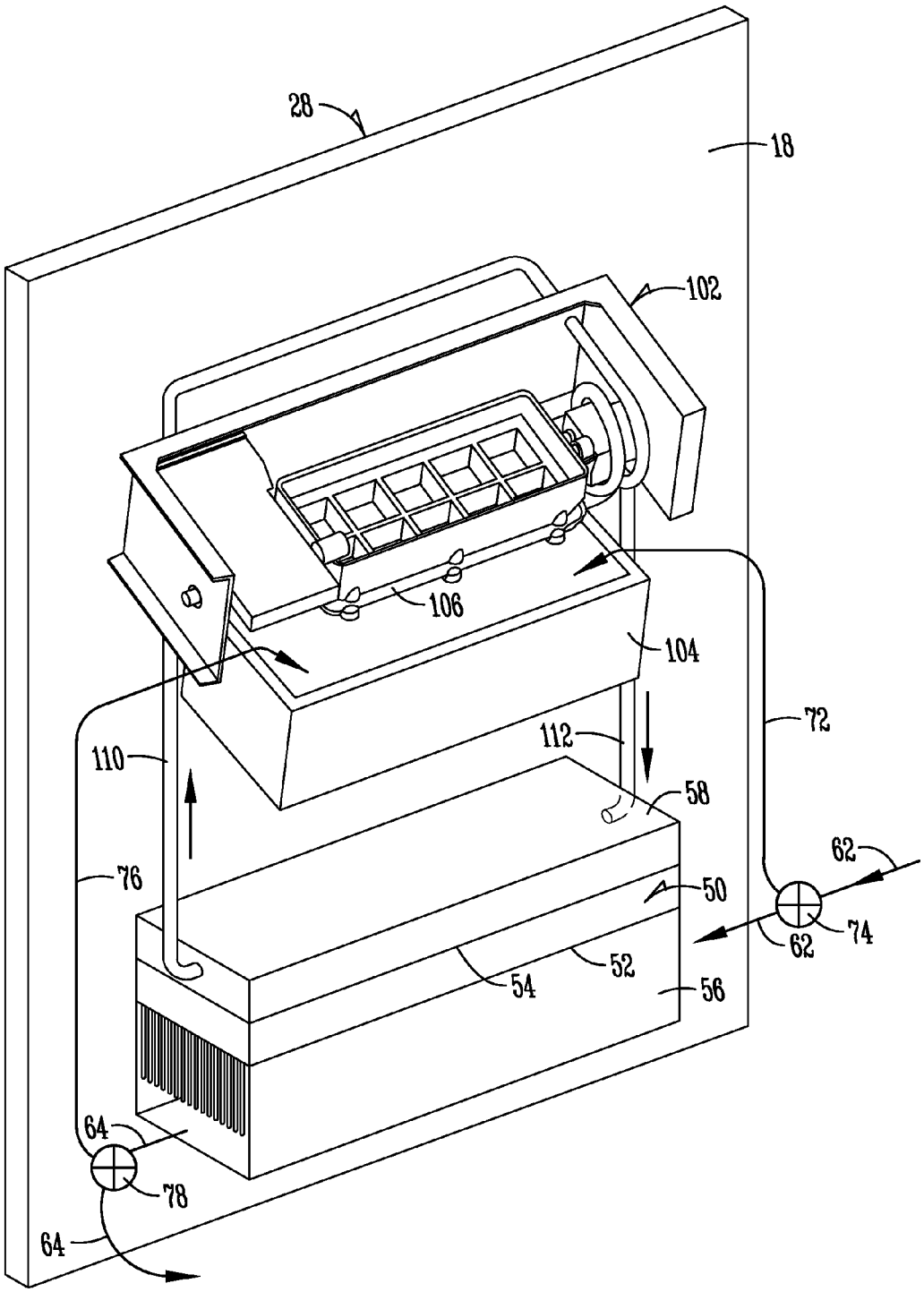

FIG. 8 illustrates another exemplary configuration for an aspect of the disclosure. As previously indicated, an air supply pathway 62 feeds air from the refrigerator compartment 14 to the thermoelectric device 50. According to one aspect of the invention, a flow controller 74 may be configured in the air supply pathway 62 for selectively controlling the flow of air through the pathway. The air in the air supply pathway 62 is generally at the temperature of the refrigerator compartment 14 (i.e., generally between 32° Fahrenheit and 40° Fahrenheit). An air supply pathway 72 may be configured between the ice storage bin 104 and the flow controller 74 whereby air from the refrigerator compartment may be communicated to the ice storage bin 104 for cooling the ice in the ice storage bin. Alternatively, a flow controller 78 may be included in the air return pathway 64 for selectively controlling the flow of air through an air supply pathway 76. The air supply pathway 76 may be connected between the ice storage bin 104 and the flow controller 78 for communicating warm air to the ice storage bin 104 for melting or warming the ice for providing a fresh ice or clear ice product.

Figure 1B:
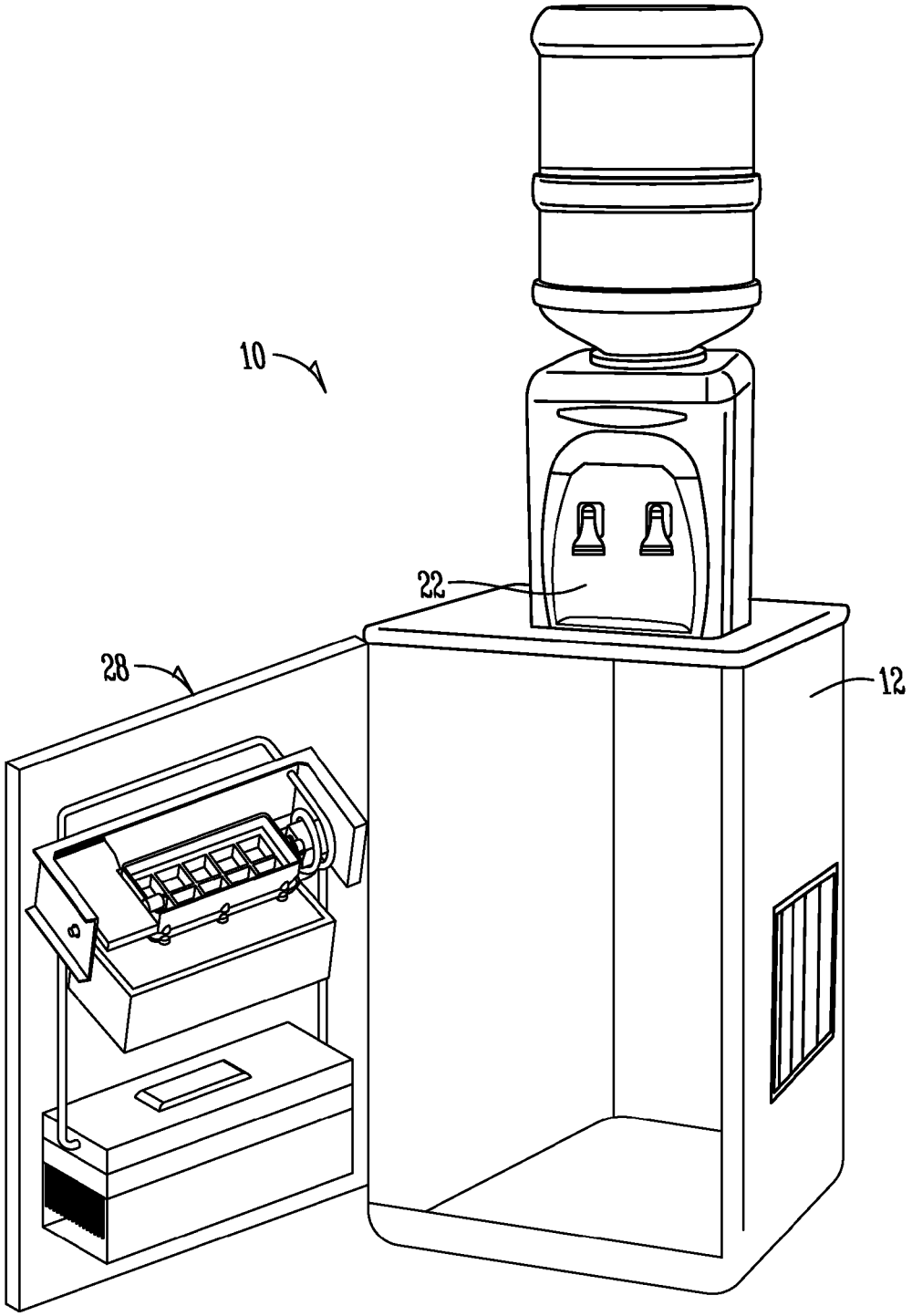
FIGS. 1B-1D are perspective views of exemplary platforms for modulating an icemaker.
Figure 1C:
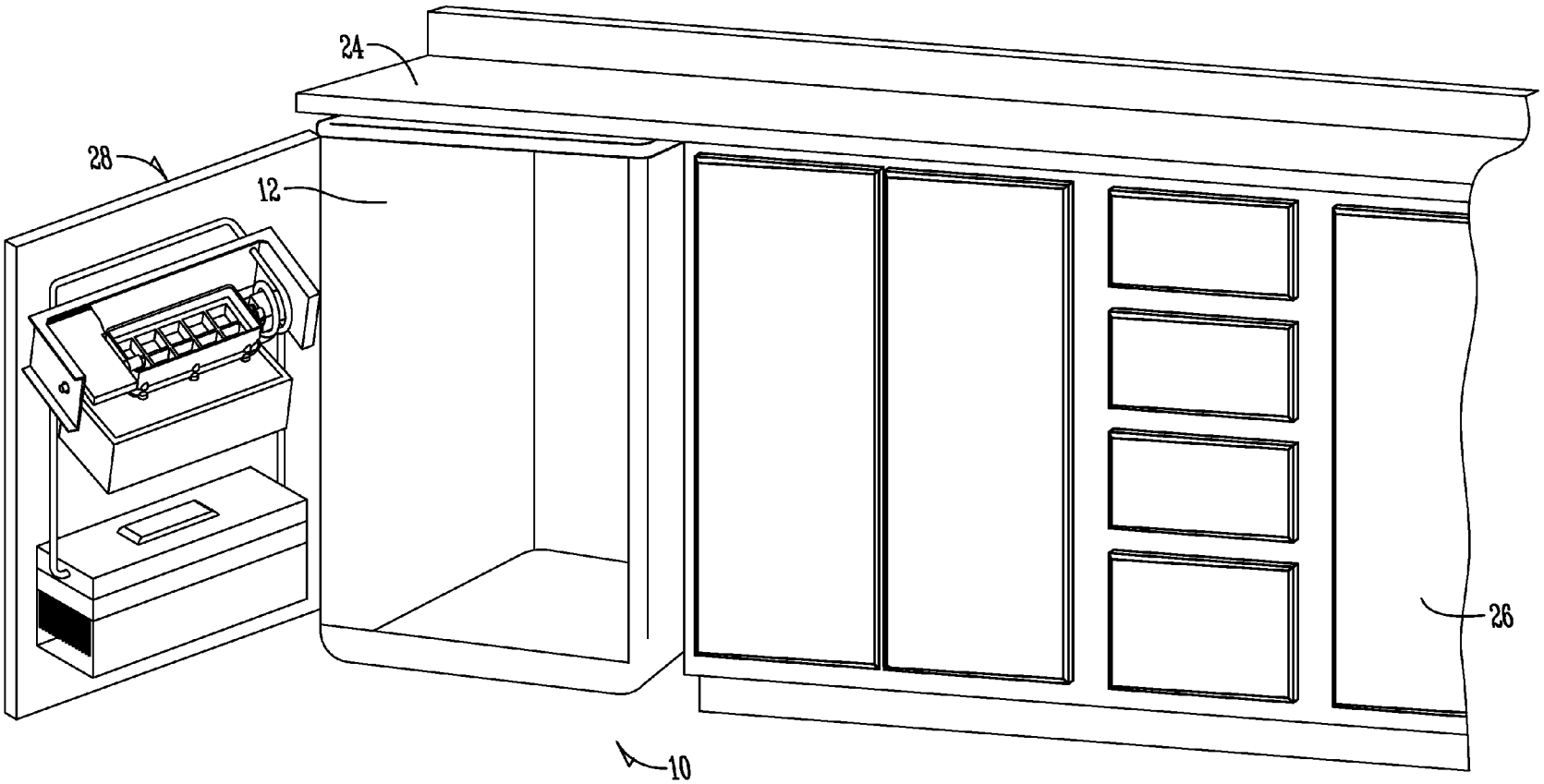
Figure 1D:
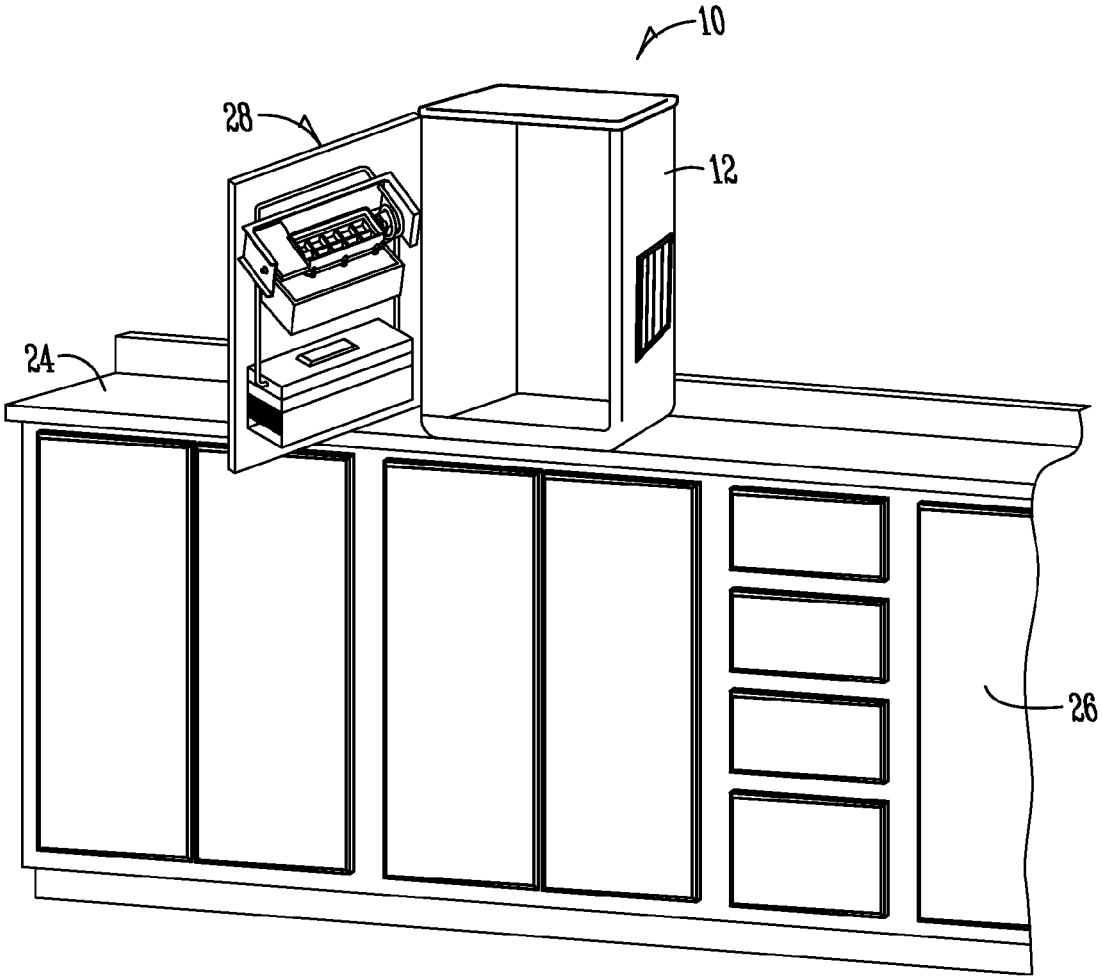

FIGS. 1B, 1C and 1D illustrate a refrigeration platform 10 configured with one or more aspects of the invention. In FIG. 1B, a water dispenser or water cooler (i.e. refrigeration platform 10) includes a dispenser 22 for water housed in a cabinet body 12. The cabinet body 12 may also be configured with an ice maker module 28, such as one of the modules illustrated in FIGS. 4-8. Using any one of the ice maker modules 28 illustrated in the Figures, the water cooler or water dispenser may be configured to dispense ice using an ice making process assisted by a thermal electric device. Similar to the refrigerator platform, heat from off the warm side of the thermal electric device may be extracted using cool air or liquid taken from the refrigeration process used to chill the liquid being dispensed from the dispenser 22. Therefore, the same concepts described above relating to implementation into a refrigerator apply here with implementation into a water dispenser or water cooler. FIG. 1C illustrates another aspect of the invention. In FIG. 1C an ice maker module 28, such as those illustrated in FIGS. 4-8, may be configured into an under cabinet refrigeration platform 10. The under cabinet refrigeration platform 10 includes a cabinet body 12 for housing the ice maker module 28. The cabinet body 12 may be positioned underneath the counter top 24 and/or alongside a cabinet 26. The ice maker module 28 may be used to provide ice at an under cabinet location using an ice maker assisted by a thermal electric device. Ice may be delivered through a door on the cabinet directly from the ice mold or from an ice storage bin. Ice may also be retrieved from the cabinet body 12 through a door in covering relation to the icemaker, ice storage bin or cabinet body 12. Similar to the refrigerator platform 10 illustrated in FIG. 1C, a refrigerator platform 10 may be configured with one of the ice maker modules 28 shown in FIGS. 4-8. The refrigeration platform 10 may be a countertop dispenser configured for resting atop a counter 24 supported, for example, by one or more cabinets 26. The counter top refrigeration platform 10 may include a cabinet body 12 for housing the ice maker module 28. The ice maker module 28 may be configured to provide ice within the cabinet body 12 or delivered through a door using an ice maker assisted by a thermal electric device.

In still another aspect of the invention, the thermal electric device 50 may be configured with a cold side 54 and a warm side 52. An air sink 56 may be configured in thermal contact with the warm side 52 of the thermal electric device 50. Ambient air may be used to extract heat off of the air sink 56 and the warm side 52 of the thermal electric device 50. Thus, in one aspect, the thermal electric device 50 may be configured to provide cooling at the cold side 54 without bringing air to the air sink 56 from the refrigeration compartment. For example, the size and performance characteristics (e.g., operating efficiency) of the thermal electric device 50 may be selected so that the air sink 56 is capable of extracting enough heat from the warm side 52 of the thermal electric device 50 to provide a cold side 54 at the desired operating temperatures. In instances where the refrigeration platform 10 does not include refrigeration components (e.g., compressor, condenser, evaporator) the thermal electric device 50 may be configured to operate without the assistance of bringing cool air from the refrigerator compartment or freezer compartment to the air sink 56 for extracting heat from the warm side 52 of the thermal electric device 50. For example, in FIG. 1C and FIG. 1D a refrigerator platform 10 is shown. The platform may not include components for providing refrigeration (i.e. compressor, condenser, evaporator), and therefore, the thermal electric device 50 may be configured to radiate a sufficient amount of heat from the warm side 52 to provide a cold side 54 at the desired temperatures for operating an ice maker within a cabinet body 12 that does not include the aforementioned refrigeration components.

Figure 9:
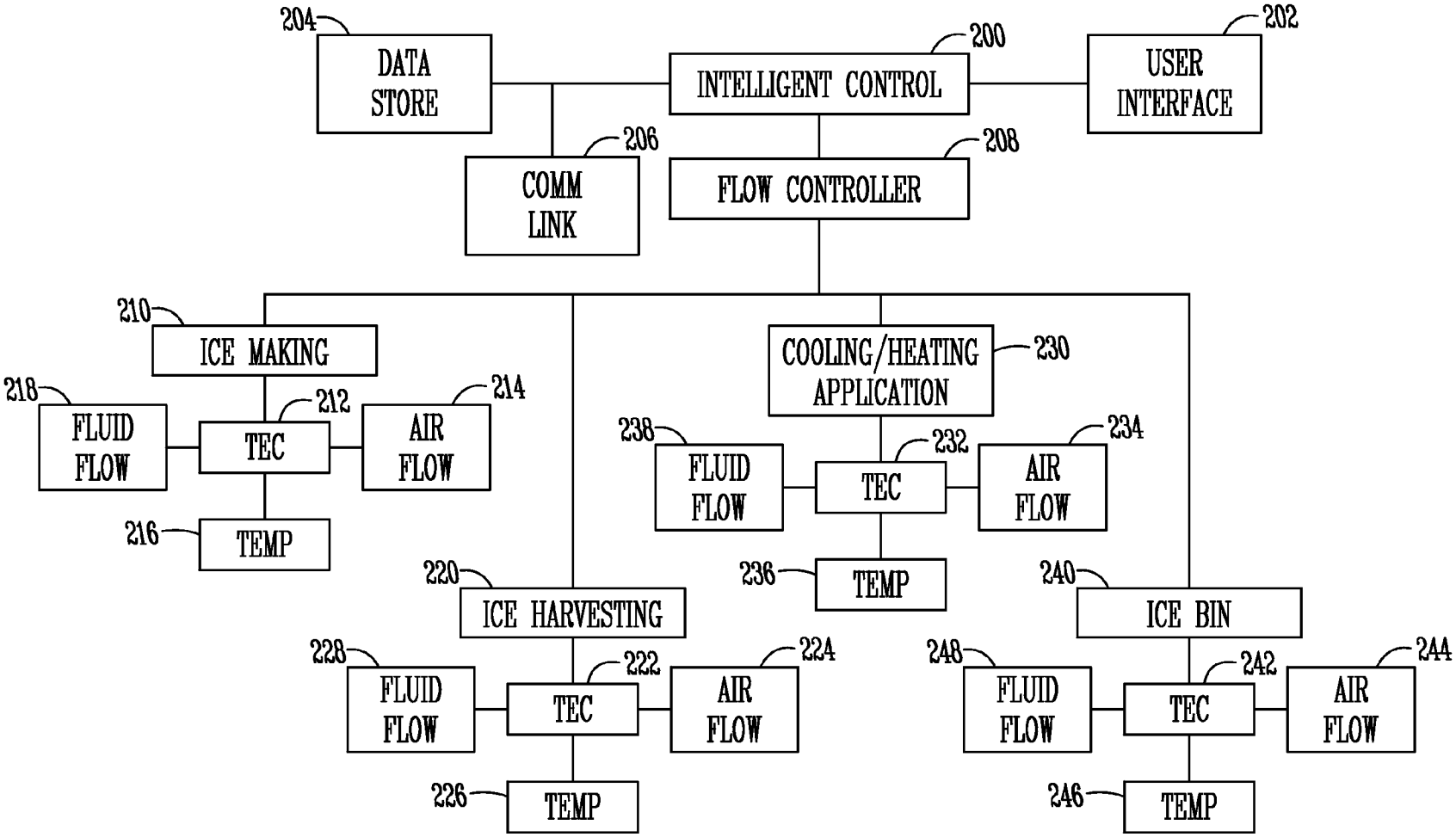
FIG. 9 is a flow diagram illustrating a process for intelligently controlling one or more operations or processes of the exemplary configurations and embodiments disclosed.

FIG. 9 provides a flow diagram illustrating one or more exemplary control processes. To perform one or more aforementioned operations or applications, the refrigerator 10 may be configured with an intelligent control 200 such as a programmable controller. A user interface 202 in operable communication with the intelligent control 200 may be provided, such as for example, at the dispenser 22. A data store 204 for storing information associated with one or more of the processes or applications of the refrigerator may be configured in operable communication with the intelligent control 200. A communications link 206 may be provided for exchanging information between the intelligent control 200 and one or more applications or processes of the refrigerator 10. The intelligent control 200 may also be used to control one or more flow controllers 208 for directing flow of a heat carrying medium such as air or liquid to the one or more applications or processes of the refrigerator 10. For example, in an ice making application 210 the flow controller 208 and intelligent control 200 control and regulate the air flow 214 from the refrigerator compartment 14 to the thermoelectric device process 212. The thermoelectric device process 212 controls the temperature 216 of the fluid flow 218 to the ice making process 210. The rate at which the air flow 214 moves air from the refrigerator compartment 14 to the thermoelectric device process 212 for controlling the temperature 216 may be controlled using the intelligent control 200 in operable communication with one or more flow controllers 208. The rate of fluid flow 218 to the ice making process 210 may also be controlled by the intelligent control 200 operating one or more flow controllers 208. For example, the air flow process 214 may be provided by intelligent control 200 of a fan or other pump mechanism for moving air flow from the refrigerator compartment 14 to the thermoelectric device process 212. The intelligent control 200 may also be used to control the pump used to control fluid flow 218 from the thermoelectric device process 212 to the ice making process 210. The rate at which the pump and the fan operate to control air flow 214 and fluid flow 218 may be used to control the temperature 216 depending upon the rate of the ice making process 210. The intelligent control 200 may also be used to control the ice harvesting process 220. One or more flow controllers 208 under operation of the intelligent control 200 may be used to control air flow 224 to the thermoelectric device process 222 and fluid flow 228 to the ice harvesting process 220. For example, the intelligent control 200 may be used to reverse polarity of the thermoelectric device process 222 to increase the temperature 226 of the fluid flow 228 to enable the ice harvesting process 220. Intelligent control 200 may also be used to control one or more flow controllers 208 to increase the temperature 226 of the air flow 224 and communicating the air flow 224 to the ice harvesting process 220 for warming the ice mold and harvesting the ice. The temperature 226 of the fluid flow 228 and/or the air flow 224 may be controlled using the thermoelectric device process 222 for warming ice within the ice bin to provide a fresh ice product or a clear ice product depending upon an input at the user interface 202. In another aspect of the invention, the intelligent control 200 may be used to control cooling and heating applications 230, such as for example, on the refrigerator compartment door 18 of the refrigerator 10. A reservoir of water may be provided that is chilled or heated by control of the intelligent control 200. The temperature 236 of the water in the cooling or heating application 230 may be controlled by controlling the fluid flow 238 and/or air flow 234 from the thermoelectric device process 232 to the cooling or heating application 230. One or more flow controllers 208 under operable control of the intelligent control 200 may be operated to perform the cooling or heating application 230. For example, the thermoelectric device process 232 may be used to lower the temperature 236 of the fluid flow 238 to the cooling application 230. Alternatively, the temperature 236 of the fluid flow 238 may be increased using the thermoelectric device process 232 for providing heating at the heating application 230. Air flow 234 from the refrigerator compartment 14 may also be used to provide cooling or heating. The air flow 234 to the thermoelectric device process 232 may be used for the cooling application or the heating application 230. For example, the air return pathway from the thermoelectric device process 232 increases the temperature 236 at the heating application 230. Alternatively, the air flow 234 to the thermoelectric device process 232 may be used to decrease the temperature 236 at the cooling application process 230. Intelligent control 200 may also be configured to control the ice bin process 240. One or more flow controllers 208 under operable control of the intelligent control 200 may be used to control air flow 244 and/or fluid flow 248 to the ice bin process 240. The temperature 246 of the fluid flow 248 to the ice bin process 240 or the temperature of air flow 244 from the refrigerator compartment 14 to the ice bin process 240 may be controlled using one or more flow controllers 208. The thermoelectric device process 242 may be configured to provide a fluid flow 248 to the ice bin process 240 having a lower temperature 246 or a fluid flow 248 to the ice bin process 240 having a warmer temperature 246. Air flow 244 to the thermoelectric device process 242 may also be used to cool or warm the ice bin process 240. Air flow 244 from the refrigerator compartment may be used to cool the ice bin process 240 whereas air flow 244 from the thermoelectric device process 242 may be used to warm the ice bin process 240. Thus, the temperature 246 of fluid flow 248 or air flow 244 may be controlled using the intelligent control 200 in operable communication with one or more flow controllers 208 for controlling the ice bin process 240. For example, the fluid flow 248 from the thermoelectric device process 242 to the ice bin process 240 may be controlled using one or more flow controller 208 under operation of the intelligent control 200 whereby the temperature 246 of the fluid flow 248 is used in a cooling ice bin process 240 or warming ice bin process 240. Thus, one or more methods for controlling the temperature of one or more applications, such as for example, an ice making process on a refrigerator compartment door, are provided.

Figure 10:
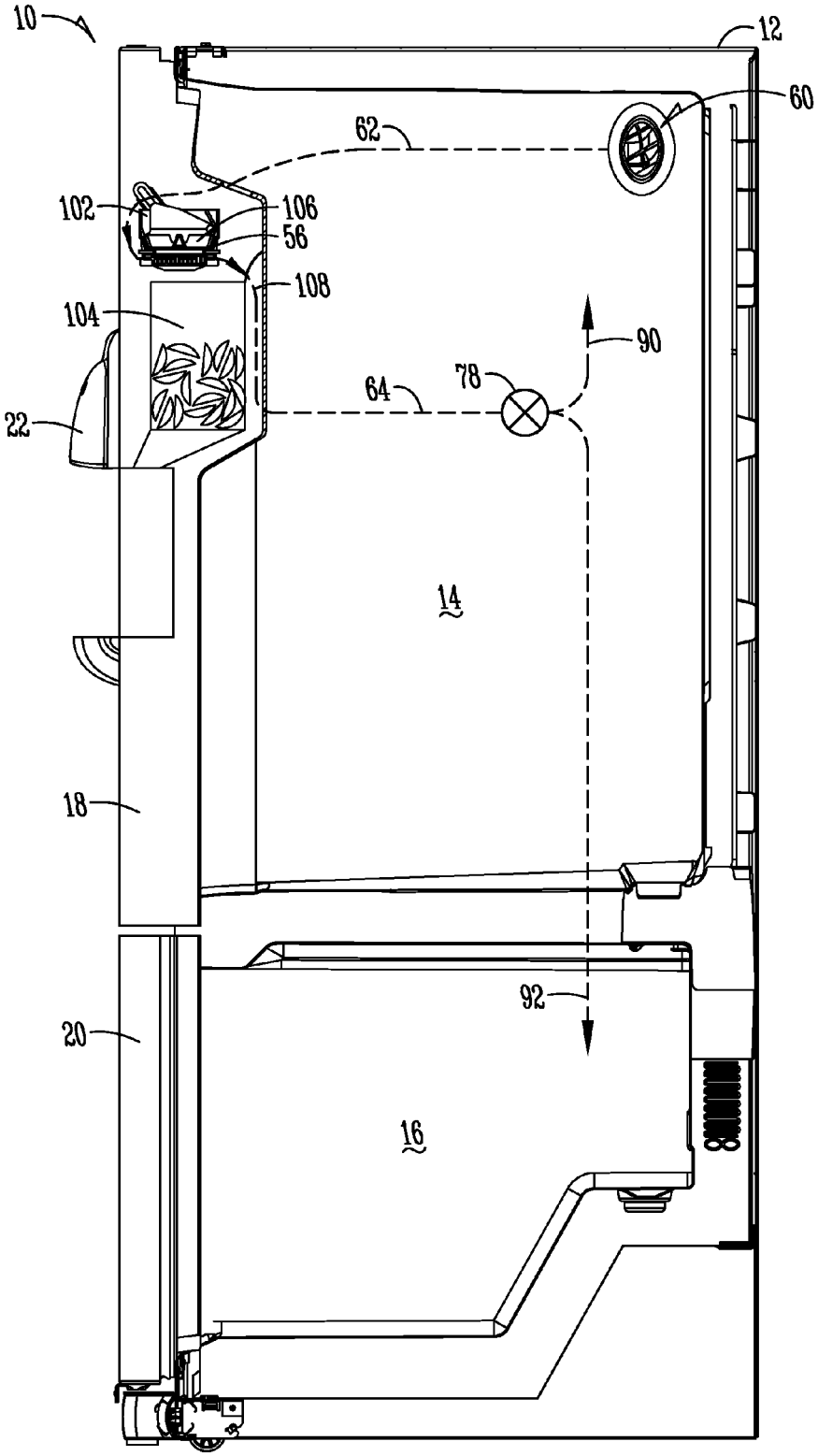
FIG. 10 is a side elevation view showing a sectional of another exemplary configuration for a refrigerator such as shown in FIG. 1A.
Figure 11:
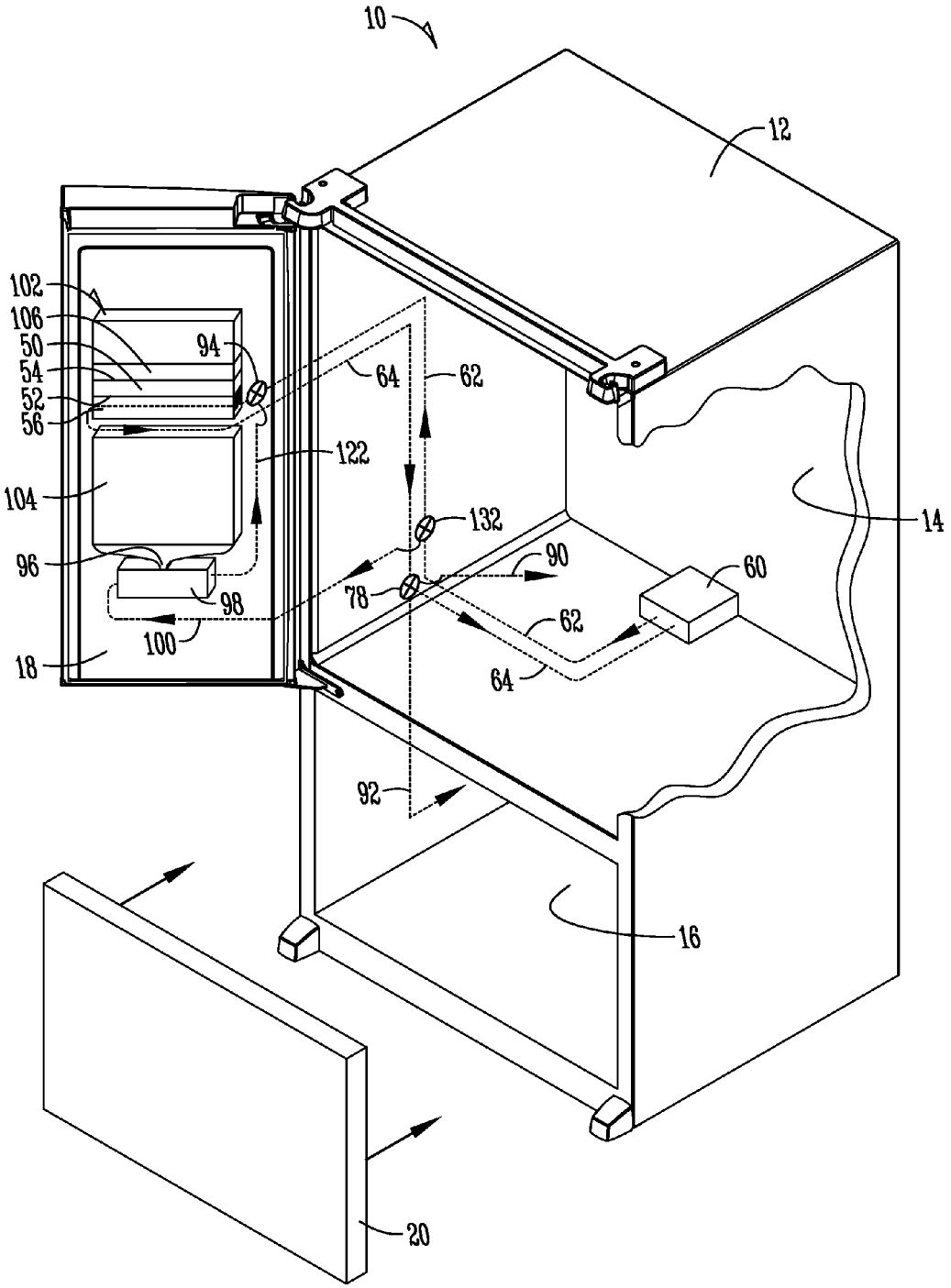
FIG. 11 is a perspective illustration with a cutaway for viewing other exemplary configurations for an icemaker on a door of the refrigerator.

Several aspects of the disclosure addressing one or more of the aforementioned challenges are also illustrated in the sectional and cutout views of refrigerator 10 shown in FIGS. 10 and 11. In connection with the dispenser 22 in the cabinet body 12 of the refrigerator 10, such as for example on the refrigerator compartment door 18, is an icemaker 102 having an ice mold 106 for extracting heat from liquid within the ice mold 106 to create ice which is dispensed from the ice mold 106 into an ice storage bin 104. The ice is stored in the ice storage bin 104 until dispensed from the dispenser 22. The ice mold 106 or ice maker 102 may include an air sink for extracting heat from the ice mold 106 using air as the extraction medium. Alternatively, a liquid sink (not shown)

may be operably connected in thermal contact with the ice mold 106 for extracting heat from the ice using fluid as the extraction medium. In another aspect, heat from the warm side of the thermoelectric device 50 may be radiated off of the air sink into ambient air. In such an embodiment, air may not need to be communicated from the refrigerator compartment 14 to the refrigerator compartment door 18 for extracting heat off the warm side 52 of the thermoelectric device 50. Thus, only the energy used to power the thermoelectric device 50 may be required to chill the ice mold 106. According to another embodiment of the disclosure, an air supply pathway 62 is connected between the icemaker 102 and a fan 60 located, for example, in the refrigerated compartment 14. An air return pathway 64 may also be connected between the icemaker 102 and the refrigerated compartment 14 and/or freezer compartment 16. The air supply pathway 62 and the air return pathway 64 together may be configured to form an air loop connecting the icemaker 102 with the fan 60. The air supply pathway 62 and air return pathway 64 could also be configured as fluid pathways (e.g., a fluid supply pathway and a fluid return pathway) connected between the icemaker 102 and refrigerated compartment 14. The pathway 62, 64 may include a conduit, line, ductwork, or other enclosed flow path to facilitate the transfer of a heat carrying medium (e.g., air or a heat carrying fluid such as glycol) between the icemaker 102 and the fan 60 (or pump for a fluid heat carrying medium).

In one aspect of the invention, air supply pathway 62 and air return pathway 64 are connected to an air sink 56 positioned in thermal contact with the warm side 52 of the thermoelectric device 50. The air sink 56 provides a thermal transfer pathway between the heat carrying medium and the warm side 52 of the thermoelectric device 50. In the case of a clear ice process, the air sink may be configured to move with the ice mold 106. Thus, the air pathway may be configured with a plenum box with direction fins for evenly distributing air across the fins of the air sink 56 while it rocks from side-to-side. This could be accomplished by communicating air or fluid through a rocking carriage in sealed communication with the box plenum whereby the ice mold 106 and sink along with the carriage rock from side-to-side within the plenum carrying the air or fluid across the fins of the sink (e.g., air sink or fluid sink). The cold side 54 of the thermoelectric device 50 is kept generally at a temperature below the temperature required for making ice (e.g., temperatures near or below 0° Fahrenheit). Conversely, the warm side 52 of the thermoelectric device is operated at a temperature of the desired temperature for making ice plus the delta for the thermoelectric device. For example, if the delta for the thermoelectric device 50 is 20° Fahrenheit, the warm side 52 of the thermoelectric device 50 must be kept at a temperature less than 52° Fahrenheit to maintain the cold side 54 of the thermoelectric device 50 at 32° Fahrenheit or below. An electrical current is provided to the thermoelectric device 50 which provides the necessary Peltier effect that creates a heat flux and provides a cold side 54 and warm side 52 during operation. To dissipate heat from the warm side 52 of the thermoelectric device 50, the air sink 56 is configured in operable thermal operation/contact with the warm side 52 of the thermoelectric device 50. An air supply pathway 62 is connected between the air sink 56 and a fan 60 positioned within the refrigerator compartment 14 of the refrigerator 10. An air return pathway 64 is connected between the air sink 56 and the refrigerator compartment 14 and/or freezer compartment 16 selectable by operation of flow controller 78 movable between open communication with air supply pathway 90 to the refrigerator compartment 14 or air supply pathway 92 to the freezer compartment 16.

Fluid as a heat carrying medium is known to be more efficient than air; therefore, one embodiment of the refrigerator 10 may include a fluid supply pathway configured to communicate a cool fluid from the refrigerator compartment 14 to a fluid sink positioned in thermal contact with the warm side 52 of the thermoelectric device 50. A fluid return pathway may also be configured across the refrigerator compartment door 18 and the refrigerator compartment 14. Together, the supply and return fluid pathways may be configured as a fluid loop between the refrigerated compartment 14 and the refrigerator compartment door 18. The fluid in the loop may comprise a glycol, such as ethylene glycol. The fluid pathway may be a conduit, tube, duct, channel, or other fluid carrying member. A flexible fluid carrying member may be used across the junction between the refrigerator compartment door 18 and the refrigerator compartment 14 to allow the member to move/adjust with opening and closing the refrigerator compartment door 18. The icemaker 102 and ice storage bin 104 may also be positioned on the insulated compartment 108. The wall of the insulated compartment 108 may be configured to separate from the refrigerator compartment door 18 to allow the door to be removed without having to remove the insulated compartment 108, which allows the fluid pathway to remain connected regardless whether the refrigerator compartment door 18 is removed.

In another configuration, a junction may provide fluid connections between the refrigerator compartment door 18 and the refrigerator compartment 14 to facilitate separation of the refrigerator compartment door 18 from the cabinet body 12 of the refrigerator 10. The fluid carrying member may also be configured into a hinge supporting the refrigerator compartment door 18. The disclosure also contemplates that a fluid supply pathway may be configured to supply cold fluid from the freezer compartment 16. The use of fluid as the heat carrying medium has several benefits. Generally, the fluid carrying member (e.g., tube) is less likely to sweat or cause condensation to form. Fluid has a greater heat carrying capacity (compared to air) meaning that less overall volume (e.g., fluid carrier volume) is required to carry more (again, compared to air). Fluid also has a higher thermal conductivity and is able to harvest heat from a fluid sink made from, for example, aluminum or zinc diecast faster than air even for smaller volumetric flows. Fluid pumps are also generally more efficient and quiet than air pumps that cost generally the same amount. Using a fluid like glycol also increases the above-described efficiencies, over for example, using air as the heat carrier.

In a typical refrigerator, the refrigerator compartment 14 is kept generally between 38° Fahrenheit and about 42° Fahrenheit. A fan 60 or other means for moving air through a ductwork or other defining channel may be positioned within the refrigerator compartment 14 at a location such as adjacent the horizontal mullion that separates the refrigerator compartment 14 from the freezer compartment 16. Other embodiments are contemplated where the fan is positioned elsewhere within the refrigerated compartment 14. For example, the fan 60 may be positioned within a mullion or sidewall of the cabinet body 12 of the refrigerator 10. Positioning the fan 60 adjacent the mullion that separates the refrigerator compartment from the freezer compartment may draw upon the coolest air within the refrigerator compartment 14 given that cooler air within the refrigerator compartment 14 is generally located closer to or adjacent the horizontal mullion that separates the refrigerator compartment 14 from the freezer compartment 16. The cool air may also be ducted out of the refrigerator compartment 14 through an air supply pathway 62 using fan 60. The fan may also be positioned within the insulated compartment 108 on the refrigerator compartment door 18. The cool air pumped to the air sink 56 may be exhausted back into the refrigerator compartment 14 and/or into the freezer compartment 16. A flow controller 78 may be provided within the air return pathway 64 to direct flow through an air return pathway 90 that exhausts into the refrigerator compartment 14 or an air return pathway 92 that exhausts into the freezer compartment 16. The disclosure contemplates that other pathways may be configured so that air from the air return pathway 64 is communicated to other locations within the cabinet body 12 of the refrigerator 10. For example, the air within the air return pathway 64 may be communicated to a discreet or desired space within the refrigerator compartment 14 or freezer compartment 16. A separate cabinet, bin or module within the freezer compartment 16 or refrigerator compartment 14 may be configured to receive air exhausted from the thermoelectric device 50 through one or more of the air return pathways 64, 90, 92. A junction may be provided in the air supply pathway 62 at the interface between the refrigerator compartment door 18 and the refrigerator compartment 14. The interface (not shown) between the refrigerator compartment 14 and refrigerator compartment door 18 is sealed and separated upon opening and closing the refrigerator compartment door 18. Alternatively, the air supply pathway 62 may be configured through another attachment point of the refrigerator compartment door 18 such as a hinge point generally at a top or bottom portion of the door. The air supply pathway 62 may also be configured from a flexible conduit that extends between the refrigerated compartment 14 and refrigerated compartment door 18 that allows the door to be opened and closed while keeping the pathway intact. Thus, cool air from the refrigerator compartment 14 is communicated through the air supply pathway 62 to the air sink 56 of the thermoelectric device 50. The air temperature ranges generally between 38° Fahrenheit and about 42° Fahrenheit (i.e., the temperature of the refrigerator compartment) depending upon the delta rating of the thermoelectric device 50 the temperature on the cold side 54 of the thermoelectric device 50 ranges anywhere from about 38° Fahrenheit to 42° Fahrenheit minus the temperature delta of the thermoelectric device. Assuming the refrigerator compartment is set at 38° Fahrenheit and the thermoelectric device has a delta of 10 degrees, the cold side 54 of the thermoelectric device 50 may operate at 28° Fahrenheit. The liquid in the ice mold 106 is generally then at the temperature of the cold side 54 of the thermoelectric device 50. Heat from the ice mold 106 is extracted and carried away from the icemaker 102 through the thermoelectric device 50 and air return pathway 64. Depending upon the desired rate of production of ice, the flow rate of air through the air supply pathway 62 and the operating parameters of the thermoelectric device 50 may be controlled so that the warm side 52 and cold side 54 of the thermoelectric device 50 are kept at the desired operating temperatures so that ice production can be maintained at a desired rate of production by extracting heat from the ice mold 106 of the icemaker 102 at a rate that is capable of sustaining the desired level of ice production. The rate of operation for these various components may be controlled to use the least amount of energy necessary for keeping up with the desired rate of ice production.

FIG. 11 illustrates another exemplary aspect of refrigerator 10. In FIG. 11 an air supply pathway 100 is connected between air supply pathway 62 and cooling application 98. A flow controller 132 may be configured in air supply pathway 62 to control flow through air supply pathway 100. The flow controller 132 allows dampening of flow through air supply pathway 62 and air supply pathway 100. An air supply pathway 110 may also be configured between the cooling application 98 and air supply pathway 62. A flow controller may be configured in air supply pathway 62 for controlling flow through air supply pathway 122. The flow controller 94 may be configured to provide dampening of flow through air supply pathway 122. In this configuration, cool air from fan 60 flows through the cooling application 98 and returns to air supply pathway 62. The cooling application 98 may be configured with a fluid reservoir for collecting cold ice melt from ice storage bin 104. And air sink (not shown) may be included in the cooling application 98 for extracting heat from air passing through the air supply pathways 100 and 122. The air passing through the cooling application 98 is cooled at or close to the temperature of the cold ice melt. For example, the refrigerator compartment air may be cooled several degrees to the temperature of the cold ice melt temperature. The chilled air may then be communicated to the thermoelectric device 50 for removing heat from the warm side 52 of the device. The further cooling of the air from the refrigerator compartment 14 allows the thermoelectric device 50 to operate more efficiently and at lower temperatures. The flow controllers 132 and 94 may be used to dampen the flow to the thermoelectric device 50 depending upon the desired inlet temperature of the airflow across the warm side 52 of the thermoelectric device 50. A water reservoir (not shown) could be included in the cooling application 98. A fluid sink (not shown) in the cooling application 98 could be used to chill water in the water reservoir using cold ice melt from the ice storage bin 104. Water (e.g., drinkable/consumable) may be communicated from the reservoir to the dispenser 22 or to the icemaker 102. The chilled water communicated to the icemaker 102 may decrease the time and energy required to freeze the water in the ice mold 106 compared to water at ambient or refrigerator compartment temperatures. A fluid heat carrying medium may also be used in flow pathways for accomplishing the same objectives describing the illustration in FIG. 11. For example, fluid may be communicated from the refrigerator compartment 14 to the icemaker 102. Cold melt water from the ice storage bin 104 collected from the drain 96 may be used to further chill the fluid from the refrigerator compartment before being passed through a fluid sink (not show, but could replace air sink 56) in thermal contact with warm side of the thermoelectric device 50. The rate of ice melt could also be controlled by allowing the ice storage bin 104 to be uninsulated from the refrigerator compartment 14, thereby permitting more ice to melt as opposed to less. The warm fluid could be communicated back to the refrigerator compartment 14 through a return pathway. The fan 60 could be replaced with a pump for supplying fluid from the refrigerator compartment 14 to the refrigerator compartment door 18. The configuration illustrated in FIG. 11 could also designed so that cold melt water collected from drain 110 in the cooling application 98 is used in combination with cool air from the refrigerator compartment 14 to extract heat from off the warm side 52 of the thermoelectric device 50. Thus, in a hybrid scenario, both chilled fluid and air may be used simultaneously to cool the thermoelectric device 50.

Figure 12:
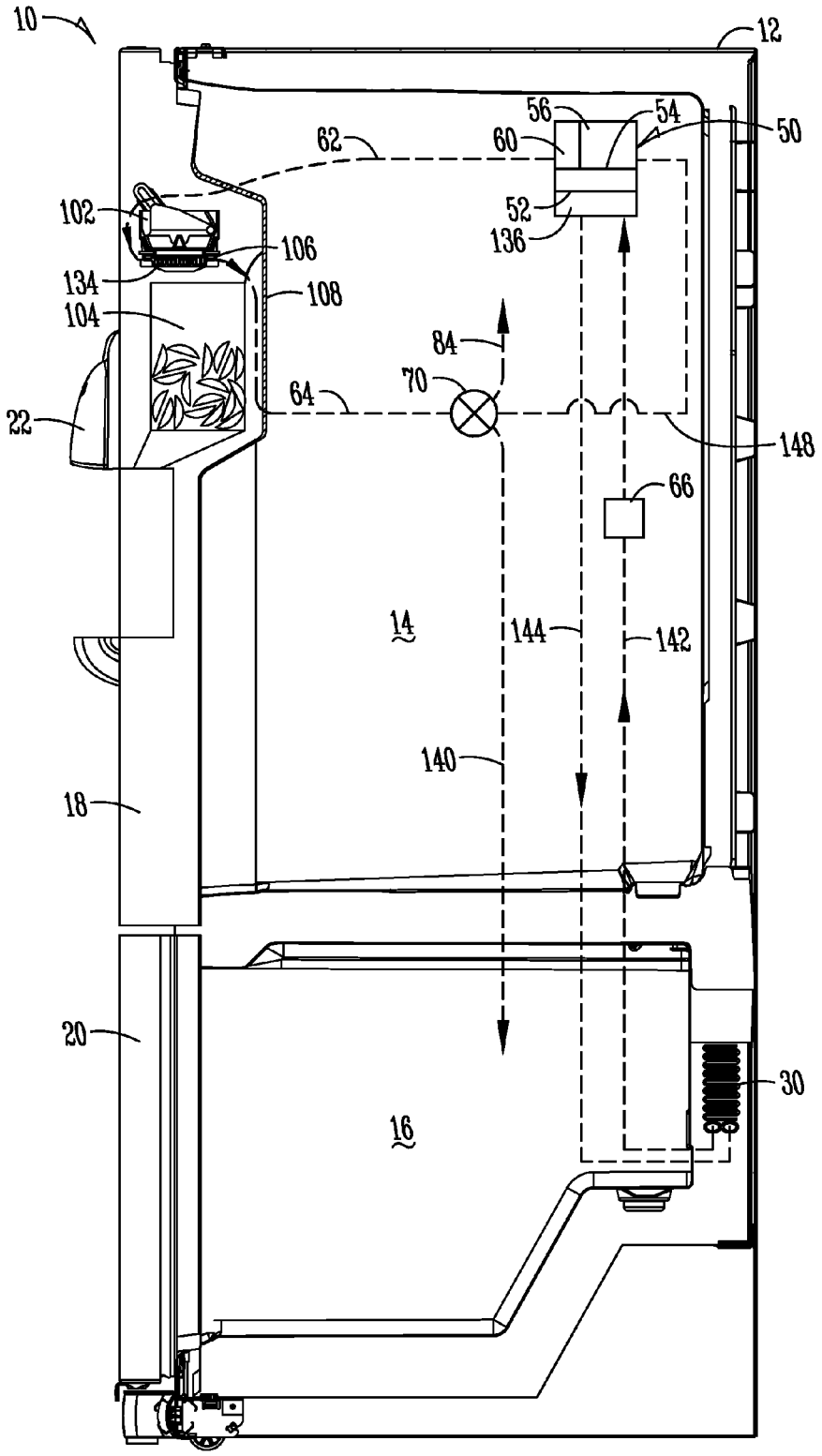
FIG. 12 is a side elevation view showing a sectional of a refrigerator configured with a fluid/air exchange from the freezer compartment.
Figure 13:
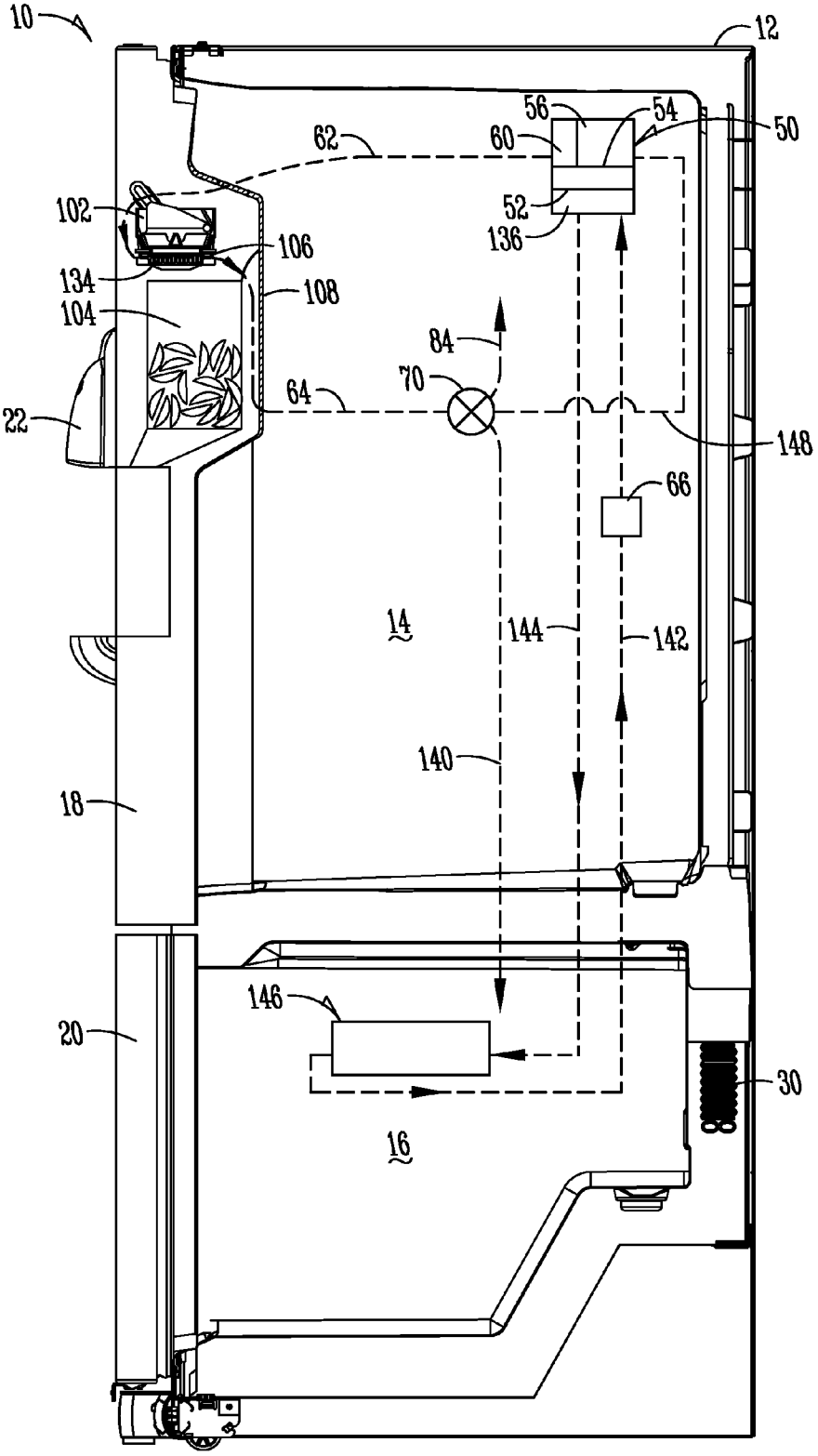
FIG. 13 is another embodiment of the refrigerator shown in FIG. 12.

Several aspects of the disclosure addressing one or more of the aforementioned challenges are also illustrated in the sectional views of refrigerator 10 shown in FIGS. 12 and 13. In FIG. 12 an elevation view showing a cross-section of a refrigerator 10 is provided. The refrigerator 10 includes an icemaker 102 that may be included or positioned on the refrigerator compartment door 18. The icemaker 102 may be housed in an insulated compartment 108. Insulated compartment 108 provides a thermal bather between the icemaker 102, the ice storage bin 104 and the refrigerator compartment 14. The icemaker 102 includes an ice mold 106 and an air sink 134 in thermal contact with the ice mold 106 for producing ice which is harvested and dispensed into the ice storage bin 104. To remove heat from the water, it is common to cool the ice mold 106 specifically. Accordingly, the ice mold 106 acts as a conduit for removing heat from the water in the ice mold. As an alternative to bringing freezer air to the icemaker, a thermoelectric device 50 may be used to chill the ice mold 106. In the ice making context this means that the warm side must be kept at a low enough temperature to permit the cold side to remove enough heat from the ice mold 106 to make ice at a desired rate. Therefore, the heat from the warm side of a thermoelectric device must be removed to maintain the cold side of the mold sufficiently cold to make ice. Removing enough heat to maintain the warm side of the thermoelectric device at a sufficiently cold temperature creates a challenge. In the case where the heat exchanger 50 is a thermoelectric device, the device may be positioned at the icemaker 102 with its cold side 54 in thermal contact with the ice mold 106 as previously described. Alternatively, a thermoelectric device 50 may be positioned within the refrigerator compartment 14 with its cold side 54 in thermal contact with an air sink 56 or a fluid sink (not shown) for communicating chilled air or fluid from the refrigerator compartment 14 to the refrigerator compartment door 18. Thus, a thermoelectric device may be positioned in the refrigerator compartment 14 or on the refrigerator compartment door 18. There are advantages depending upon where in the refrigerator the thermoelectric device 50 is positioned. In the case where the thermoelectric device 50 is positioned in the refrigerator compartment 14 a fluid loop or fluid supply pathway can be configured to carry chilled fluid (e.g., ethylene glycol) from the thermoelectric device 50 to the icemaker 102 on the refrigerator compartment door 18. One advantage of positioning the thermoelectric device in the refrigerator compartment 14 is the ability to use a device with a larger footprint (compared to those that are used at the icemaker 102 or on the refrigerator compartment door 18). A thermoelectric device 50 with a larger footprint generally has a greater heat transfer capacity (e.g., larger delta, heat transfer and volume rates). The thermoelectric device 50 may have more capacity than is needed to chill the ice mold 106. The extra capacity can be used to chill water dispensed into the ice mold 106 to make ice, heat/chill fluid for warming or cooling another zone within the refrigerator or on one or more of the doors (e.g., warm/cool a bin, drawer or shelf). If the thermoelectric device 50 is adequately large and efficient, the refrigerator 10 may be configured without a compressor. In such a design, the refrigerator could be configured with one or more thermoelectric devices for providing chilled fluid or air to specific zones within the refrigerator (e.g., chilled air or fluid transferred to any number of specific bins, compartments, locations, or shelves).

In the case where air is used as the heat carrying medium, an air supply pathway 62 may be connected between the air sink 56 and the icemaker 102 in the insulated compartment 108 on the refrigerator compartment door 18. As shown for example in FIG. 12, a fan 60 may be configured to move air from the air sink 56 through the air supply pathway 62 to the icemaker 102. The cold air in the pathway is communicated through the air sink 132 in thermal contact with the ice mold 106. Heat coming off the warm side 52 of the thermal electric device 50 may be extracted using cold from the freezer compartment 16. For example, in one aspect of the refrigerator 10, a fluid supply pathway 142 is connected between an evaporator 30 (or a secondary evaporator) and a fluid sink 136 in thermal contact with the warm side 52 of the thermal electric device 50. A fluid return pathway 144 may be connected between the evaporator 30 (or a secondary evaporator) and the fluid sink 136 in thermal contact with the warm side 52 of the thermal electric device 50. The fluid supply pathway 142 and the fluid return pathway 144 may be configured as a fluid loop between the evaporator 30 and the fluid sink 136 for extracting heat off of the warm side 52 of the thermal electric device 50. A pump 66 may be configured in the fluid loop for moving a cooling fluid (e.g., ethylene glycol or ethylene propylene) to and from the evaporator 30 between the fluid sink 136. Alternatively, as illustrated in FIG. 13, a cold battery or cold reservoir of cooling fluid may be positioned within the refrigerator compartment 14. In one aspect of the refrigerator 10, a heat exchanger 146 is positioned within the freezer compartment 16. The heat exchanger 146 may also include a fluid reservoir of fluid such as ethylene glycol or ethylene propylene. The heat exchanger 146 may also comprise a cold battery having a fluid reservoir and the potential of storing a fluid such as ethylene glycol or ethylene propylene at a temperature at or below freezing. Similar to the configuration using the evaporator 30 shown in FIG. 12, the heat exchanger 146 may be connected to the fluid sink 136 by a fluid supply pathway 142 and a fluid return pathway 144. The fluid supply pathway 142 and the fluid return pathway 144 may be configured as a loop for moving fluid from the heat exchanger 146 to the fluid sink 136. A pump 66 may be configured to move fluid through the fluid supply pathway 142 and fluid return pathway 144 between the fluid sink 136 and the heat exchanger 146 positioned in the freezer compartment 16. The fluid in the loop is chilled to the temperature of the freezer compartment and used to extract heat off of the warm side 52 of the heat exchanger/thermoelectric device 50 which is then returned to the heat exchanger 146 positioned in the freezer compartment 16. For example, if the freezer compartment 16 is set at 20° Fahrenheit, the warm side 52 of the heat exchanger/thermoelectric device 50 may be kept at or near 20° Fahrenheit and the cold side of the heat exchanger 50 may be generally around 20° Fahrenheit depending upon the flowrate of fluid from the freezer compartment 16. In the case where the heat exchanger 50 comprises a thermoelectric device, the cold side 54 of the thermoelectric device 50 may be then kept at 20° Fahrenheit minus the delta of the thermoelectric device 50. For example, if the thermoelectric device has a delta of 20°, the cold side 54 may be kept at a temperature of 0° Fahrenheit. The air from the air sink 56 is then cooled to at or near 20° Fahrenheit when a heat exchanger is used or 0° Fahrenheit when a thermoelectric device is used. The fan 60 moves the cold air from the air sink 56 to the icemaker 102 through the air supply pathway 62 as previously indicated. The cold air passes through an air sink 134 in thermal contact with the ice mold 106 for extraction heat from the ice mold for making ice. The air passes through the air sink 134 in thermal contact with the ice mold 106 through an air return pathway 64 and may be configured to distribute return air into the refrigerator compartment 14 or the freezer compartment 16. A flow controller 70 may be configured into the air return pathway 64 for metering or baffling the air into the refrigerator 14 (via air return pathway 84) or the freezer compartment 16 (via air return pathway 140). Alternatively, the air return pathway 64 may be connected to the air sink 56 in the refrigerator compartment 14. The air supply pathway 62 and the air return pathway 64 may be configured to create an air loop between the air sink 56 connected in thermal contact with the cold side 54 of the heat exchanger 50 and the air sink 132 connected in thermal contact with the ice mold 106 in the icemaker 102. Alternatively, a thermoelectric device may be connected with its cold side 54 in thermal contact with the ice mold 106. An air sink may be connected in thermal contact with the warm side of the thermoelectric device. An air pathway may be configured between an air sink (not shown) in thermal contact with the warm side of the thermoelectric device and the heat exchanger 50 positioned within the refrigerator compartment 14. Cold fluid from a heat exchange, such as heat exchanger 146 positioned in the freezer compartment 16 or an evaporator may be communicated to the heat exchanger in the refrigerator compartment for extracting heat from off the warm side of the heat exchanger. The sub-zero cooling potential communicated from the heat exchanger 50 in the refrigerator compartment 14 may be carried by air or fluid to a thermoelectric device (not shown) connected in thermal contact with the ice mold 106 of the icemaker 102 on the refrigerator compartment door 18. For example, a fluid loop may be configured to communicate cooling fluid from the heat exchanger 50 in the refrigerator compartment 14 to the ice mold 102. Alternatively, an air loop may be configured to communicate cool air from the heat exchanger 50 in the refrigerator compartment 14 to the ice mold 106. A thermoelectric device (not shown) having a cold side 54 in thermal contact with the ice mold 106 may be cooled by fluid or air taken from the heat exchanger 50 within the refrigerator compartment 14 where the exchange is provided by a cooling loop connected between a heat exchanger 146 or an evaporator 30 in the freezer compartment 16.

Figure 14:
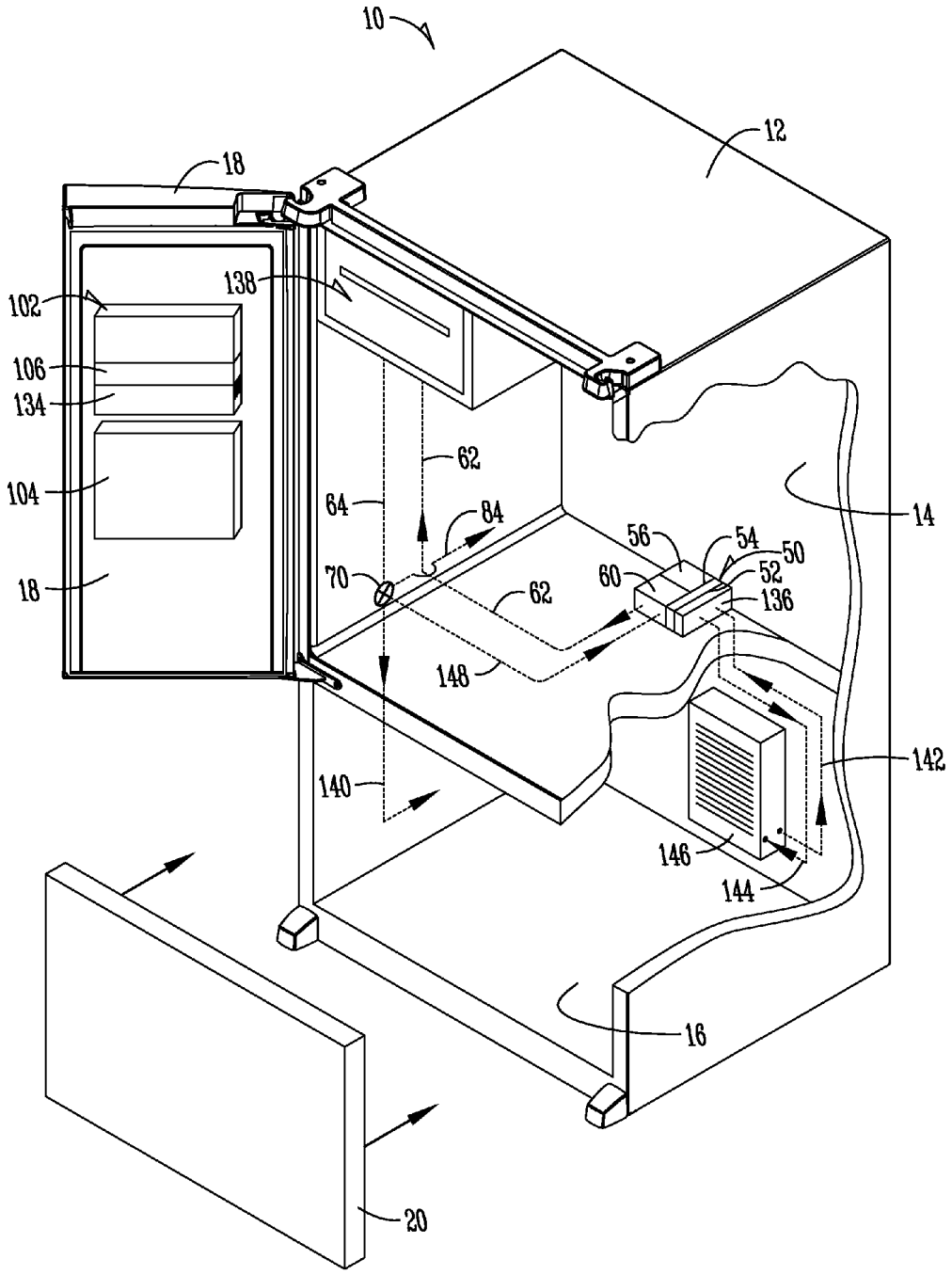
FIG. 14 is a perspective view with a cutaway for illustrating an application for warming or cooling within a refrigerator.

According to another aspect of the refrigerator 10 illustrated in FIG. 14, a sub-zero cooling application 138 may also be provided within the refrigerator compartment 14. For example, a module, cabinet, drawer, isolated space (insulated from the refrigerator compartment) may be configured within the refrigerator compartment 14. The supply pathway 62 may be connected between the heat exchanger 50 and the sub-zero cooling application 138 for providing sub-zero air or liquid to the application through the exchange process using sub-zero liquid taken from the freezer compartment 16 or evaporator 30. Alternatively, a thermoelectric device may be configured to replace the heat exchanger 50 and operated in reverse polarity to provide a warming application (at 138) within the refrigerator compartment 14. For example, an isolated drawer, cabinet, module or other enclosure insulated or non-insulated may be configured within the refrigerator compartment 14 to receive warm air or fluid from a thermoelectric device operated in reverse polarity and housed within the refrigerator compartment 14. A pathway 62 for providing warm or cold air or liquid to the application 138 may be configured between the application 138 and the thermoelectric device (not shown, but would generally replace heat exchanger 50). A return pathway 64 may also be configured between the application 138 and the thermoelectric device. A flow controller 70 may be configured within the return pathway 64 for distributing return air to the refrigerator compartment 14 via air return pathway 84 or to the freezer compartment 16 via air return pathway 140. The return pathway 64 may also be a fluid return pathway for returning fluid to the thermoelectric device. The supply pathway 62 and return pathway 64 may be configured as a fluid loop between the heat exchanger 50 or a thermoelectric device and the application 138.

Figure 15:
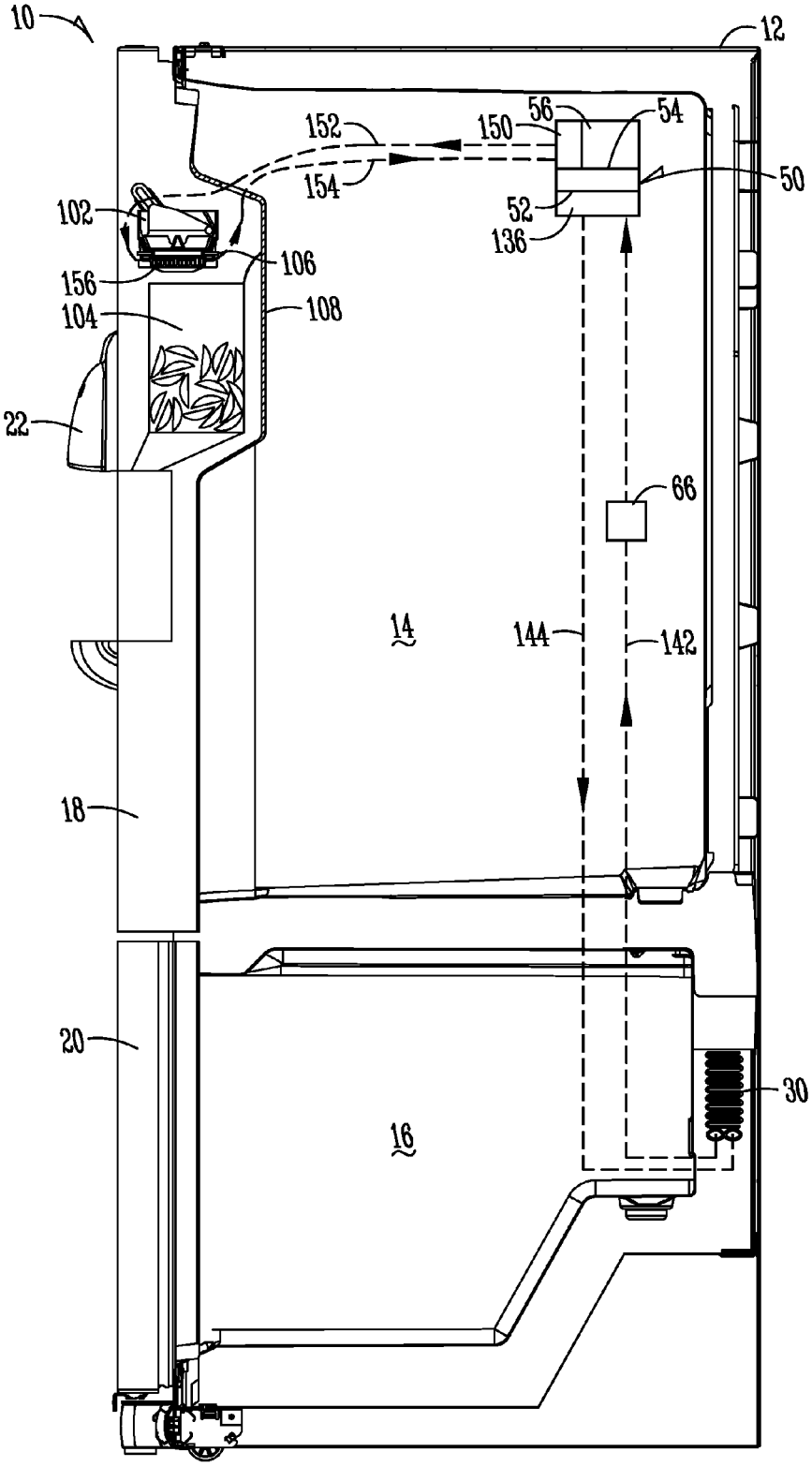
FIG. 15 is a side elevation view showing a sectional of a refrigerator with a fluid exchange from the freezer compartment.

In FIG. 15 an elevation view showing a sectional of a refrigerator 10 is provided. The refrigerator 10 includes an icemaker 102 that may be included or positioned on the refrigerator compartment door 18. The icemaker 102 may be housed in an insulated compartment 108. Insulated compartment 108 provides a thermal bather between the icemaker 102 and the ice storage bin 104 and the refrigerator compartment 14. The icemaker 102 includes an ice mold 106 and a fluid sink 156 in thermal contact with the ice mold 106 for producing ice which is harvested and dispensed into the ice storage bin 104. The icemaker 102 and ice storage bin 104 may be housed within an insulated compartment 108 for insulating the icemaker 102 and ice storage bin 104 from the refrigerator compartment 14. A thermoelectric device 50 may also be positioned at the icemaker 102 with its cold side 54 in thermal contact with the ice mold 106. Alternatively, a thermoelectric device 50 may be positioned within the refrigerator compartment 14 with its cold side 54 in thermal contact with a fluid sink 56 for communicating chilled fluid from the thermoelectric device 50 in the refrigerator compartment 14 to the refrigerator compartment door 18. Thus, a thermoelectric device 50 may be positioned in the refrigerator compartment 14 as shown, for example, in FIGS. 15 and 16 or on the refrigerator compartment door 18. There are advantages depending upon where in the refrigerator the thermoelectric device 50 is positioned. In the case where the thermoelectric device 50 is positioned in the refrigerator compartment 14 a fluid loop 152, 154 or fluid supply pathway 152 can be configured to carry chilled fluid (e.g., ethylene glycol) from the thermoelectric device 50 to the icemaker 102 on the refrigerator compartment door 18.

Figure 16:
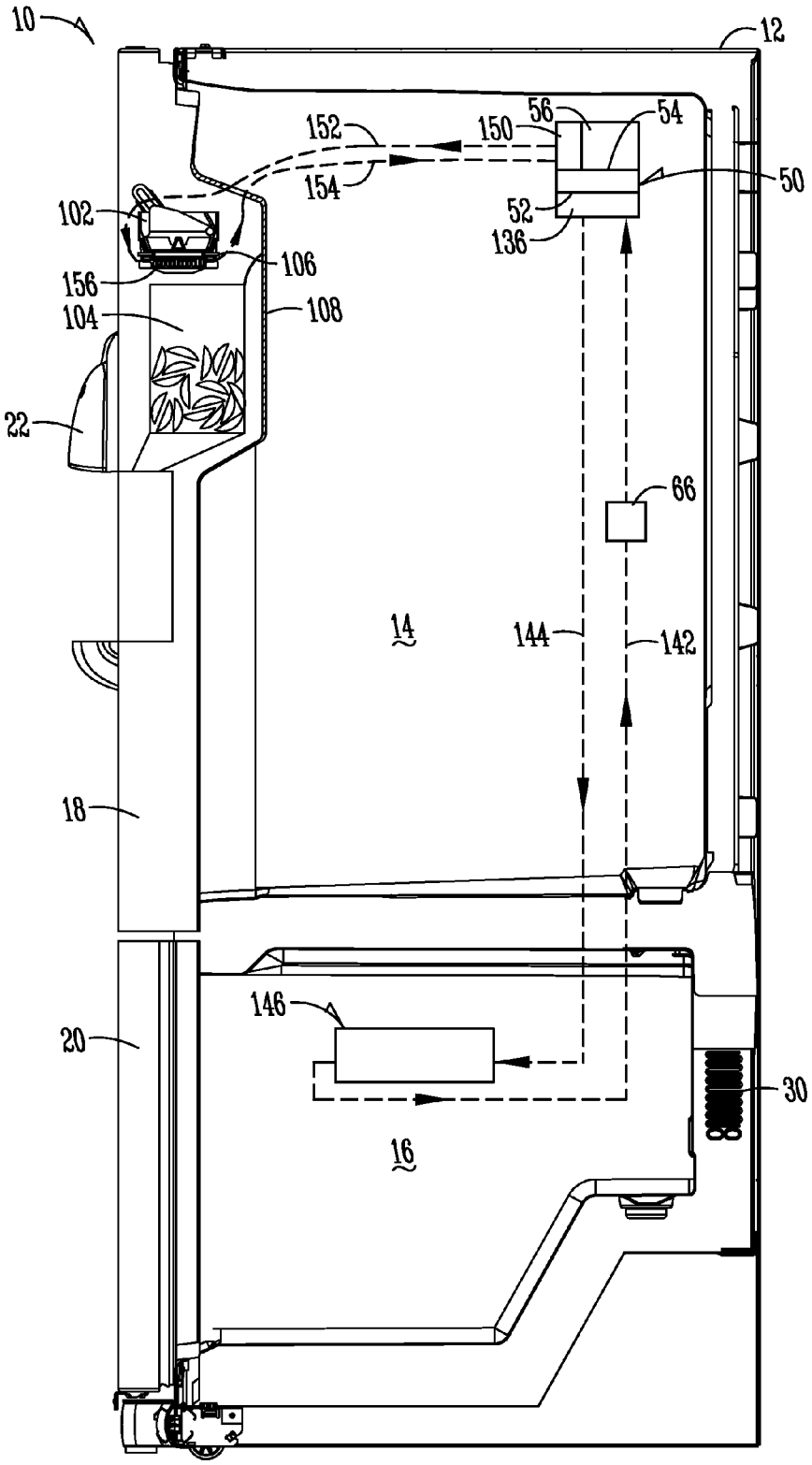
FIG. 16 is another embodiment of the refrigerator shown in FIG. 15.

In the case where fluid is used as the heat carrying medium, a fluid supply pathway 152 may be connected between the fluid sink 56 and the icemaker 102 in the insulated compartment 108 on the refrigerator compartment door 18. As shown for example in FIGS. 15 and 16, a pump 150 may be configured to move fluid from the fluid sink 56 in thermal contact with the cold side 54 of the thermoelectric device 50 through the fluid supply pathway 152 to the icemaker 102. The chilled fluid in the pathway 152 is communicated through the fluid sink 156 in thermal contact with the ice mold 106. In another aspect, fluid may be communicated through cooling channels or veins in the ice mold 106. Heat coming off the warm side 52 of the thermal electric device 50 may be extracted using chilled or sub-zero fluid (e.g., glycol) from the freezer compartment 16. For example, in one aspect of the refrigerator 10, a fluid supply pathway 142 may be connected between an evaporator 30 (or a secondary evaporator) and a fluid sink 136 in thermal contact with the warm side 52 of the thermal electric device 50. A fluid return pathway 144 may be connected between the evaporator 30 (or a secondary evaporator) and the fluid sink 136 in thermal contact with the warm side 52 of the thermal electric device 50. The fluid supply pathway 142 and the fluid return pathway 144 may be configured as a fluid loop between the evaporator 30 and the fluid sink 136 for extracting heat off of the warm side 52 of the thermal electric device 50. A pump 66 may be configured in the fluid loop for moving a cooling fluid (e.g., ethylene glycol or ethylene propylene) to and from the evaporator 30 between the fluid sink 136. Alternatively, as illustrated in FIG. 16, a cold battery or cold reservoir of cooling fluid may be positioned within the refrigerator compartment 14. In one aspect of the refrigerator 10, a heat exchanger 146 may be positioned within the freezer compartment 16. The heat exchanger 146 may also include a fluid reservoir of fluid such as ethylene glycol or ethylene propylene to increase its cold storage potential. The heat exchanger 146 may also comprise a cold battery having a fluid reservoir and the potential of storing a fluid such as ethylene glycol or ethylene propylene at a temperature at or below freezing. Similar to the configuration using the evaporator 30 shown in FIG. 15, the heat exchanger 146 may be connected to the fluid sink 58 by a fluid supply pathway 142 and a fluid return pathway 144. The fluid supply pathway 142 and the fluid return pathway 144 may be configured as a loop for moving fluid from the heat exchanger 146 to the fluid sink 136. A pump 66 may be configured to move fluid through the fluid supply pathway 142 and fluid return pathway 144 between the fluid sink 136 and the heat exchanger 146 positioned in the freezer compartment 16. The fluid in the loop is chilled to the temperature of the freezer compartment and used to extract heat off of the warm side 52 of the thermoelectric device 50 which is then returned to the heat exchanger 146 positioned in the freezer compartment 16. For example, if the freezer compartment is set at 20° Fahrenheit, the warm side 52 of the thermoelectric device 50 may be kept at or near 20° Fahrenheit. The cold side 54 of the thermoelectric device 50 may be then kept at 20° Fahrenheit minus the delta of the thermoelectric device 50. For example, if the thermoelectric device has a delta of 20°, the cold side 54 may be kept at a temperature of 0° Fahrenheit. The fluid from the fluid sink 56 is then cooled to at or near 0° Fahrenheit or the temperature of the cold side 54 of the thermoelectric device 50. The pump 150 moves the chilled fluid from the fluid sink 56 to the icemaker 102 through the fluid supply pathway 152 as previously indicated. The chilled fluid (e.g., glycol) passes through a fluid sink 156 in thermal contact with the ice mold 106 for extracting heat from the ice mold 106 for making ice. The fluid may pass through the fluid sink 156 in thermal contact with the ice mold 106 then through a fluid return pathway 154.

A thermoelectric device 50 may also be positioned with its cold side 54 in thermal contact with the ice mold 106. A fluid sink may be connected in thermal contact with the warm side 52 of the thermal electric device 50. A fluid pathway may be configured between the fluid sink in thermal contact with the warm side of the thermoelectric device and a thermal exchanger (not shown, but would replace thermoelectric device 50 by way of illustration) positioned within the refrigerator compartment 14. Cold fluid from a heat exchanger, such as heat exchanger 146 positioned in the freezer compartment 16 or an evaporator 30 may be communicated to the heat exchanger in the refrigerator compartment 14 for pulling heat away from the heat exchanger. The sub-zero cooling potential communicated to the heat exchanger from the freezer compartment 16 may be carried by fluid to a thermoelectric device connected in thermal contact with the ice mold 106 of the icemaker 102 in the refrigerator compartment door 18. For example, a fluid loop may be configured to communicate cooling fluid from a thermal exchanger in the refrigerator compartment 14 to the ice mold 102. Alternatively, an air loop may be configured to communicate cool air from the heat exchanger in the refrigerator compartment 14 to the ice mold 106. A thermoelectric device having a cold side 54 in thermal contact with the ice mold 106 may be cooled by fluid or air taken from a heat exchanger within the refrigerator compartment 14 where the exchange is provided by a cooling loop connected between a heat exchanger 146 or an evaporator 30.

In each of the above aspects, fluid from the freezer compartment 16 may be communicated directly to a cooling application on the refrigerator compartment door 18 (e.g., chilling the ice mold 106, chilling a reservoir of water for dispensing at dispenser 22 or for filling the ice mold 106, chilling the ice storage bin 104, etc.). For example, refrigerator 10 may be configured to where the chilled fluid from the thermoelectric device 50 is communicated to a cooling application on the door 18. Water in a reservoir in the cooling application may be chilled to or near the temperature of the chilled fluid from the thermoelectric device 50. The water may then be communicated through a fluid supply pathway to the dispenser for supplying cold water to drink or through a fluid supply pathway to the ice mold 106 for supply prechilled water to the ice mold 106 for making ice. This configuration may also be used to provide a heating application on the refrigerator compartment door 18 or within the refrigerator compartment 14. By reversing the polarity of the thermoelectric device 50 the fluid in the supply pathway 152 may be heated and used at a warming application for heating a reservoir of water. The warm reservoir of water may be used to provide warm water at the dispenser 22 or warm water at the icemaker 102 via supply pathway. The warm water at the dispenser may be used for warm liquid drinks and the warm water at the icemaker 102 may be used to purge the ice mold 106.

Figure 17:
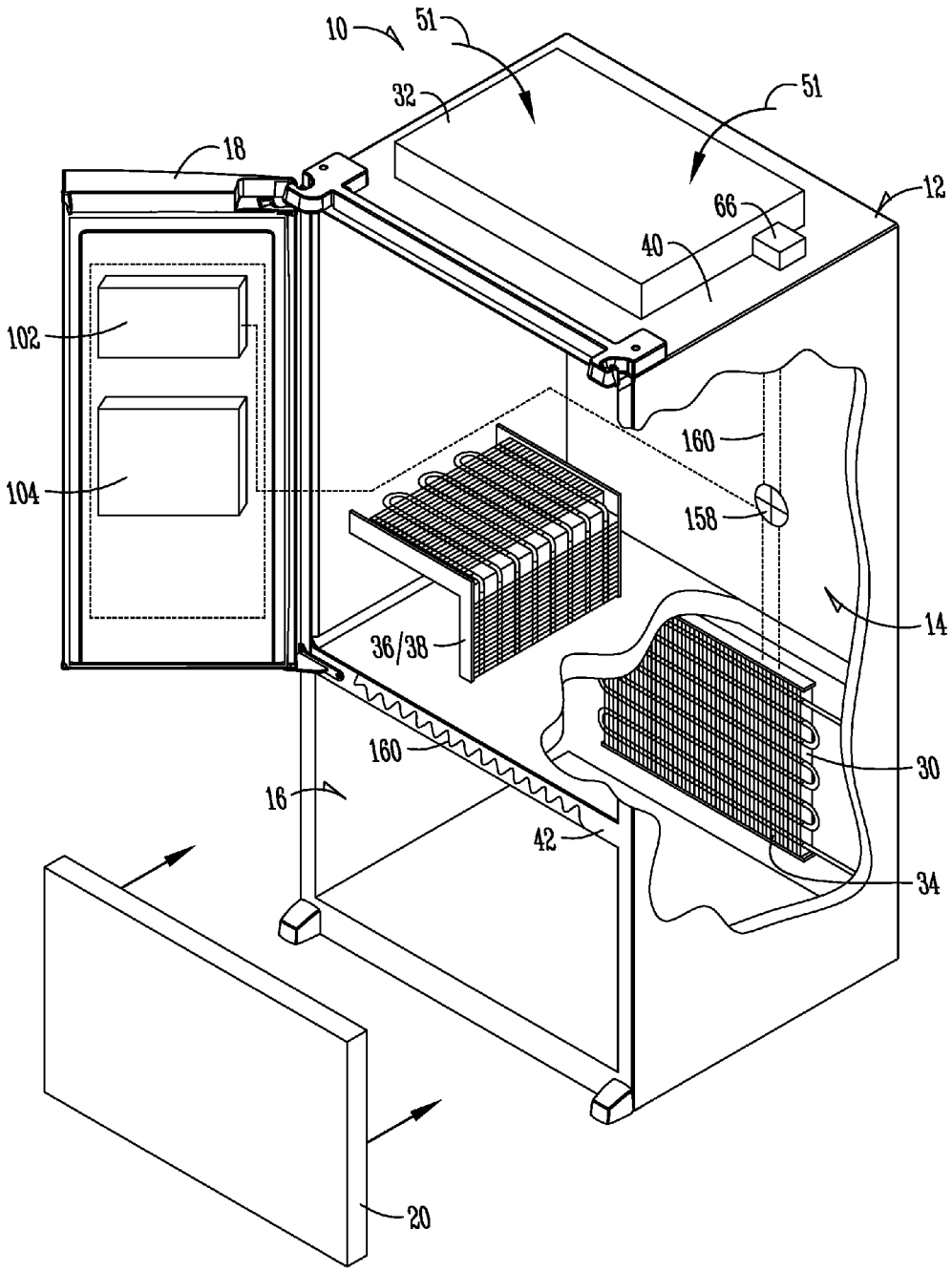
FIG. 17 is a perspective view of a refrigerator with a cutaway for illustrating an exemplary configuration for using latent heat at a heat output.

FIG. 17 is another exemplary embodiment of a refrigerator 10. FIG. 17 shows the refrigerator 10 with the freezer compartment door 20 removed and positioned generally away from the freezer compartment 18. The refrigerator compartment door 18 is open and a portion of the refrigerator cabinet 12 removed such that the inside of the refrigerator 10 may be viewed. FIG. 17 also shows the location of some of the applications that may utilize a heat output during operation. These applications may include, for example, certain applications of a refrigerator 10 that require a heat output. However, these applications may be located remote of the heat reservoir 32. Examples of such applications utilizing a heat output may include, but are not limited to, a defrost operation such as defrosting the evaporator coils, where the heat output is used to defrost the coils, an ice maker having an ice mold with a heat output used to help separate the formed ice cubes from the mold, an anti-condensation operation with the heat output used to aid in limiting or preventing sweat or fluid occurring on some exterior surface of the refrigerator, an anti-freezing operation such that the heat operation prevents a device such as a fill tube from freezing during normal operation of the refrigerator, or a storage space having a warming operation such that the heat output maintains the temperature in the storage space at a temperature to prevent freezing or to provide accelerated defrost for a consumable item. Other applications obvious to those skilled in the art that may benefit from receiving a heat output may also be included as part of the disclosure. The above-identified applications are for exemplary purposes, and are not to limit the disclosure.

FIG. 17 also shows an icemaker 102 and ice storage bin 104 positioned on the interior of the refrigerator compartment door 18. However, it should be appreciated that the icemaker 102 and/or ice storage bin 104 may also be positioned within the refrigerator compartment 14, such as at the top wall or sidewall thereof. FIG. 17 also shows the position of an evaporator 30 including evaporator coils 34 that are used in the refrigerator cycle to provide cool air for the refrigerator 14 and/or freezer compartment 16. The location of the evaporator 30 may vary according to refrigerator 10. Also shown in FIG. 17 is a mullion 42 separating the refrigerator compartment 14 and a freezer compartment 16, and a warm storage compartment 36, which also may be configured as a defrost compartment 38 in another embodiment. The warm storage and/or defrost compartment 36, 38 may be used to provide an area within the cabinet 12 that is at a higher temperature than the rest of the compartment. While the figures show the warm storage compartment 36 positioned in the refrigerator compartment 14 as a drawer or separate compartment, it should be appreciated that the warm storage compartment 36 and/or defrost compartment 38 may also be a bin, shelf, drawer and/or other compartment or area within the refrigerator, and is not limited to the configuration shown.

In another aspect of the refrigerator 10, a heat reservoir 32 may be positioned on an exterior 40 of the refrigerator cabinet 12. In FIG. 17, the heat reservoir 32 is positioned on the top of the refrigerator cabinet 12. Ambient air, which is at a temperature generally greater than the freezer compartment air (e.g., temperatures near or below 0° Fahrenheit) and the refrigerator compartment air (e.g., temperatures generally between 38° Fahrenheit and about 42° Fahrenheit), includes latent heat, which may be harvested by the heat reservoir. This is shown by the arrows 51 in FIG. 17. For example, the latent heat of the ambient air may be absorbed by the heat reservoir 32 due to the temperature and/or composition of the fluid within the heat reservoir 32. As discussed, the fluid within the heat reservoir 32 may be glycol or another anti-freeze or PCM, or it may be water. Thus, the latent heat 51 of the ambient air may be absorbed into the fluid to increase the temperature of said fluid. A pump 66 is operatively attached to the heat reservoir 32 and also to one or a plurality of fluid pathways or flow pathways 160. The fluid or flow pathways 160 are operatively connected to the heat reservoir 32, pump 66 and location of the applications requiring the heat output. For example, one such fluid pathway 160 may extend from the heat reservoir 32 to the icemaker 102 such that when ice has been formed in the ice mold 106 of the icemaker 102, the warm fluid of the heat reservoir 32 is directed by the pump 66 to the ice mold 106 to aid in dislodging the formed ice from the mold 106. Other pathways 160 may direct the fluid of the heat reservoir 32 to other applications, such as the evaporator 30 or warm storage compartment 36. In addition, the pathways may include flow controllers 158 (e.g., dampers or baffles), which may aid in directing the fluid from the heat reservoir 32 to the application requiring the heat output.

Furthermore, while the foregoing describes the movement of the actual fluid within the heat reservoir 32, it is contemplated that the heat reservoir 32 comprises a PCM or other heat exchange. In such a case, a fluid may only need to pass through the heat reservoir 32 in order to absorb heat from the PCM or heat exchanger within the heat reservoir, thus raising the temperature of the passing fluid. Therefore, the setup would eliminate the need for a fluid storage, as the pathways 160 may simply pass through the heat exchanger/PCM of the heat reservoir 32. Such a configuration would be akin to the refrigerant passing through the refrigeration cycle to provide cooled air for the refrigerator compartments.

Figure 18:
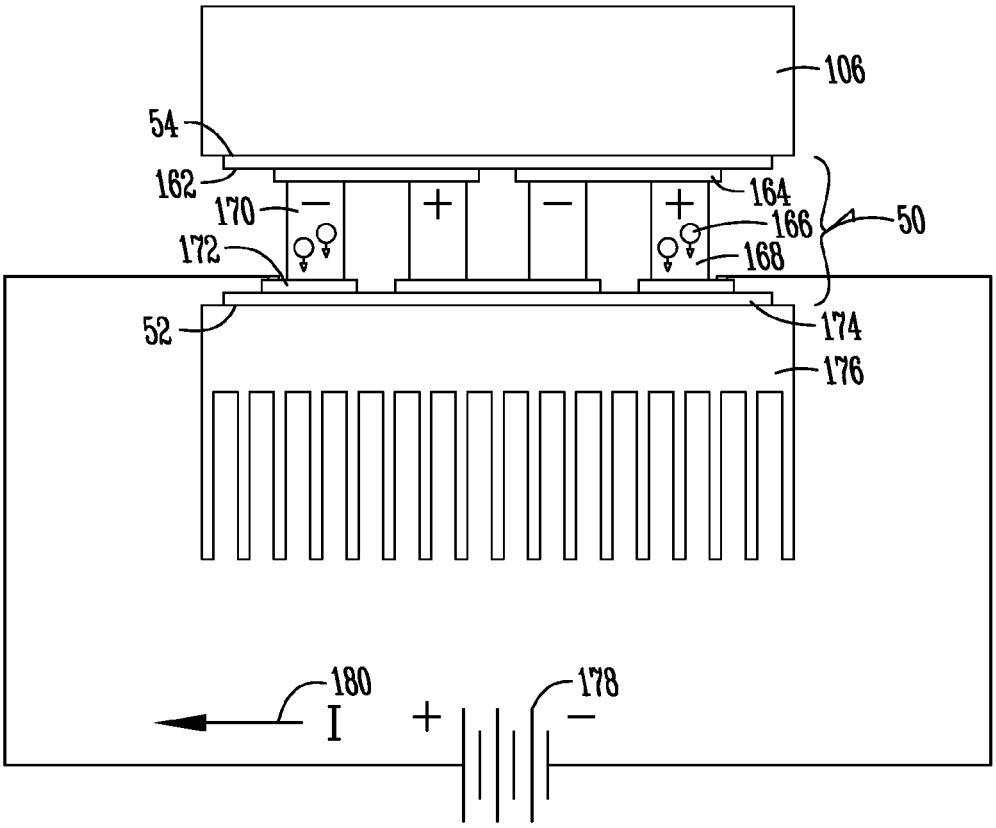
FIG. 18 is a schematic illustration of a thermoelectric device according to one exemplary embodiment.
Figure 19:
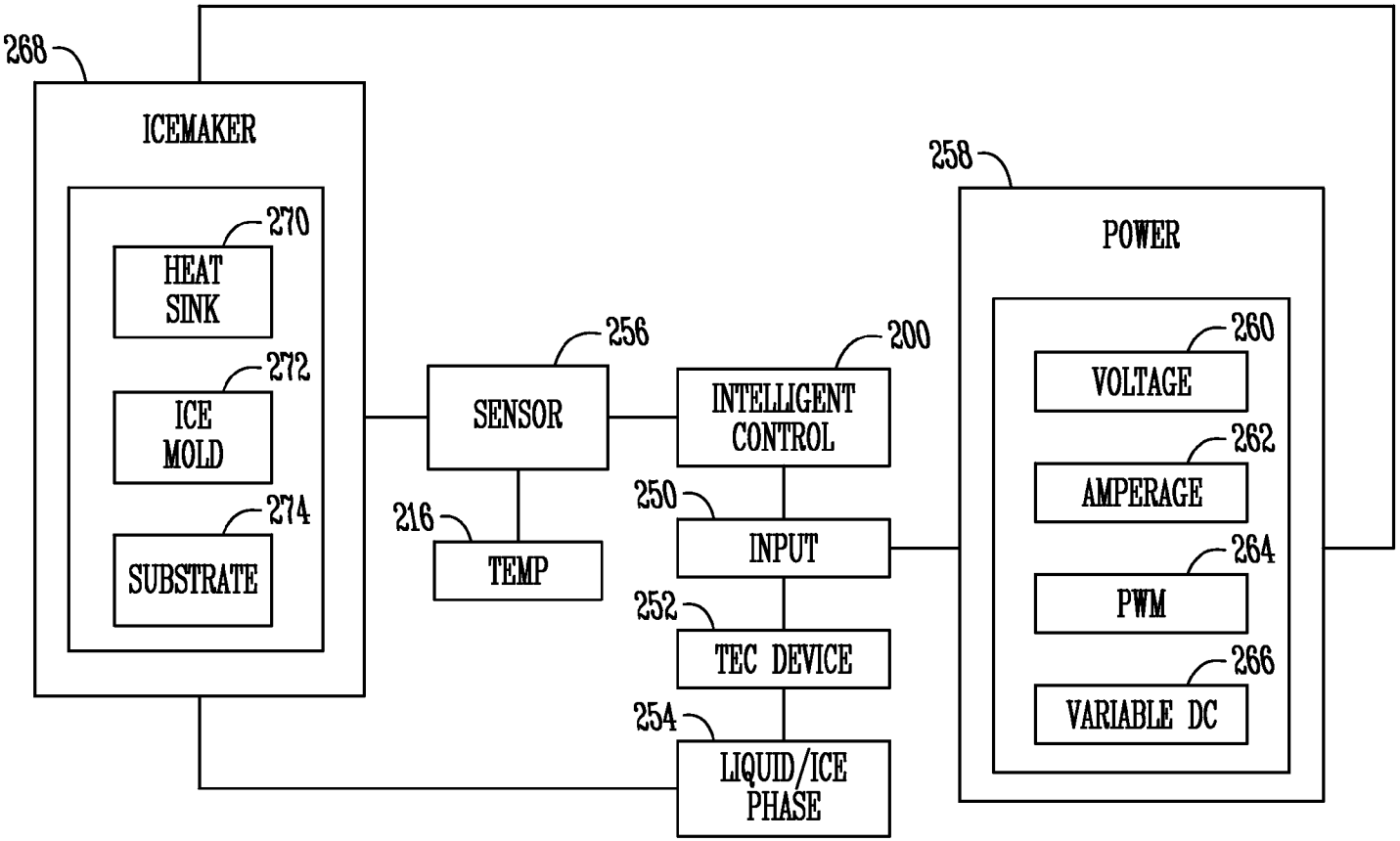
FIG. 19 is a flow diagram illustrating a process for intelligently controlling one or more operations or processes for forming an ice product using a thermoelectric device.

FIG. 18 illustrates an exemplary embodiment of an icemaker 102 configured so that the ice mold 106 may be chilled or heated using a thermoelectric device 50 using, for example, the process shown in FIG. 19. As previously indicated, the thermoelectric device 50 includes a cold side 54 and an opposite warm side 52. The cold side 54 is in thermal contact with ice mold 106. And, the warm side 52 is in thermal contact with the heat sink 176. Using the Peltier effect, a temperature difference is created between the cold side 54 and warm side 52 of the thermoelectric device 50. According to one aspect of the invention, a substrate 162 having a high thermal conductivity may be configured between the ice mold 106 and conductor 164 at the cold side 54 of the thermoelectric device 50. On the opposite side of the thermoelectric device 50, a substrate 174 having a high thermal conductivity may be configured in thermal contact with the heat sink 176 and conductor 172. Configured between conductors 164 and conductors 172 are negative-type pellets 170 and positive-type pellets 168 for providing a flow pathway for charge carriers 166. A power source 178 is connected to conductors 172 for providing a current 180 to the thermoelectric device 50. The voltage and amperage of the power source 178 may be controlled according to one aspect of the disclosure. Using one or more sensors and/or monitoring one or more inputs to the thermoelectric device 50, a system (see FIG. 19) may be configured to monitor a liquid to ice phase change 254 for fluid contained in the ice mold 106. Alternatively, the system may be configured to monitor an ice to liquid phase change 254, such as for example, in an ice harvesting cycle or a fresh ice production cycle. By reversing the polarity of the thermoelectric device 50, the warm side 52 and cold side 54 are swapped so that the ice mold would be in thermal contact with a warm side of the device 50 and the heat sink 176 would be in thermal contact with the cold side of the device 50. Although the thermoelectric device 50 is described as being in thermal contact with the ice mold 106, the disclosure contemplates that a fluid or air pathway could be configured in thermal contact between the ice mold 106 and the thermoelectric device 50 to chill or warm the ice mold 106 from a remotely positioned thermoelectric device 50.

Temperature control for the thermoelectric device 50 may be configured to use a thermostatic temperature control or a steady-state temperature control. With a thermostatic control, a thermal load is maintained between two temperature limits. For example, in an ice making cycle, the intelligent control 200 (as shown in FIG. 19) may be configured to energize the power source 258 when a thermal load rises to or above 32° Fahrenheit then turning off the power source 258 when the temperature cools to 29° Fahrenheit. The system would then therefore be continually varying the temperature between 29° and 32° Fahrenheit. To monitor operating temperatures of the thermoelectric device 50 during a liquid to ice phase change or an ice to liquid phase change 254, one or more sensors 256 may be configured at locations to sense the temperature 264 of, for example, the ice mold 272, the heat sink 270 or a substrate 274 (e.g., a conductor). The substrates 274 in thermal contact with the ice mold 272 or the heat sink 270 may also be configured with sensors 256 to monitor the temperature 264 to determine the liquid to ice phase change or the ice to liquid phase change 254. Alternatively, conductors 164 or 172 may be configured with one or more sensors 256 for monitoring the temperature 264 of a liquid to ice phase or ice to liquid phase change 254. The intelligent control 200 can be configured to control the flowrate of air or liquid to the heat sink 270 depending upon the temperature 264 sensed by one or more sensors 256 at the heat sink 270. Thus, according to one aspect of the disclosure, one or more sensors 256 may be configured at the icemaker 268 to monitor the temperature 264 of a heat sink 270 in thermal contact with the ice mold 272 or a substrate 274 in thermal contact with the ice mold 272 or the heat sink 270. Using the intelligent control 200 to monitor the temperature 264 using one or more sensors 256 at the above described locations provides one way of monitoring the liquid to ice or ice to liquid phase change 254 being driven by the thermoelectric device 252. The rate of flow of liquid or air to the heat sink 270 may be controlled by the intelligent control 200 to control the temperature 264 of the warm side of the thermoelectric device 252. If, for example, the intelligent control 200 determines from a reading from the sensor 256 that the phase of the liquid or ice 254 is not at a temperature 264 to have a phase change, whether to ice or whether to liquid depending on whether an ice production, ice harvesting or fresh ice production cycle is being performed, the intelligent control 200 may provide a correction to increase or decrease the temperature 264 by increasing/decreasing the flowrate of air or liquid to the heat sink 176.

In addition to controlling the rate of flow across the heat sink 270 of the icemaker 268, the inputs 250 for operating the thermoelectric device 252 may be controlled using intelligent control 200 to control the liquid to ice or ice to liquid phase change 254 in the ice mold 272 of the icemaker 268. For example, the thermoelectric device 252 may be operated in a steady-state control by varying the inputs to the thermoelectric device 252 using an intelligent control 200. In one aspect, the intelligent control 200 varies the power inputs 258 to the thermoelectric device 252 to maintain the ice mold 272 of the icemaker 268 at a desired temperature 264. In operation, for example, the intelligent control monitors the temperature 264 via one or more sensors 256 at the ice mold 272 of the icemaker 268 (assuming that the temperature 264 of the ice mold 272 is generally indicative of the liquid to ice or ice to liquid phase 254 of the liquid in the ice mold 272 of the icemaker 268). The intelligent control 200 may also be configured to alter the temperature 264 of the thermoelectric device 252 by changing one or more of the inputs 250, such as the power 258. In one aspect of the invention, the voltage 260 of the power source 258 may be controlled by the intelligent control 200 to maintain the temperature 264 across the thermoelectric device 252 at a desired temperature 264 for the liquid to ice phase or ice to liquid phase change 254 to occur in the ice mold 272. Similarly, the amperage 262 of the power source 258 supplied as an input 250 to the thermoelectric device 252 may be controlled using the intelligent control 200 for controlling the temperature 264 of the liquid to ice or ice to liquid phase change 254 in the ice mold 272. The power 258 supplied as an input 250 to the thermoelectric device 252 may also be varied using pulse-width modulation (PWM) 264 or a variable direct current 266 such as linear control. Using pulse width modulation 264 to control power 258 as an input 250 to the thermoelectric device 252, the frequency for pulsing the thermoelectric device 252 on and off may be controlled, for example, under operation of the intelligent control 200. For example, the intelligent control 200 may be configured to control the percentage of "on" time versus "off" time (i.e., the duty cycle) during pulse width modulation 264 of the power 258 provided to the thermoelectric device 252. Alternatively, a variable DC 266 level may be used to power the thermoelectric device 252. Using for example, a linear drive current as power 258 input 250 into the thermoelectric device 252 under control of the intelligent control 200, the thermoelectric device 252 may be linearly driven to control the liquid to ice or ice to liquid phase change 254 in the ice mold 272 of the icemaker 268. One or more sensors 256 positioned in locations at the icemaker 268, as previously described, may be used to monitor the temperature 264 and provide feedback to the intelligent control 200 to provide correction to the inputs 250 from the power sources 258 (e.g., voltage 260, amperage 262, pulse width modulation 264, variable DC 266). For example, since the liquid to ice phase change or the ice to liquid phase change 254 requires a certain amount of energy for the change to occur, this energy may be detected by one or more sensors 256 positioned at one or more locations at the icemaker 268 (e.g., heat sink 270, ice mold 272, substrate 274, conductor 1168, etc.) to determine the temperature 264 and provide information to the intelligent control 200 based on inputs 250 to the thermoelectric device 252. For example, the power 258 inputs 250 such as voltage 260, amperage 262, pulse width modulation 264 or variable DC 266 may be controlled or corrected depending upon the phase of the liquid to ice stage or ice to liquid stage 254. In one aspect of the disclosure, in a liquid to ice phase change 254, the temperature 264 of the liquid in the ice mold 272 may remain generally flat although the inputs 250 to the thermoelectric device 252 may increase at least until the entire ice mold 272 is frozen (i.e., all the water in the mold is frozen) and ice is formed. Alternatively, when ice in contact with a surface of the ice mold 272 is being changed from ice to liquid, the temperature 264 of the ice mold 272 may be fairly level despite the increase in inputs 250 (e.g., power 258 to the thermoelectric device 252) until the phase change occurs. In this manner, power 258 provided as an input 250 to the thermoelectric device 252 may be monitored (e.g. voltage 260, amperage 262, pulse width modulation 264 or variable DC 266 may be monitored) to determine the phase of the liquid to ice or ice to liquid phase change 254 in the ice mold 272 of the icemaker 268. Temperature 264 taken by one or more sensors 256 positioned at, for example, a heat sink 270 in thermal contact with the ice mold 272 or a substrate 274 may be used to provide a feedback response to the intelligent control 200 for correcting or adjusting the inputs 250 to the thermoelectric device 252. Thus, using at least in part, existing features and inputs to a thermoelectric device 50, a low energy system for monitoring the ice to liquid or liquid to ice phase change 254 for an icemaker 268 chilled or warmed by a thermoelectric device 252 is provided.

Figure 20:
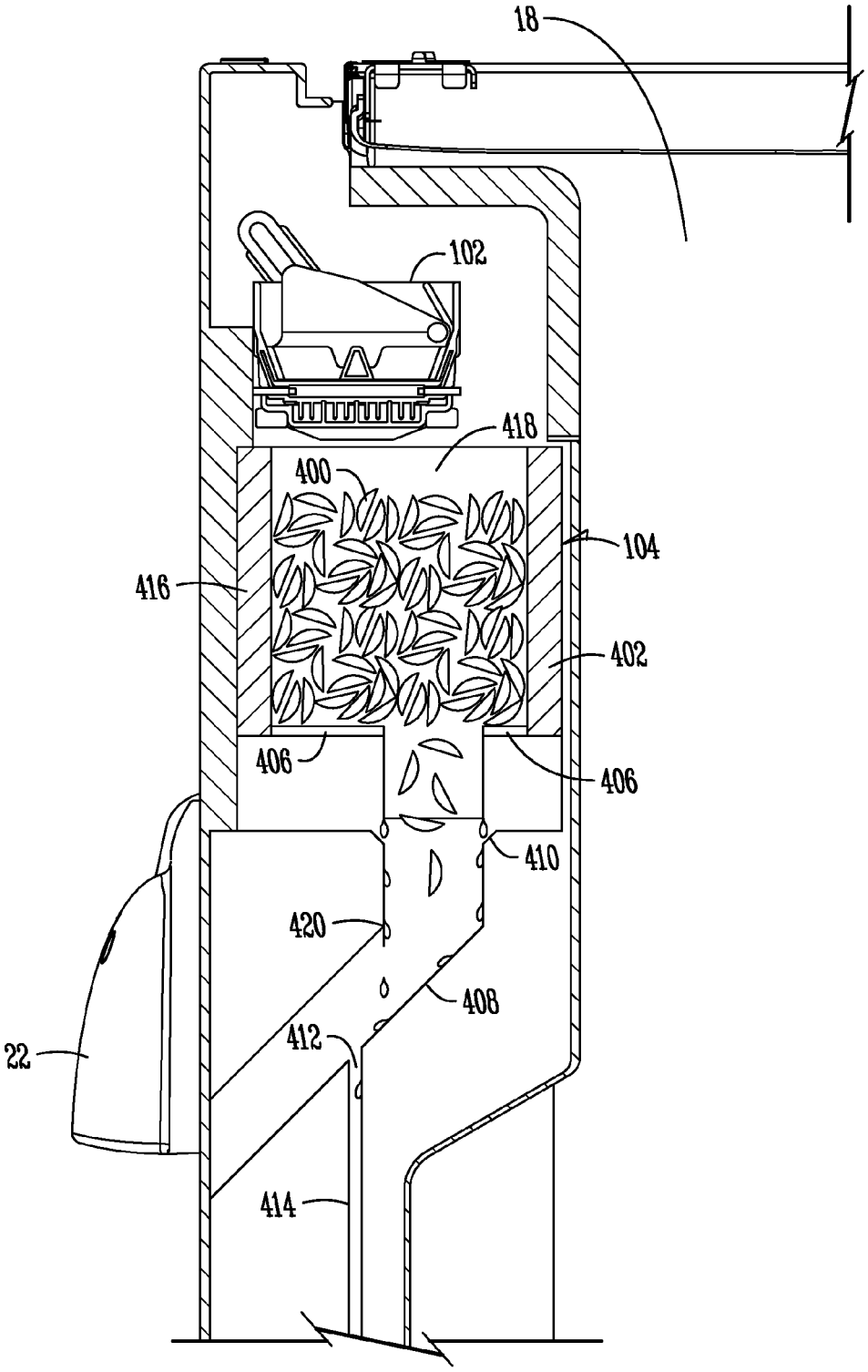
FIG. 20 illustrates an icemaker and ice storage bin within a refrigerator.

FIG. 20 illustrates another view of a French door 18 of a refrigerator with an ice maker 102 and ice storage bucket 104 as well as a dispenser 22. As shown in FIG. 20, ice cubes 400 from the ice maker 102 are deposited into the ice storage bucket 104. The ice storage bucket 104 may have insulated walls such as insulated upper walls 402, 416 forming an integral one piece chamber 418. A funnel 410 may be used to funnel ice 400 away from the ice bucket 26 to another location such as to the dispenser 22. A drip edge 420 may be provided. As ice melts in the ice bucket 104 the melt water may be conveyed down edges of a chute 408 and may then be captured in a drain or water trap 412. The drip edge 420 may be generally above the water trap 412 so that droplets of melt water fall into or above the water trap 412. The melt water may then be conveyed through a gutter or tube 414 to another location such as an evaporator tray, the drip tray of the dispenser 22 having an associated heater, an evaporator, a pump, a reservoir, back to the ice maker, the water dispenser, outside of the refrigerator, an atomizer, a mister, or elsewhere. It is to be understood that the drip water thus may be evaporated or re-used in any number of different ways.

Figure 21:
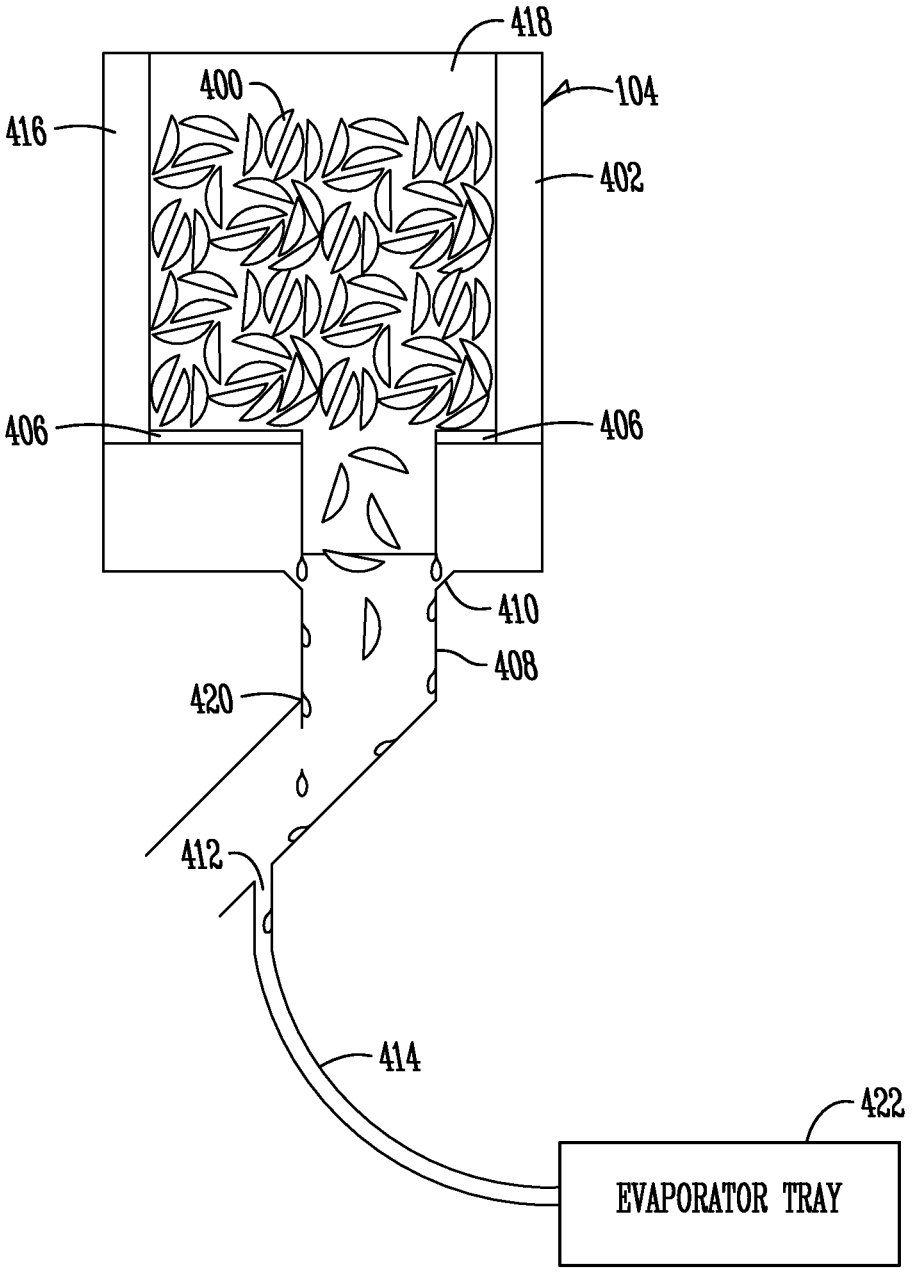
FIG. 21 illustrates one example of an ice storage bin with a heater.

FIG. 21 illustrates one example of an ice storage bucket 104 where melt water is drained to an evaporator. As shown in FIG. 21, melt water may be conveyed through a gutter or tube 414 to an evaporator tray 422. The melt water may then be evaporated at the evaporator tray 422. Also, as shown in FIG. 21, a heater 406 may be positioned within the ice storage bucket 104. The heater 406 may provide for conductive heating and may, for example, be a warm side of thermo electric cooler (TEC) which provides for conductive heating of ice within the ice storage bucker 104. Alternatively, the heater 406 may be of other types and may be located elsewhere provided it is thermally coupled to the ice storage bucket 104 or ice associated therewith. Although a heater may be used, it is to be understood that instead of a heater refrigerator air may be ducted into the ice storage bucket 104 to melt ice or alternatively, the ambient temperature may melt ice within the ice storage bucket 104 without using additional heat sources.

Figure 22:
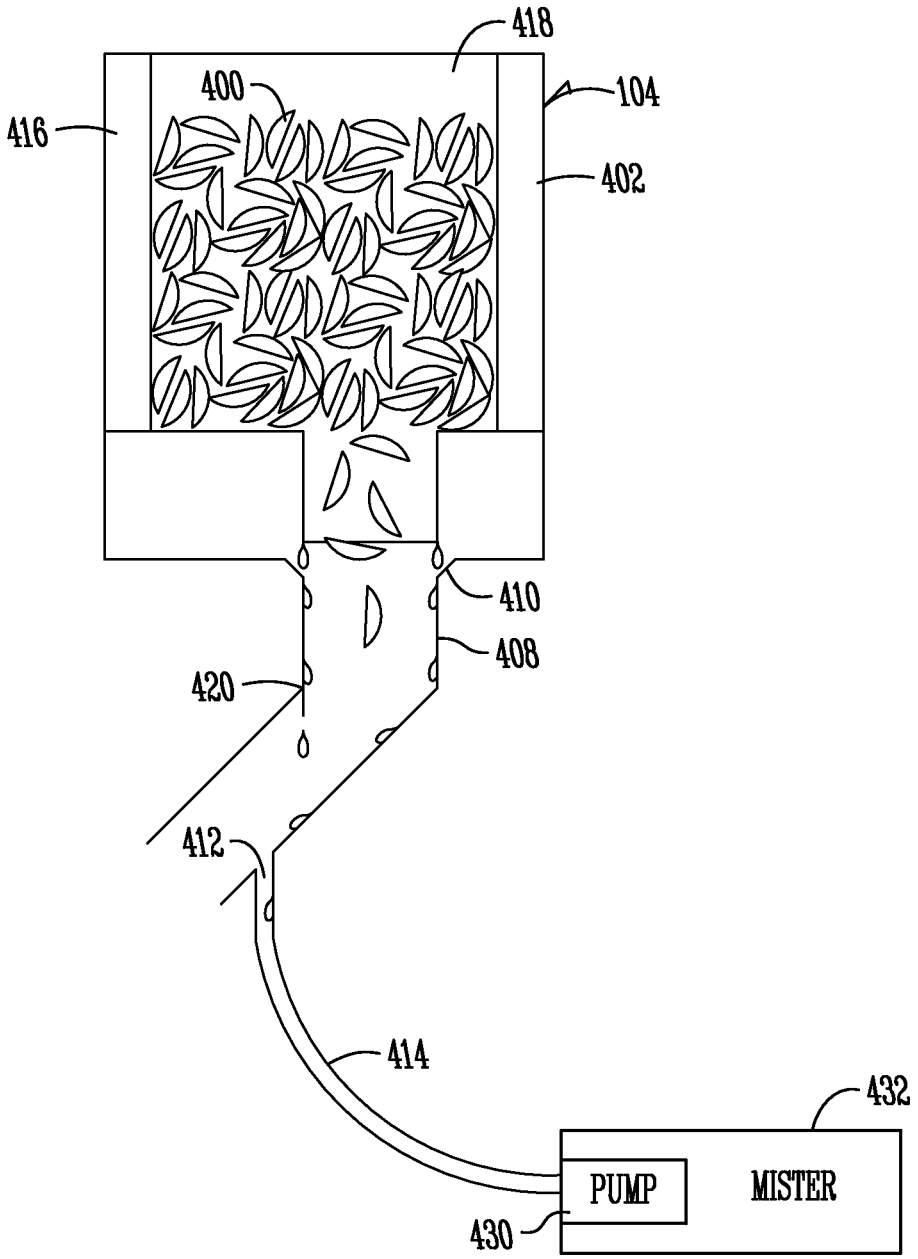
FIG. 22 illustrates one example of an ice storage bin where melt water is communicated to a mister.

FIG. 22 illustrates another example of using melt water in an alternative manner. As shown in FIG. 22, melt water is conveyed through a gutter or tube 414 to a pump 430 which may be associated with a mister 432. Thus, melt water may be misted into the refrigeration compartment, a crisper drawer, other drawer or bin within the refrigeration compartment or elsewhere.

Figure 23:
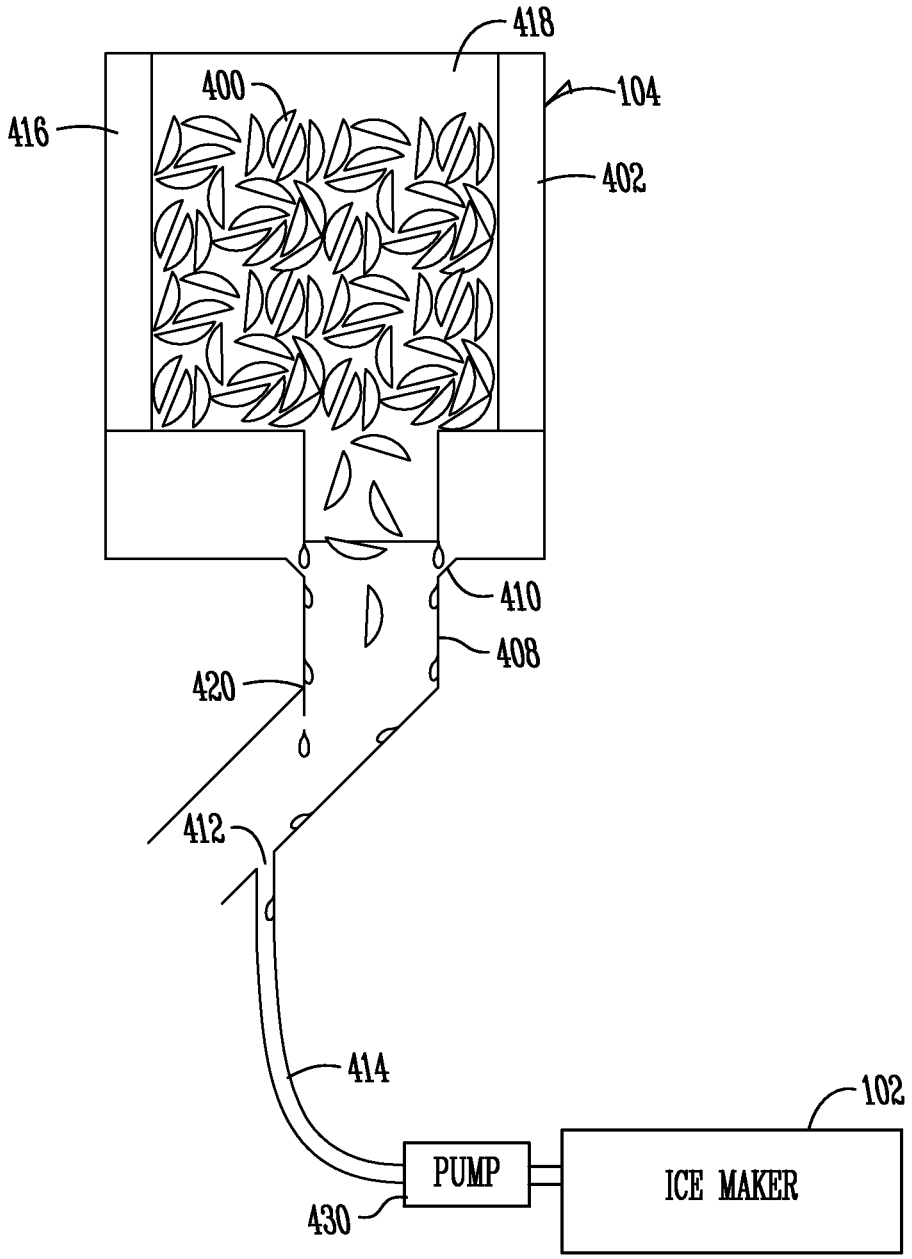
FIG. 23 illustrates one example of an ice storage bin where melt water is communicated to an icemaker.

FIG. 23 illustrates another example of using melt water in an alternative manner. As shown in FIG. 23, melt water is conveyed through a gutter or tube 414 to a pump 430 which may then pump the melt water back to the ice maker 102. The ice maker 102 may use the melt water in various ways including to make ice or in cooling. Such a use of melt water may be advantageous as it is already cold and thus less energy would need to be expended for cooling it compared to water at higher temperatures.

Figure 24:
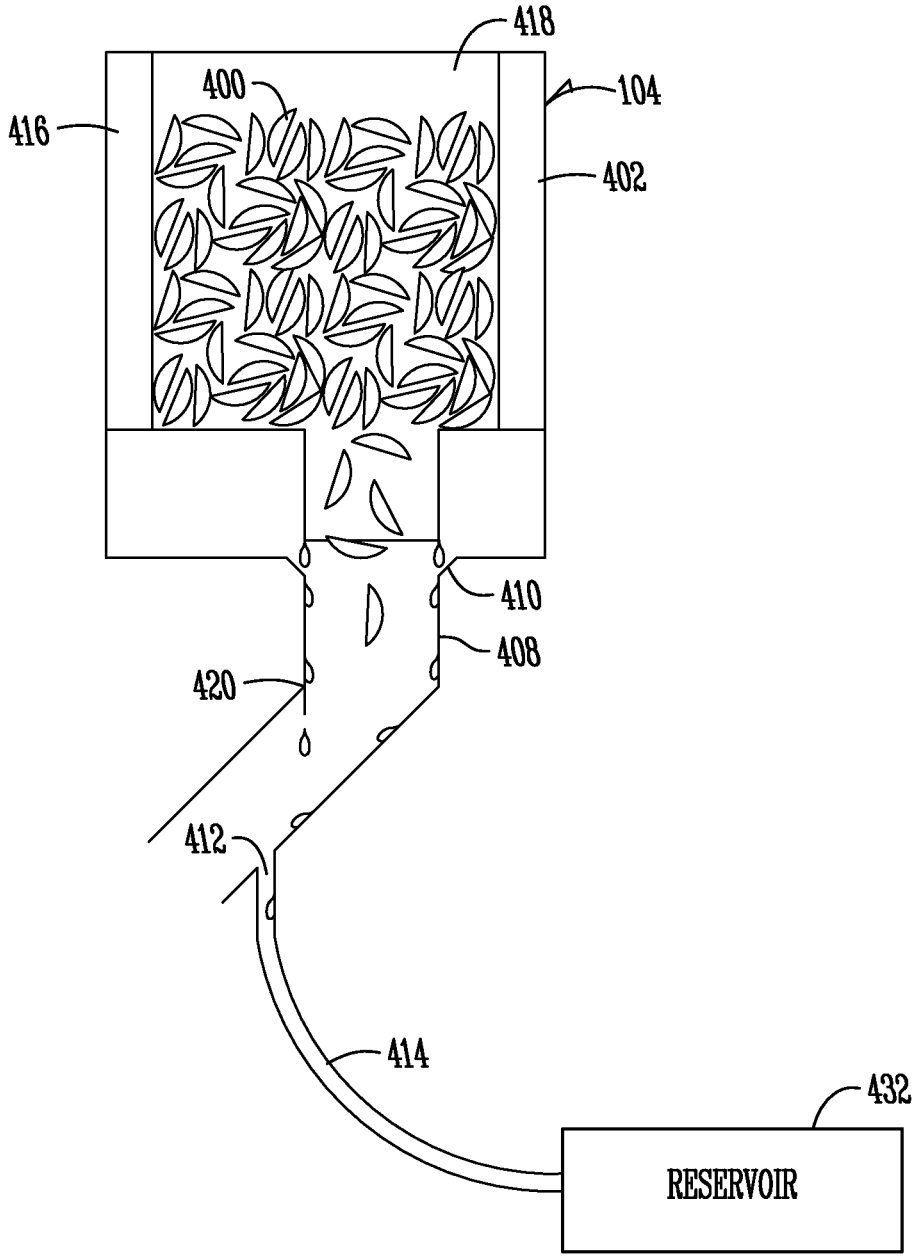
FIG. 24 illustrates one example of an ice storage bin where melt water is communicated to a reservoir.

FIG. 24 illustrates another example of using melt water in an alternative manner. As shown in FIG. 24, melt water may be conveyed through a gutter or tube 414 to a reservoir 432. It is contemplated that once collected in the reservoir 432, the melt water may be used in various ways, disposed of by a user or otherwise, or otherwise used.

Figure 25:
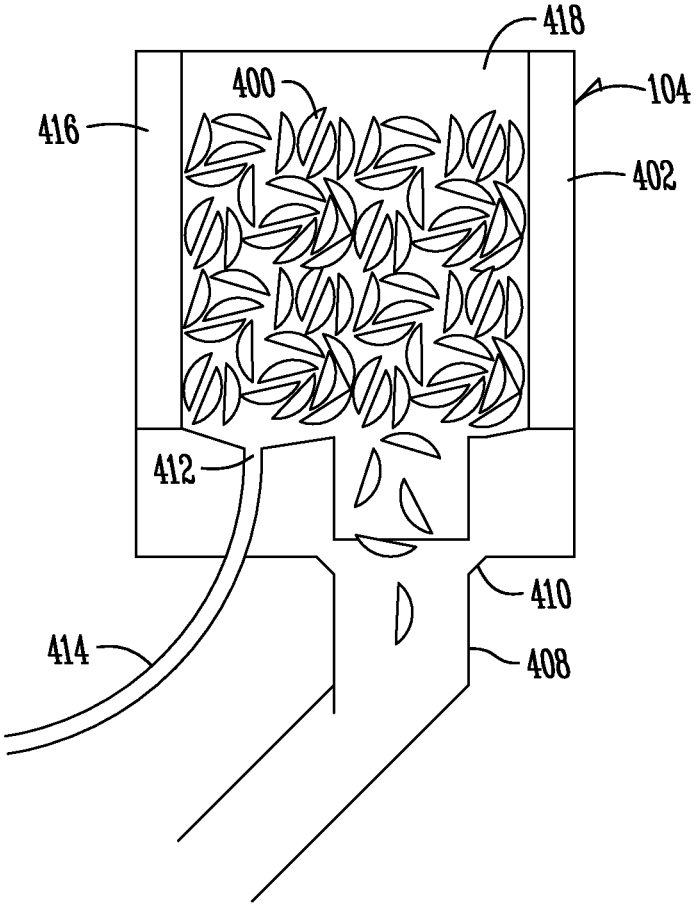
FIG. 25 illustrates one example of an ice storage bin with an alternative location for a drain.

FIG. 25 illustrates another example of using melt water in an alternative manner. As shown in FIG. 25, a drain 412 may be positioned within the body of the ice storage bin 104. Thus, melt water may be conveyed through the drain 412 and through a gutter or tube 414 to another location.

Figure 26:
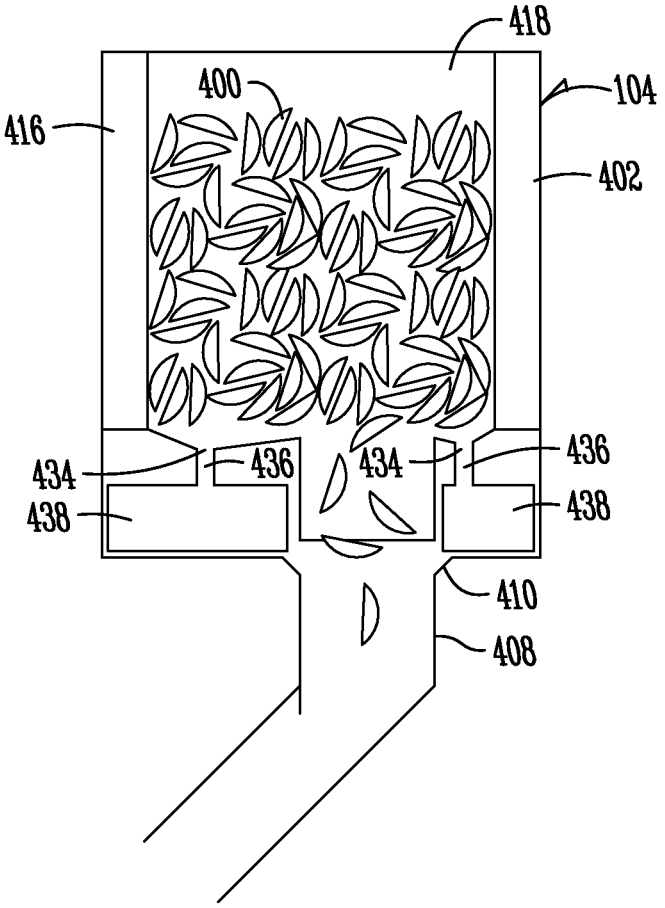
FIG. 26 illustrates one example of an ice storage bin where melt water is collected in one or more reservoirs within the ice storage bin.

FIG. 26 illustrates another example of collecting melt water. As shown in FIG. 26, melt water may travel through grains 434 and through conduits 436 to one or more reservoirs 438. As shown in FIG. 26, the reservoirs 438 are disposed within the ice storage bucket 104. Thus, a user could remove the ice storage bucket 104 and empty the melt water from the ice storage bucket 104.

Figure 27:
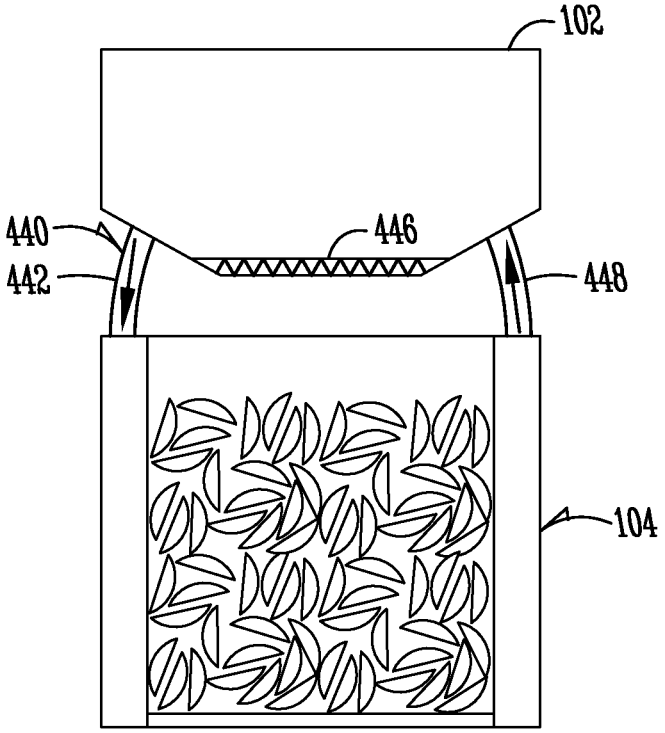
FIG. 27 illustrates one example of an ice storage bin with a fluid warming loop.

FIG. 27 illustrates another embodiment wherein a heater in the form of a fluid warming loop 440 is thermally to the ice storage bucket 104 to melt ice stored in the ice storage bucket 104. The fluid warming loop 440 may be associated with a TEC 446 associated with the ice maker 102 which warms fluid in the loop from an inlet 442 associated with the ice storage bucket 104, along one more walls or surfaces of the ice storage bucket 104 and to an outlet 442 and back to the ice maker 102. Thus, it is to be understood that the heater, where used, need not necessarily be in the ice storage bucket but may be in another location provided that the heater is thermally coupled to the ice storage bucket. It is further to be understood that the heater may operate in various ways and may use air flow, liquid flow, or otherwise use fluid flow to melt ice storage in the ice storage bucket or may use conduction heating instead as previously explained. It is to be further understood that a heater need not be used. Instead, air may be ducted from the refrigeration compartment to melt ice. Alternatively, the ambient temperature may be used to melt ice.

Figure 28:
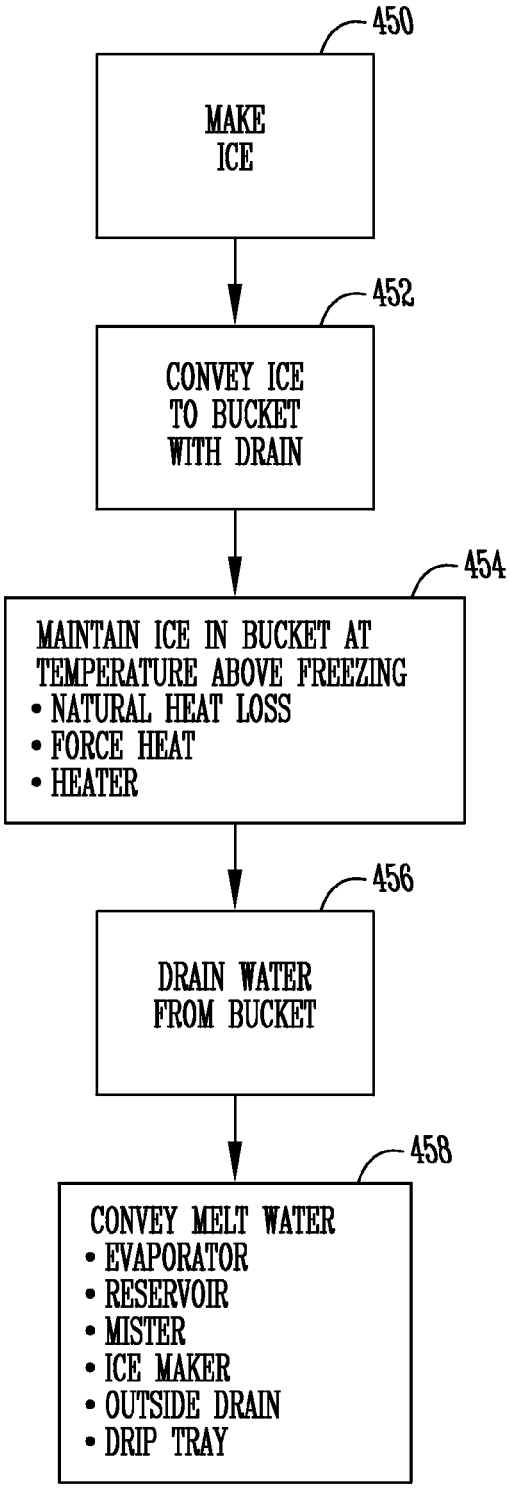
FIG. 28 illustrates one example of a method.

FIG. 28 illustrates one method related to melt water. In step 450 ice is made using an ice maker. In step 452, ice is conveyed to an ice storage bucket with a drain. In step 454, the ice is maintained in the ice storage bucket at a temperature above freezing. This temperature may be obtained through natural heat loss, force heater, using a heater or otherwise. Next, in step 456, melt water is drained from the ice storage bucket. In step 458, the melt water is conveyed to an evaporator, a reservoir (which may be within the ice storage bucket or elsewhere), a mister, an ice maker, an outside drain, a drip tray, or elsewhere.

Figure 29:
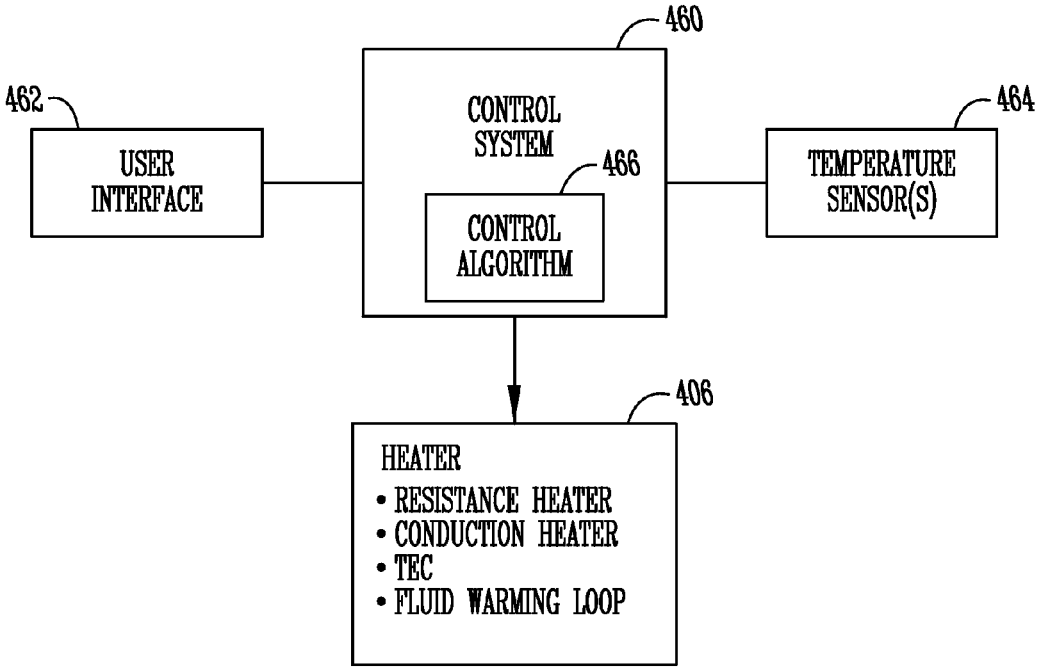
FIG. 29 illustrates one example of a control system for controlling a heater associated with an ice storage bin.

FIG. 29 illustrates one example of a control system 460 which may be used to control temperature of ice stored within the ice storage bucket. The control system 460 has a control algorithm 466. The control system is operatively connected to a user interface 462, temperature sensors 464, and a heater 406. The heater 406 may be a resistance heater, a conduction heater, a TEC, a fluid warming loop, or other type of heater. In operation, the control system may determine when to operate the heater 406 in order to melt ice which is stored in the ice storage bucket. It is contemplated that ice may be melted due to a selection made by a user using the user interface 462. Ice may be periodically melted to refresh the ice being stored, or for other reasons.

Figure 30:
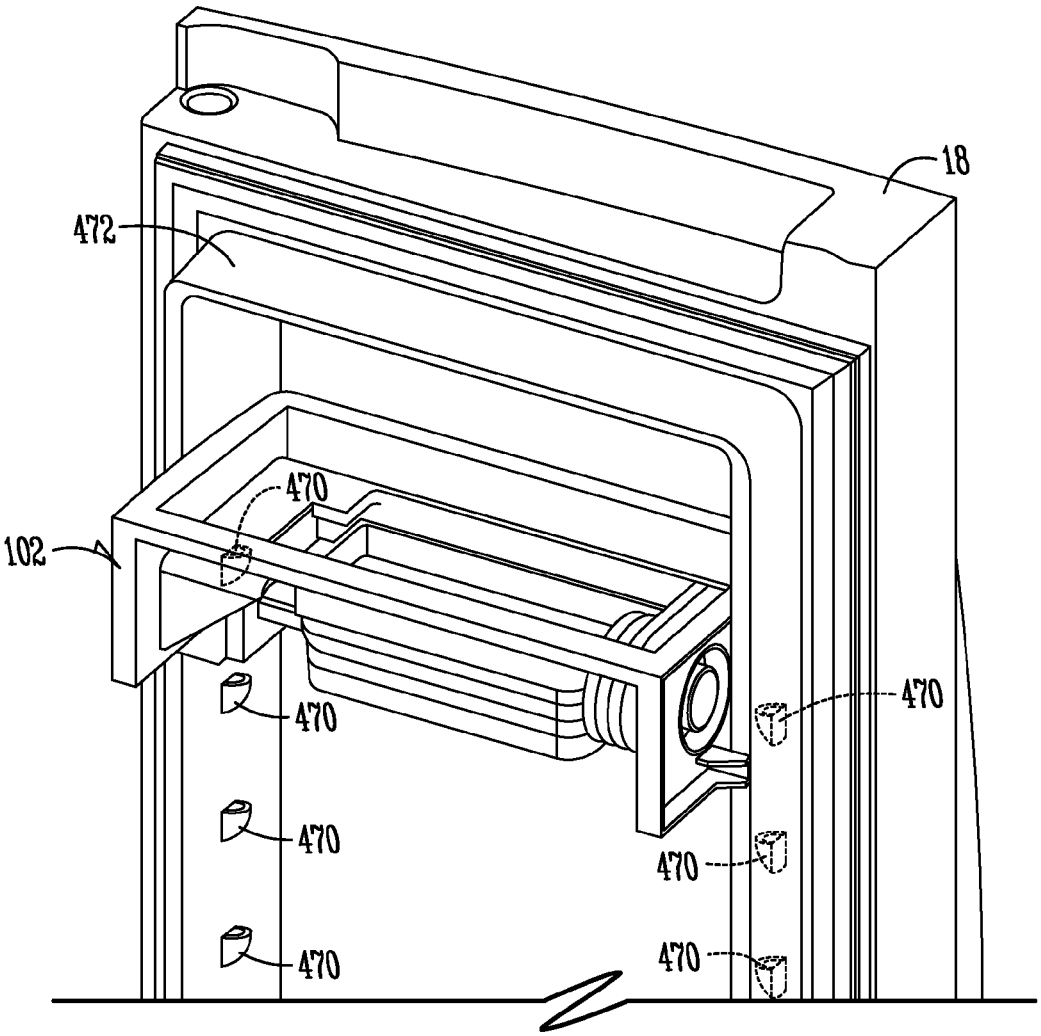
FIGS. 30-32 illustrate diagrammatically different ways in which a moveable independently temperature controlled enclosure or device can be adjustably mounted within a refrigerator cabinet and have quick connect or releasable connections for either electrical power or liquid conduits.
Figure 31:
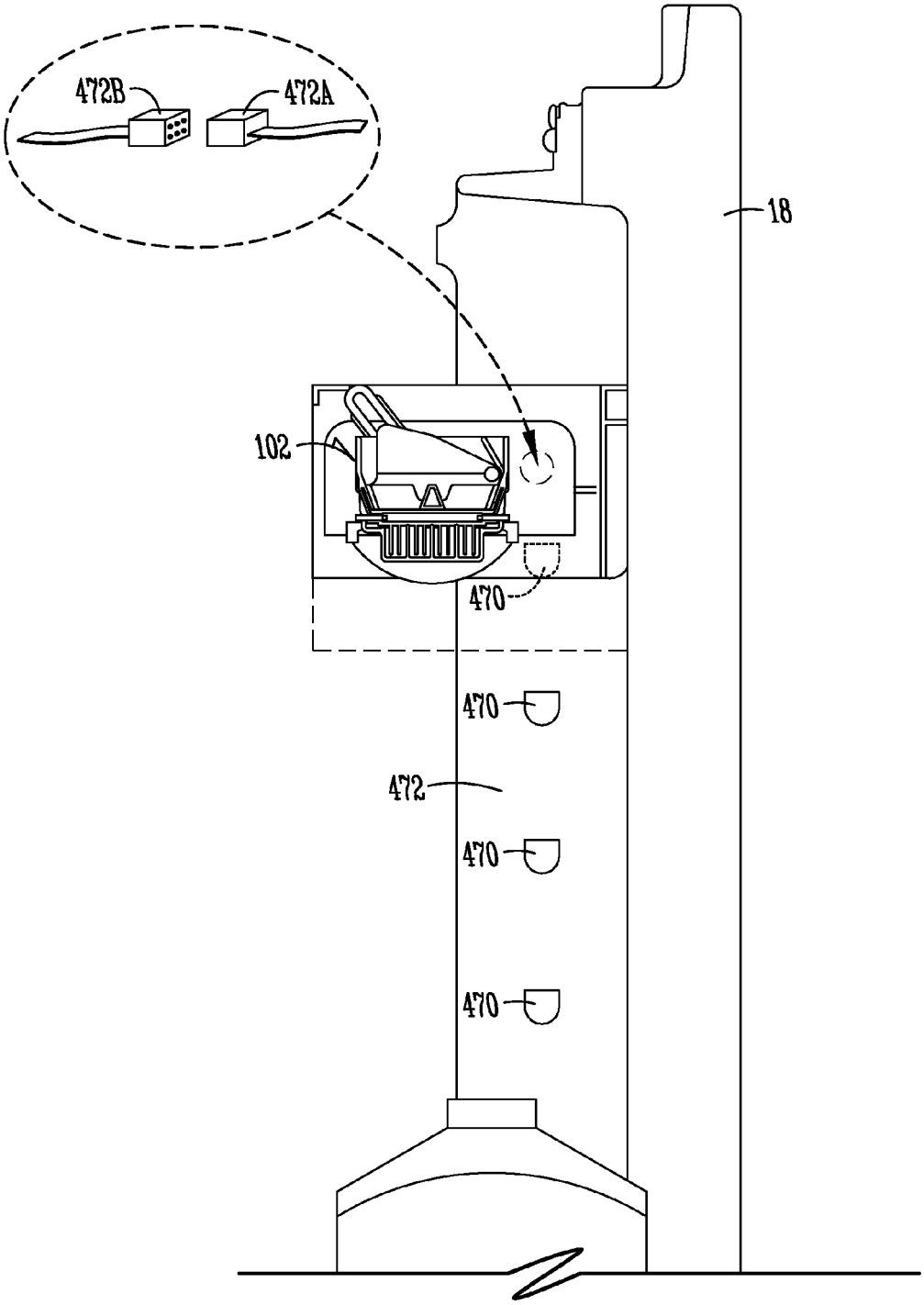
Figure 32:
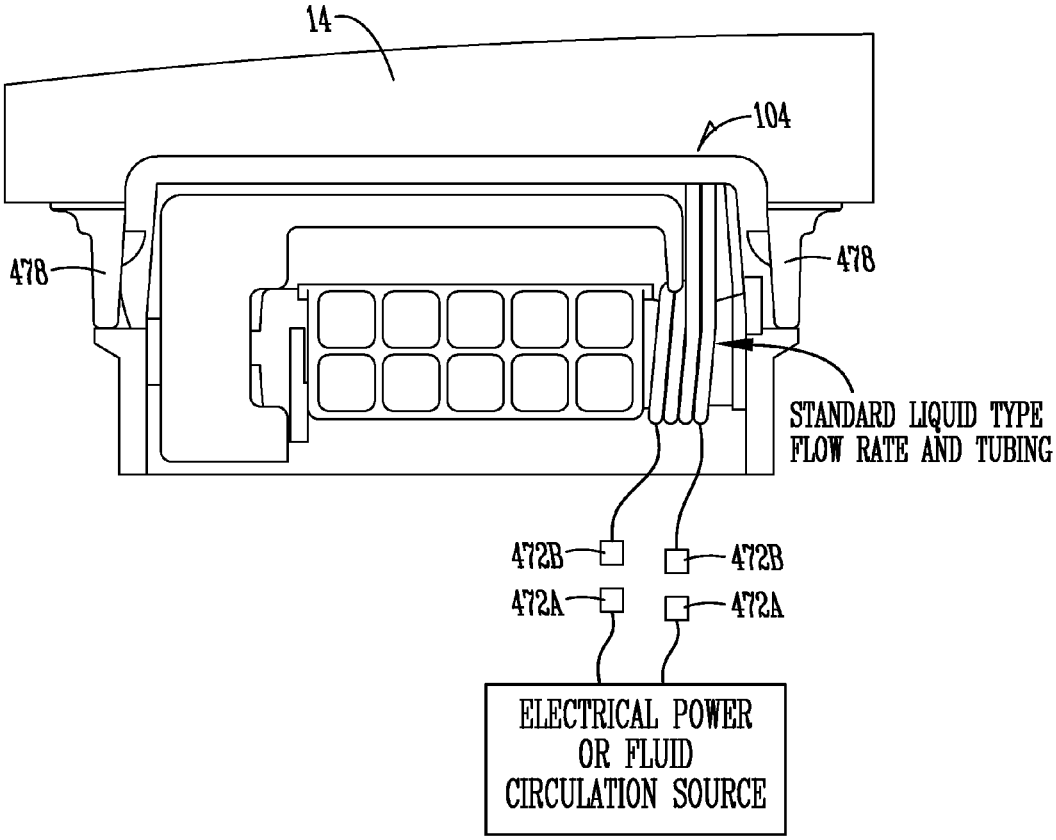

Another aspect relates to a modular ice maker which may be moveable between multiple locations such as multiple locations on a door of the refrigerator, within a fresh food compartment, within a freezer compartment, on a freezer compartment door, or elsewhere within a refrigerator. FIGS. 30-32 illustrate that releasable connectors for fluid flow and/or electricity can be utilized to further allow quick and easy connection of an enclosure in whatever form (including electrically activated components such as ice maker 102 and the like). Connector pairs 472A and 472B (FIG. 31) or analogous electrical connectors. As shown in FIG. 30, a door liner 472 is shown and mounts 470 are shown extending along the door liner 472 for mounting the ice maker 102. FIG. 32 shows the mounting connectors 478. As can be further appreciated, there could be just one mounting connection for each different location within refrigerator cabinet 12. In other words, it is not required that they be vertical adjustability at each mounting location. Thus, the ice maker may be removably mounted in multiple locations. The ice bin and other components may also be removably mounted. Thus, the ice maker and ice storage bin may be modular in nature and may be moveable throughout a refrigerator with custom temperature needs being met regardless of location of the ice maker within a refrigerator and without needing to route air. A variety of different types of enclosures or bins to meet the temperature ranges and locations throughout the refrigerator may be used. As shown, standard interfaces at each location and for each type of bin.

Figure 33A:
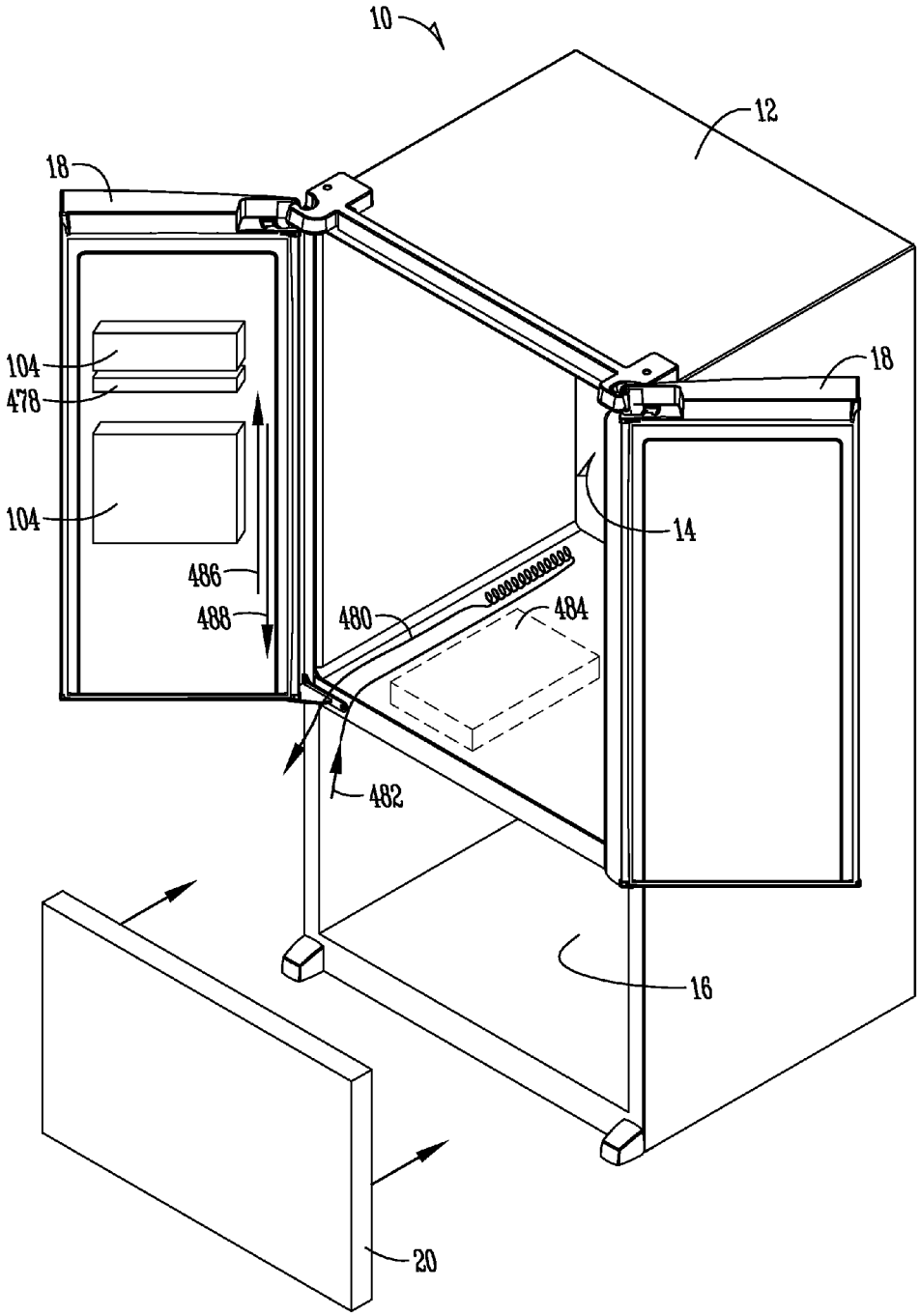
FIG. 33A illustrates a moveable and removably mounted icemaker mounted in a first position.

FIG. 33A illustrates an exemplary embodiment of a refrigerator. In FIG. 1 a refrigerator 10 has a bottom mount freezer with French doors. It is should be understood that one or more of the disclosed aspects may be used in other configurations including side-by-side refrigerator configurations and other types of configurations. The refrigerator 10 has a refrigerator cabinet 12. One or more compartments are disposed within the refrigerator cabinet 12. As shown in FIG. 1, a fresh food compartment 14 is shown with French doors 18 providing access to the fresh food compartment 14. Below the fresh food compartment 14 is a freezer compartment 16 which may be accessed by pulling drawer or door 20 outwardly. Mounted on the inside of the left side French door 18 is an ice maker 102 preferably with a thermoelectric cooler (TEC) 478. Below the ice maker 102 is an ice storage bucket 104. Electric connections 486 and fluid connections 488 provide electric connections and fluid to the ice maker including water for making ice and cooling fluid. These connections may connect to connections 480, 482 which may in turn be operatively connected to a cooling bank 484.

Preferably the connections are durable and robust with quick connectors. As shown, connection 480 may be a coiled to allow it to be stretched.

Figure 33B:
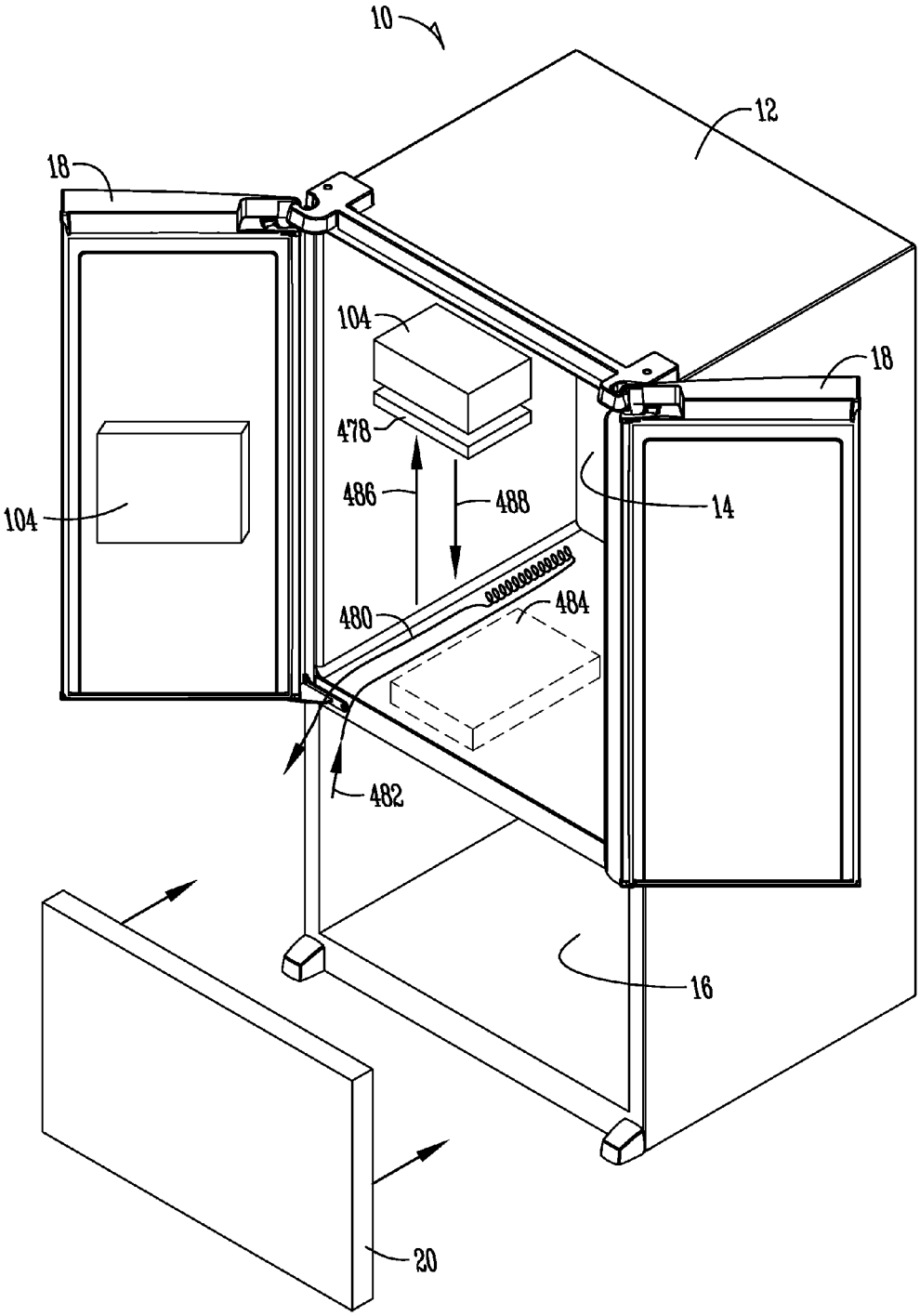
FIG. 33B illustrates the moveable and removably mounted icemaker mounted in a second position.

FIG. 33B illustrates the refrigerator of FIG. 33A, however, in FIG. 33B, the ice maker 102 is stowed in the fresh food compartment 14 of the refrigerator cabinet 12. The configuration shown in FIG. 33B is particularly applicable when the refrigerator is being shipped to a home location. Thus, the refrigerator door 18 may be removed for installation or shipping and then once the refrigerator door 18 is mounted to the refrigerator cabinet 12, the ice maker 102 may be moved to the inside of the French door 18. In other words, the refrigerator may be configured for relocation by positioning the ice maker in a first position within the refrigerator cabinet without disconnecting the fluid line from the ice maker. Then the refrigerator may be relocated. Then the refrigerator may be installed by moving the ice maker from the first position within the refrigerator cabinet to a second position within the refrigerator cabinet without disconnecting or connecting the fluid line to the ice maker. Thus, the modularity of the ice maker 102 provides additional advantages as well.

Figure 34:
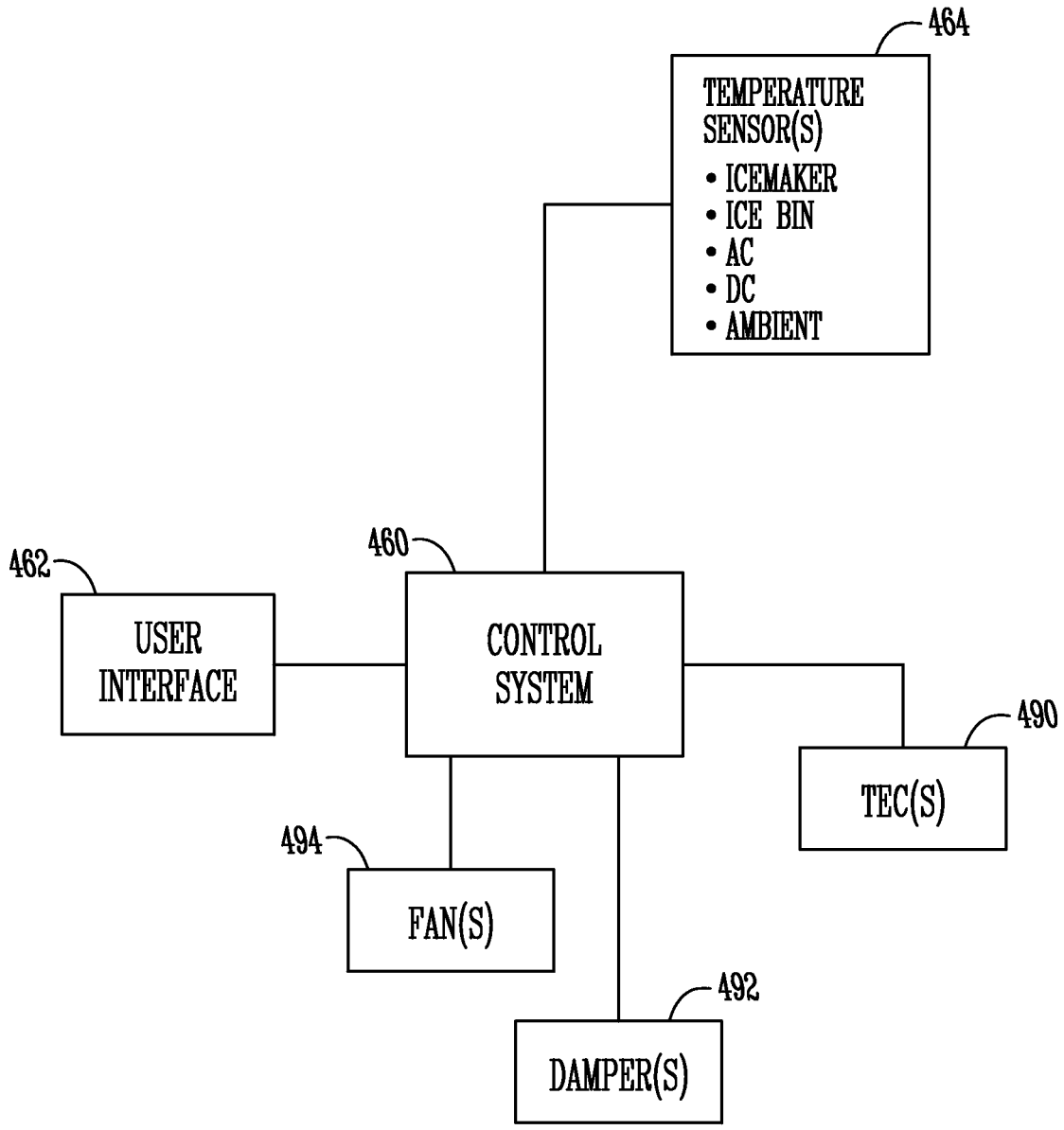
FIG. 34 illustrates one example of a control system.

FIG. 34 illustrates another example of a control system associated with a refrigerator. The control system 460 is operatively connected to a user interface 462 which may include a display, buttons, a touch screen interface, or other types of user controls. The control system 460 may also be operatively connected to one or more dampers 492 and configured to control the one or more dampers 492. The control system 460 may be operatively connected to one or more fans 492 and configured to control the one or more fans 494. The control system 460 may also be operatively connected to one or more thermo electric coolers 490 and configured to control the one or more thermo electric coolers 490. The control system 460 may also be operatively connected to one or more temperature sensors 464 and configured to receive temperature signals or data from the one or more temperature sensors. In operation, the control system 460 may be used to control temperature at various locations within the refrigerator such as by controlling air flow using the damper(s) and fan(s) 494 or by controlling temperature through operation of the thermo electric coolers 490 to heat or cool different areas within the refrigerator. The control of temperature may be used to reach or maintain particular temperatures within different compartments, different areas, the ice maker, the ice storage bin, or other locations within the refrigerator including in the various manners described herein.

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. It is to be further understood that in addition to specific examples or embodiments described, various additional embodiments may be constructed by combining different elements or functions from different examples or embodiments. These combinations are fully contemplated herein and form a part of this disclosure. It is understood that any other modifications, substitutions, and/or additions may be made, which are within the intended spirit and scope of the invention. From the foregoing, it can be seen that the exemplary aspects and configurations shown and described accomplish at least all of the intended objectives and purpose of the disclosure.

What is claimed is:

1. A refrigerator, comprising:

a housing comprising a refrigerated compartment and a freezer compartment;

an icemaker disposed within the housing, the icemaker having an ice mold;

a thermoelectric device disposed remote from the icemaker, the thermoelectric device having a warm side and a cold side when a polarity of an applied voltage to said thermoelectric device is in a first direction in which the icemaker makes ice, the cold side fluidly coupled to the icemaker via a liquid refrigerant line, the liquid refrigerant line comprising a fluid supply pathway and a fluid return pathway;

a flow pathway in communication with the warm side of the thermoelectric device;

a first heat carrier in the flow pathway, the flow pathway comprising a flow controller, wherein said flow controller is configured to operate by selectively switching into a first position and a second position; said first position is configured to fluidly communicate the first heat carrier from the flow pathway with a first discrete space within the refrigerator compartment via said flow controller; and said second position is configured to fluidly communicate the first heat carrier from the flow pathway with a second discrete space within the freezer compartment via said flow controller; and wherein said first heat carrier is configured transfer heat from the warm side of the thermoelectric device to said first discrete spave when the flow controller is in said first position and transfer heat from the warm side of the thermoelectric device to said second discrete space when the flow control is in said second position.

2. The refrigerator of claim 1 further comprising an ice storage bin for containing ice positioned below the icemaker.

3. The refrigerator of claim 1 wherein the first discrete space is in a bin, and wherein the refrigerator is configured to transfer the heat carrier from the warm side of the thermoelectric device to the bin of the refrigerator.

4. The refrigerator of claim 1 further comprising a plurality of fastenerless mounts throughout the housing and connectors on the icemaker for removably mounting the icemaker to the mounts in various locations within the housing.

5. The refrigerator of claim 1 wherein the supply pathway acquires a second heat carrier from a location remote from the icemaker.

6. The refrigerator of claim 1, wherein the supply pathway is in communication between the cold side of the thermoelectric device and the icemaker.

* * * * *